US006156470A

United States Patent [19]

Matsunaga et al.

[11] Patent Number: 6,156,470

[45] **Date of Patent: *Dec. 5, 2000**

[54] TONER HAVING NEGATIVE TRIBOELECTRIC CHARGEABILITY AND IMAGE FORMING METHOD

[75] Inventors: Satoshi Matsunaga, Mishima; Hirohide Tanikawa, Shizuoka-ken; Minekazu Endo, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/362,221

[22] Filed: Jul. 28, 1999

[30] Foreign Application Priority Data

Jul. 31, 1998 [JP] Japan ..... 10-216609
Dec. 4, 1998 [JP] Japan ..... 10-345943

[51] Int. Cl.[7] ..... G03G 9/097; G03G 13/22

[52] U.S. Cl. ..... 430/110; 430/111; 430/124

[58] Field of Search ..... 430/110, 111, 430/124

[56] References Cited

U.S. PATENT DOCUMENTS

| | | | |
|---|---|---|---|
| 2,297,691 | 10/1942 | Carlson | 430/31 |
| 3,666,363 | 5/1972 | Tanaka et al. | 430/55 |
| 4,071,361 | 1/1978 | Marushima | 430/55 |
| 4,857,432 | 8/1989 | Tanikawa et al. | 430/106 |
| 5,075,185 | 12/1991 | Bertrand et al. | 430/45 |
| 5,135,833 | 8/1992 | Matsunaga | 430/110 |
| 5,200,288 | 4/1993 | Ando et al. | 430/110 |
| 5,256,515 | 10/1993 | Law et al. | 430/110 |
| 5,268,248 | 12/1993 | Tamkawa et al. | 430/106 |
| 5,275,900 | 1/1994 | Ong et al. | 430/110 |
| 5,298,354 | 3/1994 | Matsunaga et al. | 430/99 |
| 5,300,387 | 4/1994 | Ong | 430/110 |
| 5,529,872 | 6/1996 | Grychtol et al. | 430/110 |
| 5,972,553 | 10/1999 | Katada et al. | 430/110 |

FOREIGN PATENT DOCUMENTS

| | | |
|---|---|---|
| 6-214421 | 8/1994 | Japan . |
| 9-146292 | 6/1997 | Japan . |
| 9-244294 | 9/1997 | Japan . |
| 10-010785 | 1/1998 | Japan . |
| 10-090939 | 4/1998 | Japan . |
| 10-115951 | 5/1998 | Japan . |

OTHER PUBLICATIONS

Database WPI, Sect. Ch, Week 197742, Derwent Publ., AN 1977–75153y, XP002134385 for JP 52–107837.
Database WPI, Sect. Ch, Week 198336, Derwent Publ., AN 1983–755975, XP002134386 for JP 58–127937.
Database WPI, Sect. Ch, Week 199322, Derwent Publ., AN 1993–177999, XP002134387 for JP 05–107803.
Database WPI, Sect.. Ch, Week 199618, Derwent Publ., AN 1996–176750, XP002134388 for JP 08–054753.

*Primary Examiner*—Roland Martin
*Attorney, Agent, or Firm*—Fitzpatrick, Cella, Harper & Scinto

[57] ABSTRACT

A toner having a negative triboelectric chargeability is constituted by at least a binder resin, a colorant, a wax and an organic metal compound. The toner is characterized in that: (a) the toner has an acid value of 5–35 mgKOH/g, (b) the binder resin comprises a vinyl polymer, (c) the binder resin in the toner contains a chloroform-insoluble content in an amount of 3–50 wt. %, (d) the toner contains a THF (tetrahydrofuran)-soluble content providing a GPC (gel permeation chromatography) chromatogram exhibiting a main peak in a molecular weight range of 5,000–30,000 and at least one sub-peak and/or shoulder in a molecular weight range of $2\times10^5$–$15\times10^5$ and including 15–70% of a component having molecular weights of $1\times10^4$–$10\times10^4$, and (e) the organic metal compound is an organic zirconium compound comprising a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids.

124 Claims, 4 Drawing Sheets

TONER HAVING NEGATIVE TRIBOELECTRIC CHARGEABILITY AND IMAGE FORMING METHOD

FIELD OF THE INVENTION AND RELATED ART

The present invention relates to a toner having a negative triboelectric chargeability used in a recording method utilizing electrophotography, electrostatic recording, electrostatic printing or toner jet recording, and an image forming method using the toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., via or without via an intermediate transfer member, as desired, fixed by heating, pressing, or heating and pressing, or with solvent vapor to obtain a copy or print carrying a fixed toner image.

As for the step of fixing the toner image onto a sheet (transfer) material such as paper which is the final step in the above-mentioned electrophotographic process, various methods and apparatus have been developed, of which the most popular one is a heating and pressing fixation system using hot rollers, or a fixed heat generating heater for fixation via a heat-resistant film.

In the heating and pressing system using hot rollers, a sheet carrying a toner image to be fixed (hereinafter called "fixation sheet") is passed through hot rollers, while a surface of a hot roller having a releasability with the toner is caused to contact the toner image surface of the fixation sheet under pressure, to fix the toner image. In this method, as the hot roller surface and the toner image on the fixation sheet contact each other under a pressure, a very good heat efficiency is attained for melt-fixing the toner image onto the fixation sheet to afford quick fixation.

In the fixing step, however, a hot roller surface and a toner image contact each other in a softened or melted state and under a pressure, so that a part of the toner is transferred and attached to the fixing roller surface and then re-transferred to a subsequent fixation sheet to soil the fixation sheet. This is called an offset phenomenon and is remarkably affected by the fixing speed and temperature. Generally, the fixing roller surface temperature is set to be relatively low in case of a slow fixing speed and set to be relatively high in case of a fast fixing speed. This is because a constant heat quantity is supplied to the toner image for fixation thereof regardless of a difference in fixing speed.

The toner image on a fixation sheet is deposited in several layers, so that there is liable to occur a large temperature difference between a toner layer contacting the heating roller and a lowermost toner layer particularly in a hot-fixation system using a high heating roller temperature. As a result, a topmost toner layer is liable to cause a so-called high-temperature offset phenomenon because of excessive softening or melting of the topmost toner layer in case of a high heating roller temperature, while a so-called low-temperature offset is liable to occur because of insufficient melting of the lowermost toner layer in case of a low heating roller temperature.

In order to solve the above problem, it has been generally practiced to increase the fixing pressure in case of a fast fixing speed in order to promote the anchoring of the toner onto the fixation sheet. According to this method, the heating roller temperature can be somewhat lowered and it is possible to obviate a high-temperature offset phenomenon of an uppermost toner layer. However, as a very high shearing force is applied to the toner layer, there are liable to be caused several difficulties, such as a winding offset that the fixation sheet winds about the fixing roller, the occurrence of a trace in the fixed image of a separating member for separating the fixation sheet from the fixing roller, and inferior fixed images, such as resolution failure of line images and toner scattering, due to a high pressure.

Further, it is difficult to uniformly disperse various additives, particularly a wax, added for toner production, thus being liable to result in problems not only in fixing performance but also in developing performance of the resultant toner. This difficulty is liable to be noticeable especially in production of smaller-particle size toners which are preferred in recent years.

JP-A 6-214421 discloses an image forming method using a toner containing an aluminum complex as a charge-promoting agent.

JP-A 10-11591 discloses a toner having a peak in a specific molecular weight range and a specific tetrahydrofuran (THF)-insoluble content.

JP-A 10-10785 discloses a toner containing a charge control agent comprising a metal complex of a monoazo compound and a metal complex of aromatic hydroxycarboxylic acid.

JP-A 10-90939 discloses a toner containing substantially no THF-insoluble content and having a peak in a specific molecular weight range and a specific acid value.

JP-A 9-146292 discloses a toner containing polyalkylene fine particles having a specific coefficient of kinetic friction, wherein a contact angle at a surface of a solid image fixed on a sheet for an overhead projector (OHP sheet) is in a specific range.

JP-A 9-244294 discloses a toner containing polyalkylene fine particles having a specific coefficient of kinetic friction, wherein a contact angle and dielectric loss tangent of the toner satisfy a specific relationship.

In the above-mentioned toners, the fixability is somewhat improved but the offset-prevention effect on the hot roller or the heat-resistant film is insufficient.

SUMMARY OF THE INVENTION

A generic object of the present invention is to provide a toner having a negative triboelectric chargeability and having solved the above-mentioned problems, and an image forming method using the toner.

A more specific object of the present invention is to provide a toner having a negative triboelectric chargeability capable of exhibiting a good low-temperature fixability and causing no heating member soiling due to offset phenomenon in a low to high temperature range even when used in a high to medium-speed apparatus using a hot roller fixing device or a medium to low-speed apparatus using a fixed heater via a heat-resistant film.

Another object of the present invention is to provide a toner having a negative triboelectric chargeability capable of providing a halftone image exhibiting good fixability even when formulated as a smaller particle size toner containing a large amount of a colorant, particularly a magnetic material.

Another object of the present invention is to provide a toner having a negative triboelectric chargeability capable of retaining a sufficient offset-prevention effect even on a fixing member and a cleaning member which have been deteriorated with time (year) and providing an excellent releasability and a good developing performance in combination.

A further object of the present invention is to provide an image forming method using a toner as described above.

According to the present invention, there is provided a toner having a negative triboelectric chargeability, comprising: at least a binder resin, a colorant, a wax and an organic metal compound, wherein (a) the toner has an acid value of 5–35 mgKOH/g, (b) the binder resin comprises a vinyl polymer, (c) the binder resin in the toner contains a chloroform-insoluble content in an amount of 3–50 wt. %, (d) the toner contains a THF (tetrahydrofuran)-soluble content providing a GPC (gel permeation chromatography) chromatogram exhibiting a main peak in a molecular weight range of 5,000–30,000 and at least one sub-peak and/or shoulder in a molecular weight range of $2\times10^5$–$15\times10^5$ and including 15–70% of a component having molecular weights of $1\times10^4$–$10\times10^4$, and (e) the organic metal compound is an organic zirconium compound comprising a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids.

According to the present invention, there is also provided an image forming method, comprising:

a developing step of developing an electrostatic image held on an image-bearing member with a toner having a negative triboelectric chargeability to form a toner image on the image-bearing member, a transfer step of transferring the toner image formed on the image-bearing member onto a recording material via or without via an intermediate transfer member, and a fixing step of fixing the toner image onto the recording material by a heat-fixing means, wherein the toner comprises at least a binder resin, a colorant, a wax and an organic metal compound, wherein (a) the toner has an acid value of 5–35 mgKOH/g, (b) the binder resin comprises a vinyl polymer, (c) the binder resin in the toner contains a chloroform-insoluble content in an amount of 3–50 wt. %, (d) the toner contains a THF (tetrahydrofuran)-soluble content providing a GPC (gel permeation chromatography) chromatogram exhibiting a main peak in a molecular weight range of 5,000–30,000 and at least one sub-peak and/or shoulder in a molecular weight range of $2\times10^5$–$15\times10^5$ and including 15–70% of a component having molecular weights of $1\times10^4$–$10\times10^4$, and (e) the organic metal compound is an organic zirconium compound comprising a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
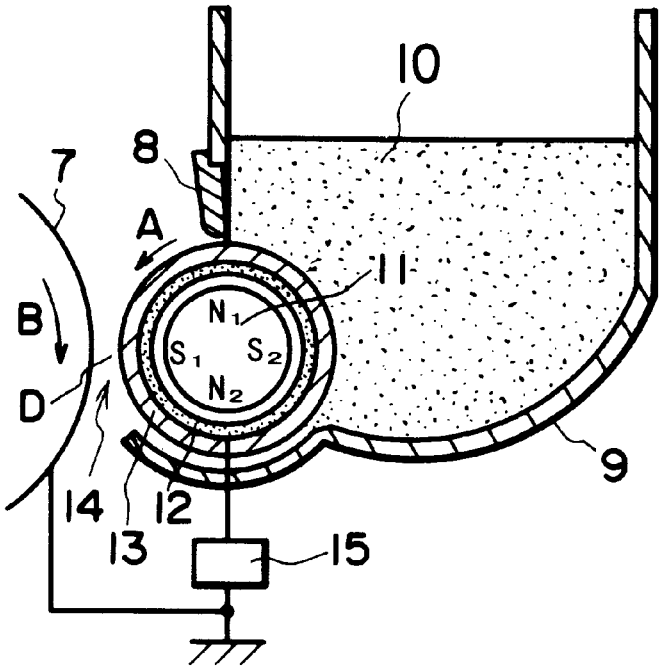
FIGS. 1 and 2 are respectively a sectional illustration of a developer replenishment-type developing device equipped with a developer-carrying member and a magnetic blade (FIG. 1) or an elastic blade (FIG. 2), respectively, as a regulating member and applicable to an embodiment of the image forming method according to the invention.

We have found it possible to provide a toner having a quick chargeability, having a high chargeability even in a high temperature—high humidity environment, free from excessive charging even in a low temperature—low humidity environment and causing less heating member soiling due to offset phenomenon irrespective of a fixation mode of a fixing member by using a toner characterized by a combination of a negative charge control agent comprising an organic zirconium compound (e.g., organic zirconium complex, organic zirconium complex salt or organic zirconium salt) obtained by reaction of a zirconium compound with an aromatic diol, an aromatic monocarboxylic acids an aromatic polycarboxylic acid or/and an aromatic hydroxycarboxylic acid, with a binder resin comprising a vinyl polymer controlled to have a specific acid value and molecular weight distribution described hereinafter. We have also found it possible to maintain a sufficient offset-prevention effect even on a fixing member and a cleaning member which have been deteriorated with time in repetitive use by using a toner providing an excellent releasability and a good developing performance in combination.

More specifically, according to our study, it has been found that improvements alone in low-temperature fixability and anti-high-temperature offset performance of the toner are insufficient to prevent soiling of a fixing member (device) due to offset phenomenon irrespective of a heating mode of the fixing member and it is important therefor to improve a releasability of the toner to the fixing member.

The improvement in offset performance of the toner has been conventionally identified with that in toner fixability. However, the improvement in offset performance resulting from the fixability improvement based on an improvement in properties of a binder resin and a releasing agent, such as a wax, contained in the toner has a limit and accordingly is insufficient to prevent the fixing member soiling.

Further, even if releasabilities of the fixing member and a cleaning member are enhanced and expected to have a sufficient offset-prevention effect in an initial stage of the use of these members, the respective members are deteriorated with the lapse of time (years) when a toner exhibiting an insufficient releasability is used for a long period of time, thus finally causing offset phenomenon in some cases.

There has been conventionally proposed the use of a toner including a binder resin containing an insoluble content in an organic solvent (such as chloroform or THF) in view of an improvement in anti-hot (high-temperature) offset performance of a toner. Even such a toner, however, fails to achieve a sufficient offset-prevention effect for the fixing member and the cleaning member deteriorated with time (years) in some cases. Further, the toner can contain a wax for the purpose of imparting a releasability thereto but such a wax is required to be contained in a large amount in order to maintain a sufficient offset-prevention effect for the above-deteriorated fixing and cleaning members. In this case, the resultant toner is liable to be accompanied with inferior developing performances, such as a lowering in image density in continuous image formation and an increase in fog density. In addition, it is difficult to control a dispersion state of a wax contained in toner particles, so that the resultant toner includes a large amount of liberated wax (free wax component). As a result, the toner is liable to remain on a photosensitive member due to insufficient cleaning, thus leading to image defects.

We have found that a toner containing the vinyl polymer as a binder resin is required to satisfy a good releasability and a good developing performance at the same time in order to retain a sufficient offset-prevention effect even with respect to a fixing member and cleaning member deteriorated with time (years) in continuous image formation. Further, we have found that such a toner is realized by providing the toner with a specific acid value and providing the vinyl polymer (as the binder resin) with a specific chloroform-insoluble content and THF (tetrahydrofuran)-soluble content providing a GPC (gel permeation chromatography) chromatogram exhibiting a main peak and a sub-peak and/or shoulder in a specific molecular weight range.

In the present invention, the toner may have an acid value of 5–35 mgKOH/g, preferably 10–30 mgKOH/g. Below 5 mgKOH/g and above 35 mgKOH/g, the toner containing the organic zirconium compound (described later) is liable to lower an image density in continuous image formation.

The toner of the present invention may contain a chloroform-insoluble content in an amount of 3–50 wt. %, preferably 5–45 wt. %, more preferably 10–40 wt. %. Below 3 wt. % and above 50 wt. %, a wax contained in the toner is not readily kept in a state suitable for its dispersion in some cases and the toner is liable to be attached to the fixing member in continuous image formation.

The binder resin (vinyl polymer) contained in the toner of the present invention may contain a THF-soluble content providing a GPC chromatogram exhibiting a main peak in a molecular weight range of 5,000–30,000, preferably 7,000–25,000, more preferably 9,000–20,000 and at least one sub-peak and/or shoulder in a molecular weight range of $2\times10^5$–$15\times10^5$, preferably $3\times10^5$–$12\times10^5$ and including 15–70%, preferably 20–60%, of a component having molecular weights of $1\times10^4$–$10\times10^4$.

When the main peak is present in a molecular weight range below 5,000 or above 30,000, it is difficult to place the organic zirconium compound in an appropriate dispersion state in the toner, thus resulting in a lower image density in some cases.

When the sub-peak and/or shoulder is not present in a molecular weight range of at least $2\times10^5$, the organic zirconium compound is not readily kept in an appropriate dispersion state in the toner and the resultant image density is liable to be lowered. Further, when the sub-peak and/or shoulder is not present in a molecular weight range of $2\times10^5$–$15\times10^5$ but present in a molecular weight range above $15\times10^5$, it is difficult to keep the organic zirconium compound and other additives in their appropriate dispersion states by a relatively higher molecular weight component and a relatively lower molecular weight component constituting the binder resin of the toner, thus resulting in a lowering in cleaning performance with respect to the toner particles on the photosensitive member in continuous image formation.

When the component having molecular weight of $1\times10^4$–$10\times10^4$ is contained in an amount below 15%, a dispersion of the organic zirconium compound is not readily kept in an appropriate state to adversely affect a developing performance of the toner, thus lowering an image density. Above 70%, it is difficult to keep the organic zirconium compound and other additives in their appropriate dispersion states to unstable the resultant toner developing performance, thus resulting in an unstable image density in continuous image formation.

The THF-soluble content of the binder resin contained in the toner may preferably contain 25–50 wt. % of a component having molecular weight of above $10\times10^4$ on its GPC chromatogram. Below 25 wt. % and above 50 wt. %, the organic zirconium compound is not readily kept in an appropriate dispersion state to lower an image density in continuous image formation in some cases.

In the toner according to the present invention, the binder resin comprises a vinyl polymer having carboxyl group (—COOH) and/or carboxylic anhydride group (—CO—O—CO—) (as substituent(s)) prepared through copolymerization of a plurality of monomers including a monomer having carboxyl group and/or carboxylic anhydride group (hereinbelow, sometimes referred to as an "acid monomer"). Further, zirconium (element) of the organic zirconium compound interacts with carboxyl group and/or carboxylic anhydride group as substituent of the vinyl polymer constituting the binder resin contained in the toner of the present invention to form a chloroform-insoluble content.

As described above, the toner according to the present invention (characterized by a combination of the organic zirconium compound and the vinyl polymer) contains, as a negative charge control agent, an organic zirconium compound comprising a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids.

Herein, the "organic zirconium compound" refers to a compound obtained by reaction of a zirconium compound with an aromatic diol, an aromatic monocarboxylic acid, an aromatic polycarboxylic acid or/and an aromatic hydroxycarboxylic acid. Examples of the organic zirconium compound may include an organic zirconium complex compound (complex or complex salt) and an organic zirconium salt.

The organic zirconium compound used in the toner of the present invention may preferably be a zirconium complex or complex salt including units of aromatic diol, aromatic hydroxycarboxylic acid or aromatic carboxylic acid.

In a more preferred embodiment, a zirconium complex or complex salt including two coordinating units (ligands) of aromatic diol, aromatic hydroxycarboxylic acid or aromatic carboxylic acid is contained in the toner as a principal component of a (negative) charge control agent. In this case, an interaction of carboxyl group and/or carboxylic anhydride group (contained as a substituent of the vinyl polymer) with zirconium of the organic zirconium compound, i.e., some complex-forming reaction presumed to be a ligand exchange reaction (hereinbelow, sometimes referred to as a "complex-forming reaction (with zirconium)") can be effectively performed thus allowing localization of a charge control agent suitable for the toner of the present invention. Further, in this case, at least a part of the organic zirconium compound may be presumed not to be present as a zirconium complex or complex salt including coordinating unit(s) of aromatic diol, aromatic hydroxycarboxylic acid or aromatic carboxylic acid.

In the toner according to the present invention, the organic zirconium compound described above may preferably be contained in an amount of 0.5–10 wt. parts, more preferably 1.0–8.0 wt. parts, further preferably 1.5–5 wt. parts, per 100 wt. parts of the binder resin. Below 0.5 wt. part, complex-forming reaction between zirconium and the binder resin becomes insufficient. Above 10 wt. parts, an excessive complex-forming reaction therebetween is liable to occur. As a result, in either case, it is difficult to control a dispersion state of the wax(es) used.

The organic zirconium compound contained in the toner may preferably be contained in a chloroform-insoluble content of the binder resin of the toner in an amount of at least 30 wt. %, more preferably at least 40 wt. %, further preferably at least 50 wt. %, as zirconium (element) based on an entire addition amount in the toner.

Below 30 wt. %, the localization of the charge control agent becomes consequently insufficient and charging stability of the toner is liable to become unstable, thus resulting in a lower image density in continuous image formation in some cases.

The binder resin of the toner of the present invention may preferably contain a chloroform-soluble content having an acid value (Av.S) and a chloroform-insoluble content having an acid value (Av.G) providing a difference therebetween (Av.G–Av.S) of 10–150 mgKOH/g, more preferably 20–130 mgKOH/g, further preferably 30–100 mgKOH/g. Below 10 mgKOH/g, the binder resin is liable to cause an insufficient complex-forming reaction with zirconium (of the organic zirconium compound) and above 150 mgKOH/g, an excessive complex-forming reaction is liable to proceed, thus not readily keeping a dispersion state of the charge control agent at an optimum level. As a result, the charge stability of the toner is liable to be lowered, thus leading to a lowering in image density in continuous image formation.

The toner of the present invention may preferably contain a chloroform-soluble content having an acid value (Av.S) of 10–50 mgKOH/g, more preferably 15–45 mgKOH/g, further preferably 20–40 mgKOH/g. Below 10 mgKOH/g, an insufficient complex-forming reaction (with zirconium) is liable to occur. Above 50 mgKOH/g, an excessive complex-forming reaction is liable to occur.

In order to retain a sufficient offset-prevention effect even on the fixing member and/or cleaning member deteriorated with time (year) in continuous image formation as to the toner using the vinyl polymer as a binder resin, it is necessary to improve a releasability of the toner in terms of a contact angle (of the toner) with respect to water.

The toner containing the binder resin and the organic zirconium compound may preferably exhibit a contact angle to water of 105–130 degrees, more preferably 107–127 degrees, further preferably 110–125 degrees.

Below 105 deg., it is difficult to retain a sufficient offset-prevention effect with respect to the fixing and cleaning members deteriorated in continuous image formation. Above 130 deg., the toner is liable to be accompanied with an inferior developing performance and a poor cleaning performance for residual toner particles on the photosensitive member.

The toner exhibiting a contact angle in the above-mentioned range (105–130 deg.) may be prepared by using a binder resin having a specific acid value, a specific organic zirconium compound as a crosslinking agent, and a wax having specific peak molecular weight (Mp) and structure in combination.

The vinyl polymer contained in the toner as the binder resin may preferably have an acid value of 5–40 mgKOH/g, more preferably 7–35 mgKOH/g, further preferably 10–30 mgKOH/g, in order to control the wax dispersion state through the complex-forming reaction with zirconium (of the organic zirconium compound). Below 5 mgKOH/g, the complex-forming reaction becomes insufficient and above 40 mgKOH/g, the complex-forming reaction proceeds excessively, thus failing to provide the wax with a good dispersion state in either case.

The vinyl polymer before contained in the toner may contain a THF-insoluble content.

The THF-insoluble content may preferably contained in the vinyl polymer (before contained in the toner) in an amount of 2–35 wt. %, more preferably 5–30 wt. %. When the THF-insoluble content is above 35 wt. %, the resultant toner can contain a THF-insoluble content in an amount above 40 wt. %, thus failing to achieve the object of the present invention in some cases.

The THF-insoluble content contained in the binder resin (vinyl polymer) after contained in the toner is an important component for not only imparting an anti-hot (high-temperature) offset performance to the toner but also controlling the wax dispersion state in the kneading step for toner production due to an appropriate melt viscosity of the kneaded mixture given by the THF-insoluble content.

The THF-insoluble content may preferably be contained in the binder resin (after toner production) in an amount of 5–60 wt. %, more preferably 7–55 wt. %, further preferably 10–50 wt. %. Below 5 wt. %, the anti-hot offset performance of the resultant toner is liable to be lowered and the melt viscosity in the kneading step is liable to become too low, thus causing reagglomeration of the wax particles. As a result, it is difficult to appropriately control the wax dispersion state in some cases. Above 60 wt. %, the low-temperature offset phenomenon is liable to occur and in the kneading step, components having high and low melt viscosities are liable to be co-present in mixture, thus resulting in a broader wax particle size distribution. As a result, it is also difficult to appropriately control the wax dispersion state in some cases.

The wax (component) which may be contained in the toner together with the above-mentioned vinyl polymer (binder resin) and the organic zirconium compound may preferably have a molecular-weight distribution based on a GPC exhibiting a maximum peak molecular weight (Mp) of 300–5,000 and an Yw/Mn (weight-average molecular weight/number-average molecular weight) ratio of 1.2–15, more preferably an Mp of 350–4,500 and an Mw/Mn ratio of 1.3–10, further preferably an Mp of 400–4,000 and an Mw/Mn ratio of 1.4–8. If the Mp is below 300 or the Mw/Mn ratio is below 1.2, the particle size of the wax dispersed in toner particles becomes too small. If the Mp is above 5,000 or the Mw/Mn ratio is above 15, the dispersed wax particle size becomes too high. As a result, in either case, an appropriate control of the dispersed wax particle size is not readily performed.

The wax may be used in combination of two or more species of different waxes.

In this case, the waxes contained in the toner may preferably have a molecular-weight distribution based on a GPC exhibiting an Mp of 300–5,000 and an Mw/Mn ratio of 1.2–15, more preferably an Mp of 350–4,500 and an Mw/Mn ratio of 1.5–12, further preferably an Mp of 400–4,000 and an Yw/Mn ratio of 2–10. If the Mp is below 300 or the Mw/Mn ratio is below 1.2, and if the Mp is above 5,000 or the Mw/Mn ratio is above 15, an appropriate control of the dispersed wax particle size in the toner particles is not readily performed.

Preferred examples of the wax contained in the toner may preferably include hydrocarbon waxes, polyethylene waxes or polypropylene waxes. Specifically, it is preferred to use a hydrocarbon wax obtained by subjecting a mixture gas containing carbon monoxide and hydrogen to the Arge process to form a synthesis hydrocarbon wax, a residue obtained by distilling-off of the hydrocarbon wax or a hydrocarbon wax obtained by hydrogenation of the above-obtained hydrocarbon wax or residue thereof. Fractionation of wax may preferably be performed by the press sweating method, the solvent method, vacuum distillation or fractionating crystallization. Such a fractionated hydrocarbon wax may more preferably be used.

The wax used in the toner of the present invention may also preferably include a compound represented by the following formula (I):

$$CH_3\text{-}(CH_2\text{—}CH_2)_a\text{—}CH_2\text{—}CH_2\text{—}A \quad (I)$$

wherein A represents hydroxyl group or carboxyl group, preferably hydroxyl group, and a is an integer of 20–60, preferably 30–50.

When the wax used in the above-mentioned toner is an acid-modified polyethylene or polypropylene, the acid-modified polyethylene or polypropylene may preferably have an acid value of 1–20 mgKOH/g, preferably 1.5–15 mgKOH/g, and may preferably be prepared by modifying polyethylene or polypropylene with at least one species of an acid monomer selected from the group consisting of maleic acid, maleic acid half-ester and maleic anhydride.

In the case where two species of waxes are used in combination, at least one of which may preferably be the above-mentioned wax.

In the toner of the present invention, a wax having a low Mp (peak molecular weight) and a wax having a high Mp may preferably be used in combination as the wax.

Examples of such a combination of two waxes are shown in Table 1 below.

TABLE 1

| Wax | Low-Mp wax | High-Mp wax |
|---|---|---|
| (1) | Hydrocarbon wax (Mp = 1000, Mw/Mn = 1.5, Tmp*1 = ca. 105° C.) | Polypropylene wax (Mp = 3000, Mw/Mn = 9, Tmp = ca. 130° C.) |
| (2) | Wax of formula (I) (A = OH) (Mp = 800, Mw/Mn = 2.0, Tmp = ca. 110° C.) | Polypropylene wax (Mp = 3000, Mw/Mn = 9, Tmp = ca. 130° C.) |
| (3) | Hydrocarbon wax (Mp = 1000, Mw/Mn = 1.5, Tmp = ca. 105° C.) | Modified PP wax*2 (Mp = 4000, Mw/Mn = 9.5, Tmp = ca. 120° C.) |
| (4) | Wax of formula (I) (A = OH) (Mp = 800, Mw/Mn = 2.0, Tmp = ca. 110° C.) | Modified PP wax*2 (Mp = 4000, Mw/Mn = 9.5, Tmp = ca. 120° C.) |
| (5) | Hydrocarbon wax (Mp = 1000, Mw/Mn = 1.5, Tmp = ca. 105° C.) | Modified PE wax*3 (Mp = 3000, Mw/Mn = 5.5, Tmp = ca. 110° C.) |
| (6) | Wax of formula (I) (A = OH) (Mp = 800, Mw/Mn = 2.0, Tmp = ca. 100° C.) | Modified PE wax*3 (Mp = 3000, Mw/Mn = 5.5, Tmp = ca. 110° C.) |
| (7) | Hydrocarbon wax (Mp = 500, Mw/Mn = 1.3, Tmp = ca. 80° C.) | Polypropylene wax (Mp = 3000, Mw/Mn = 9, Tmp = ca. 130° C.) |

*1: Tmp represents a melting point of the wax.
*2: Modified PP wax: maleic acid-modified polypropylene wax having an acid value of 2 mgKOH/g.
*3: Modified PE wax: maleic acid-modified polyethylene wax having an acid value of 2 mgKOH/g.

The toner according to the present invention containing the wax may preferably provide a DSC heat absorption curve obtained by use of a differential scanning calorimeter (DSC) exhibiting a heat absorption main peak in a temperature region of 70–140° C., more preferably 75–135° C., further preferably 80–130° C.

It is also preferred that the wax-containing toner according to the present invention has, on its DSC heat-absorption curve, a heat-absorption main peak and a heat-absorption sub-peak or shoulder in the above specific temperature region. If the heat absorption main peak is in a temperature region other than the above temperature region, it is difficult to satisfy the low-temperature fixability, anti-offset property and anti-blocking performance in combination in some cases.

In the toner of the present invention, the above-mentioned wax may be added and dispersed in a kneading step and may preferably be added in a solution of the vinyl polymer (binder resin) in an organic solvent such a xylene, thus further facilitating uniform dispersion of the wax used.

In the case where two or more species of different waxes are contained in the toner of the present invention, preferred examples of the waxes added at the time of dissolution of the vinyl polymer in an organic solvent (e.g., xylene) may include: a hydrocarbon wax, polyethylene, polypropylene, an acid-modified polypropylene having an acid value of 1–20 mgKOH/g, and an acid-modified polyethylene having an acid value of 1–20 mgKOH/g.

The above waxes may preferably be used in the toner in an amount of 0.2–20 wt. parts, more preferably 0.5–10 wt. parts, per 100 wt. parts of the binder resin.

Hereinbelow, the organic zirconium compound used in the present invention will be described more specifically.

The organic zirconium compounds usable in the present invention may be classified into the following three categories:

(i) zirconium complexes each comprising metal element of zirconium and a ligand of an aromatic diol, an aromatic hydroxycarboxylic acid or an aromatic polycarboxylic acid, (ii) zirconium complex salts each comprising a metal element of zirconium and a ligand of an aromatic diol, an aromatic hydroxycarboxylic acid or an aromatic polycarboxylic acid, and (iii) salts of zirconium with aromatic carboxylic acids inclusive of aromatic carboxylic acids, aromatic hydroxycarboxylic acids and aromatic polycarboxylic acids.

It is preferred to use a zirconium complex or zirconium complex salt including 1–4 units of aromatic diol, aromatic hydroxycarboxylic acid or aromatic polycarboxylic acid so as to form a chelate. It is also possible to use a zirconium complex or complex salt including 1–6 units of coordinating carboxy anions of, aromatic hydroxycarboxylic acid, aromatic carboxylic acid or aromatic polycarboxylic acid. In the case of an organic zirconium salt, it is preferred to use a salt having 1–4 units, more preferably 1–3 units, of aromatic carboxyl acid, aromatic hydroxycarboxylic acid or aromatic polycarboxylic acid. It is also possible to use a mixture of complexes or complex salts having different number of chelates or/and different species of ligands. The zirconium salt can also be a mixture of two or more species of organic zirconium salts including those of different numbers of acids per molecule. The organic zirconium compound can also be a mixture of an organic zirconium complex compound and an organic zirconium salt.

It has been found that the organic zirconium compound provides an excellent developing performance to a mono-component developer, inclusive of a magnetic toner containing magnetic powder, which is required to exhibit a quick chargeability and a high chargeability through relatively few triboelectrification opportunities, because of excellent performances as a negative charge control agent of the organic zirconium compound. It is also optimum to provide a non-magnetic toner used in a non-magnetic mono-component developing method.

It is preferred that the organic zirconium compound is used in combination with a resin having an acid value in order to further improve the triboelectric chargeability while utilizing the polarity of water molecules retained in the toner particles. The dispersibility of the organic zirconium compound in the toner can be improved by using two or more species of waxes having different melting points or molecular weights, thereby providing a toner showing improved uniform chargeability and continuous image formation performances.

The toner according to the present invention containing the organic zirconium compound not only exhibits a sufficient chargeability in a low or high humidity environment but also suppresses a lowering in image density during a long term of continuous image formation. The organic zirconium compound is particularly effective for use in a magnetic toner containing a magnetic iron oxide comprising various different species of elements. Iron oxide containing different elements or oxides or hydroxides of such different elements, or iron oxide forming a mixed crystal with such different elements, may be effective for adsorbing water molecules, thus effectively improving and stabilizing the charging based on utilization of the polarity of water molecules. This effect is particularly enhanced when the binder resin having an acid value (used in the present invention) is used in combination therewith.

The organic zirconium compound used in the present invention includes a zirconium ion capable of easily assuming an octa-coordinated configuration to be coordinated or bonded with oxygen of carboxyl and/or hydroxyl group. Accordingly, when a binder resin having an acid value, such as a vinyl polymer having a functional carboxyl group, is used together therewith, the organic zirconium compound can exhibit a good affinity with and a good dispersibility in the binder resin, so that the liberation thereof from the toner particles can be well suppressed to provide a uniform and continuously stable chargeability. The organic zirconium compound exhibits little adverse effect to the toner transparency, thus being preferable for constituting a color toner.

Further, as the binder resin can be provided with an increased crosslinking via the carboxyl or hydroxyl group of the binder resin coordinated with the zirconium, the binder resin can be provided with an increased rubber elasticity, thus providing an excellent releasability and effective prevention of soiling of the fixing member. Thus, it is preferred that the binder resin is crosslinked to such a degree that it contains a THF-insoluble content. Further, it is possible to exert a shearing force on a kneaded mixture during melt-kneading in toner production, thus improving the dispersion of a colorant such as a magnetic material, a pigment or a dye, to provide a toner exhibiting a high coloring power and/or a clear hue.

As mentioned above, the organic zirconium compound used in the present invention is excellent in triboelectric chargeability-imparting performance, so that it functions as a charge control agent suitable for a magnetic toner requiring a high chargeability. Further, the organic zirconium compound not only shows a good dispersibility thereof in a binder resin but also functions to promote the dispersion of a magnetic material in the binder resin if a resin having an acid value is used as the binder resin, thus providing a magnetic toner with improved uniform chargeability and continuous image formation performances.

Further, it has been found that the organic zirconium compound used in the present invention exerts some influence on the surface tension of the toner binder resin and provides a toner with an excellent releasability when used in combination with a plurality of waxes. As a result, it becomes possible to provide a toner exhibiting excellent anti-offset characteristic and suppressed soiling of the fixing member. This effect is particularly promoted when used in combination with the binder resin having an acid value used in the present invention.

Another characteristic of the organic zirconium compound used in the present invention is that it provides a toner less liable to cause a lowering in developing performance after standing. For example, when the toner is used in a high-humidity environment, then left standing for some pause period and then re-used for image formation, the resultant images cause little lowering in image density.

Further, the toner according to the present invention containing the organic zirconium compound is less liable to cause insufficiently charged toner particles leading to scattering toner particles. For example, a magnetic toner is liable to cause a noticeable scattering in a low-humidity environment wherein the agglomerating force is lowered, thus causing various difficulties. More specifically, in case of an image forming system using the corona charging scheme, the scattered toner is attached to the charging wire to cause discharge abnormality which results in an abnormally charged electrostatic image leading to a streak-like image defect in the case of primary charging and also a streak-like transfer failure in the case of transfer charging. However, the toner according to the present invention can reduce such difficulties. In case of an image forming system using a contact charging scheme, the scattered toner is liable to soil the contact transfer unit and the soiling toner is liable to be transferred to a transfer paper, thus causing so-called back soiling as in the case of the corona charging scheme. The toner according to the present invention is also less liable to cause such difficulty.

In the case of a non-magnetic toner, the toner particle scattering phenomenon is more noticeably caused in a high-humidity environment since the toner is constrained only by an electrostatic force, this scattering phenomenon is also reduced by the toner according to the present invention. Further, in a low-humidity environment, a non-magnetic toner is liable to cause a density irregularity in a halftone image due to insufficiently charged particles. This difficulty can also be reduced by the toner according to the present invention.

Now, the organic zirconium compounds inclusive of zirconium complex, complex salts and salt with aromatic diol, aromatic hydroxycarboxylic acid and aromatic polycarboxylic acid will be described more specifically.

Preferred examples of the zirconium complex or complex salts may include those represented by formulae (1) and (2) below:

(1)

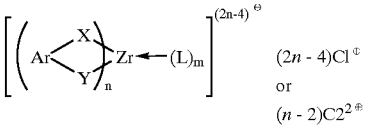

$(2n-4)Cl^{\oplus}$ or $(n-2)C2^{2\oplus}$ wherein Ar denotes an aromatic residual group capable of having a substituent of alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes O or —CO—O—; L denotes a neutral ligand of water, alcohol, ammonia, alkylamine or pyridine; C1 denotes a monovalent cation, such as hydrogen ion, monovalent metal ion, ammonium ion or alkylammonium ion; C2 denotes a divalent cation, such as a metal ion; n is 2, 3 or 4; m is 0, 2 or 4; a plurality (n) of ligands (such as aromatic carboxylic acids and diols) can be identical to or different from each other, and a number (m>0) of neutral ligands can be identical to or different from each other in each complex or complex salt of a formula. Further, each complex or complex salt of a formula can also be a mixture of complex compounds having mutually different n or/and m, or a mixture of complex salts having mutually different counter ions C1 or/and C2. In order to improve the dispersibility in binder resin and charge control ability of a complex or complex salt, it is preferred that the aromatic residue group (Ar) comprises benzene ring, naphthalene ring, anthracene ring or phenanthrene ring; the optional substituent is alkyl, carboxyl or hydroxyl; L is water; and C1 is hydrogen, sodium, potassium, ammonium or alkyl ammonium.

(2)

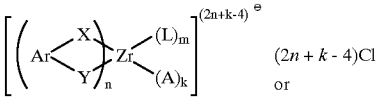

$(2n+k-4)Cl^{\oplus}$ or $(n+k/2-2)C2^{2\oplus}$ wherein Ar denotes an aromatic residue group capable of having a substituent of alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes O or —CO—O—; L denotes a neutral ligand of water, alcohol, ammonia, alkylamine or pyridine; A denotes an anion of halogen, hydroxyl, carboxylate, carbonate, nitrate, sulfate, cyano or thiocyano, a plurality of A can be identical or different when k≧2, C1 denotes a monovalent cation, such as hydrogen ion, monovalent metal ion, ammonium ion or alkylammonium ion; C2 denotes a divalent cation, such as a metal ion; n is 1, 2, 3 or 4; m is 0, 1, 2, 3 or 4; and k is 1, 2, 3, 4, 5 or 6; a plurality of anions A (when ≧2) and/or a plurality (when n≧2) of ligands (such as aromatic carboxylic acids and diols) can be identical to or different from each other, and a plurality (when m≧2) of neutral ligands can be identical to or different from each other in each complex or complex salt of a formula. Further, each complex or complex salt of a formula can also be a mixture of complex compounds having mutually different n or/and m, or a mixture of complex salts having mutually different counter ions C1 or/and C2. In order to improve the dispersibility in binder resin and charge control ability of a complex or complex salt, it is preferred that the aromatic residue group (Ar) comprises benzene ring, naphthalene ring, anthracene ring or phenanthrene ring; the optional substituent is alkyl, carboxyl or hydroxyl; L is water; C1 is hydrogen, sodium, potassium, ammonium or alkylammonium; and A is hydroxyl or carboxylate ion. When A is a divalent anion, k for the counter cation is doubled (replaced by 2k).

Further, preferred sub-classes of zirconium complexes or complex salts may be represented by the following formulae (3)–(8).

(3)

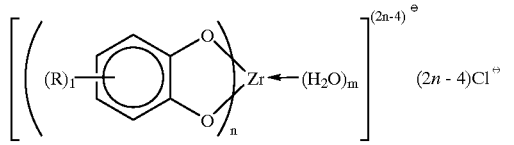

$(2n-4)Cl^{\oplus}$ (4)

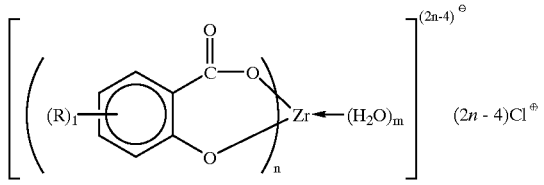

$(2n-4)Cl^{\oplus}$ (5)

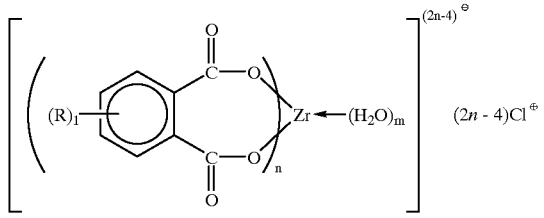

$(2n-4)Cl^{\oplus}$

In the above formulae (3), (4) and (5), R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when l≧2) of R can be mutually linked to form an alicyclic, aromatic or heterocyclic ring capable of having 1–8 similar R substituent(s); a plurality of R can be identical or different; C1 denotes a monovalent cation such as hydrogen, alkaline metal, ammonium or alkylammonium; l is an integer of 1–8; n is 2, 3 or 4; m is 0, 2 or 4; a plurality (n) of ligands can be identical or different in each complex or complex salt of a formula. Further, each complex or complex salt of a formula can be a mixture of complex compounds having mutually different n or/and m, or a mixture of complex salts having mutually different counter ions C1. In order to improve the dispersibility in binder resin and charge control ability of the complex or complex salt, it is preferred that the substituent R is alkyl, alkenyl, carboxyl or hydroxyl; C1 is hydrogen, sodium, potassium, ammonium or alkylammonium. It is particularly preferred to use a complex compound of the formula (4) or a neutral complex of the formula (3), (4) or (5) (wherein n=2) with no counter ion, so as to exhibit excellent environmental stability, dispersibility in the binder resin, and continuous image forming performances.

(6)

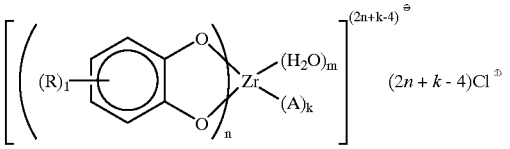

(7)

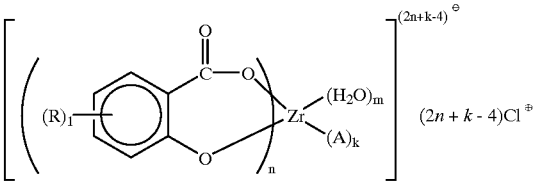

(8)

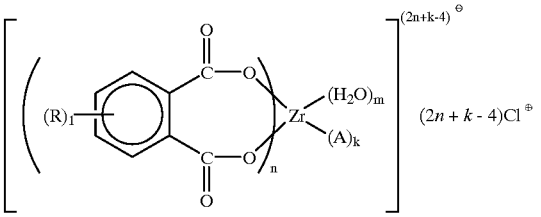

In the above formulae (6), (7) and (8), R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when 1≧2) of R can be mutually linked to form an alicyclic, aromatic or heterocyclic ring capable of having 1–8 similar R substituent(s); a plurality of R can be identical or different; A denotes an anion of halogen, hydroxyl, carboxylate, carbonate, nitrate, sulfate, cyano or thiocyano, a plurality of A can be identical or different; C1 denotes a monovalent cation such as hydrogen, alkaline metal, ammonium or alkylammonium; l is an integer of 1–8; n is 1, 2, 3 or 4; m is 0, 1, 2, 3 or 4; k is 1, 2, 3, 4, 5 or 6; a plurality (when n≧2) of ligands can be identical or different in each complex or complex salt of a formula. Further, each complex or complex salt of a formula can be a mixture of complex compounds having mutually different n or/and m, or a mixture of complex salts having mutually different counter ions C1 or/and anions A. When A is a divalent anion, k for the counter cation is doubled (replaced by 2k). In order to improve the dispersibility in binder resin and charge control ability of the complex or complex salt, it is preferred that the substituent R is alkyl, alkenyl, carboxyl or hydroxyl; C1 is hydrogen, sodium, potassium, ammonium or alkylammonium and A is hydroxyl or carboxylate ion. It is particularly preferred to use a complex compound of the formula (7) or a neutral complex of the formula (6), (7) or (8) (wherein n=2) with no counter ion, so as to exhibit excellent environmental stability, dispersibility in the binder resin, and continuous image forming performances.

The zirconium complex or complex salt used in the present invention includes hexa-coordinated and octa-coordinated complex compound, and some octa-coordinated compound may assume a form of plural-nuclei complex compound wherein ligands form a crosslinkage to provide a rational formula giving a coordination number of 6. Further, it is also possible to form a plural-nuclei compound formed by successive linkage with ligands, such as hydroxyl groups.

Some typical example structures of such complex compounds are indicated by the following formulas (9)–(33), wherein some complex compounds having no ligand L are included. Further, in the formulas (30)–(33), counter cations are omitted.

(9)

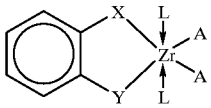

(10)

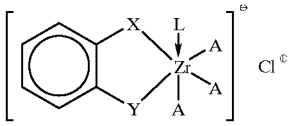

(11)

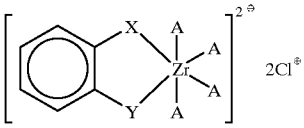

(12)

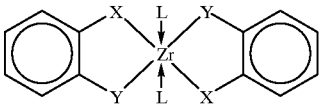

(13)

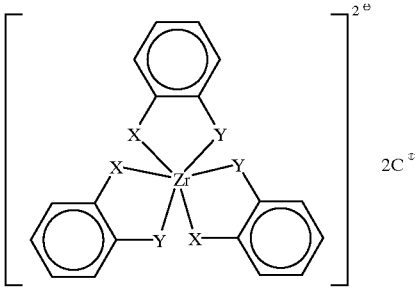

(14)

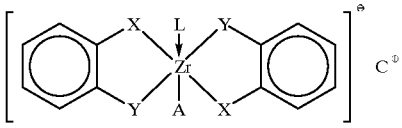

-continued
(15)
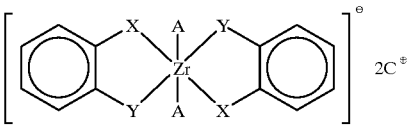
(16)
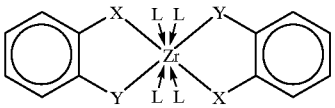
(17)
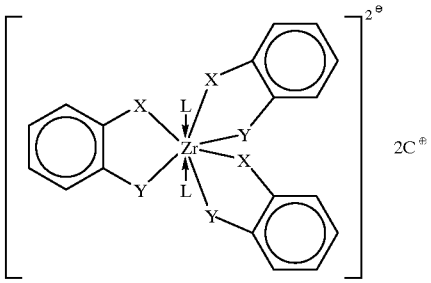
(18)
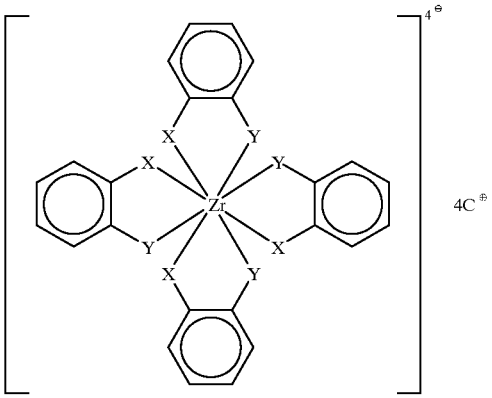
(19)
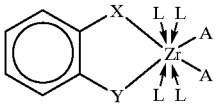
(20)
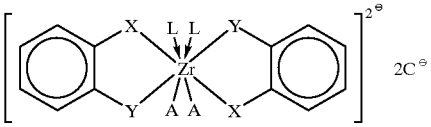
(21)
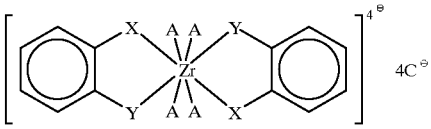
(22)
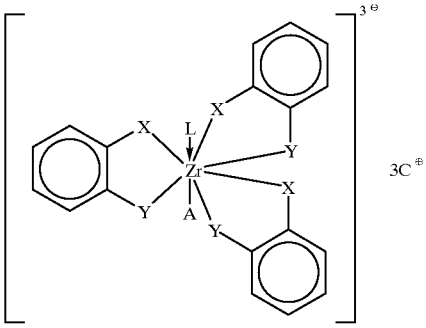
(23)
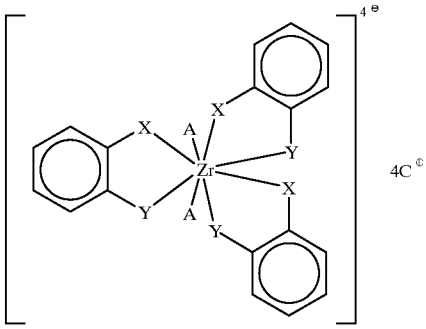
(24)
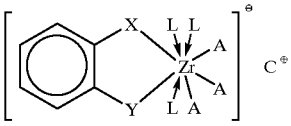
(25)
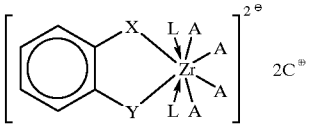
(26)
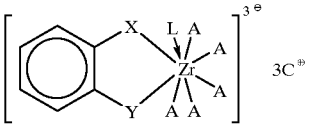

-continued (27)

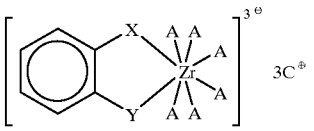

(28)

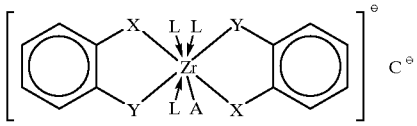

(29)

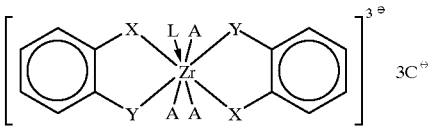

(30)

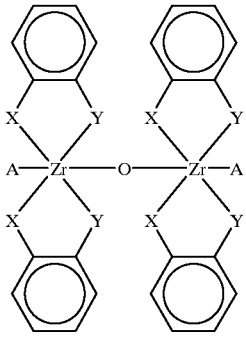

(31)

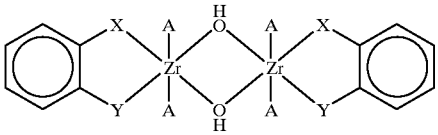

(32)

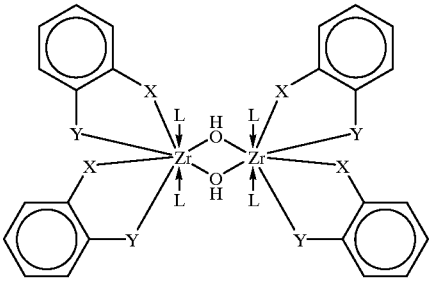

(33)

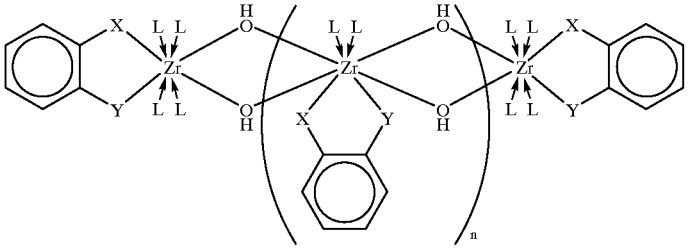

The organic zirconium compound used in the present invention can also assume a form of complex compound wherein a plurality of substituents, e.g., X and Y of hydroxyl and/or carboxyl, attached to an aromatic ring are bonded to different zirconium atoms as represented by a partial structural formula (34) below:

(34)

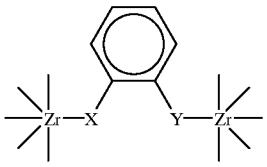

Such complex compounds may more generally be represented by the following formula (35):

(35)

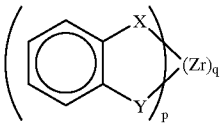

wherein p is an integer of at least 1 and q is an integer of at least 2. From the formula (35), anionic ligands, neutral ligands and counter-cations are omitted from showing.

Preferred classes of aromatic carboxylic acid zirconium salts as a category of the organic zirconium compound used in the present invention may include those represented by the following formulas (36) and (37):

$$(Ar—COO^-)_n Zr^{4\oplus}(4-n)A_{1\ominus} \text{ or } (2-n/2)A_2^{2\ominus} \quad (36)$$

$$(Ar—COO^-)_n Zr^{4\oplus}(O)(2-n)A_{1\ominus} \quad (37)$$

In the above formulas (36) and (37), Ar denotes an aromatic residue group capable of having a substituent of alkyl, aryl, aralkyl, cycloalkyl, alkenyl, alkoxy; aryloxy, hydroxyl, acyloxy, alkoxycarbonyl, aryloxycarbonyl, acyl, carboxyl, halogen, nitro, cyano, amino, amido or carbamoyl; $A_1$ denotes a monovalent anion such as halogen, hydroxyl, nitrate or carboxylate; $A_2$ denotes a divalent anion, such as sulfate, hydrogenphosphate or carbonate; and n is 1, 2, 3 or 4. In case of n≧2 for each metal salt, $A_1$, $A_2$ and a plurality (n) of acid ions, i.e., aromatic carboxylates and aromatic hydroxycarboxylates may be identical to or different from each other. Further, each metal salt of a formula can be a mixture of different salts having different numbers of n. In order to improve the dispersibility in binder resin and chargeability of the zirconium salt, it is preferred that the aromatic residue group (Ar) comprises benzene ring, naphthalene ring, anthracene ring, or phenanthrene ring; the optional substituent is alkyl, carboxyl, hydroxyl or acyloxy.

Further, preferred sub-classes of the zirconium salt may be represented by the following formulas (38) and (39):

(38)

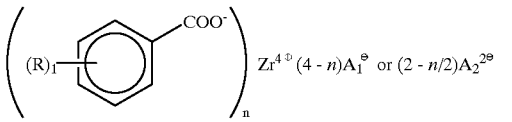

(39)

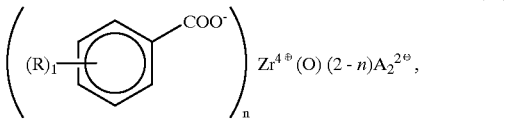

In the above formulae (38) and (39), R denotes a substituent of hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amido or carbamoyl, a plurality (when l≧2) of R can be mutually linked to form an alicyclic, aromatic or heterocyclic ring capable of having 1–8 similar R substituent(s); a plurality of R can be identical or different; $A_1$ denotes a monovalent anion of halogen, hydroxyl, nitrate or carboxylate; $A_2$ denotes a divalent anion of sulfate, hydrogenphosphate or carbonate; l is an integer of 1–8; and n is 1, 2, 3 or 4. In case of n≧2 for each metal salt, the anions $A_1$ and $A_2$ and a plurality of acid ions, i.e., aromatic carboxylates and aromatic hydroxycarboxylates may be identical to or different from each other. Further, each metal salt of a formula can be a mixture of different salts having different numbers of n. In view of improvements in dispersibility in binder resin and chargeability of the zirconium salt, it is preferred that the optional substituent is alkyl, alkenyl, carboxyl, hydroxyl or acyloxy, thus providing the resultant toner with excellent environmental stability and continuous image formation performance.

Further, preferred sub-classes of the zirconium salt may be represented by the following formula (40) or (41):

(40)

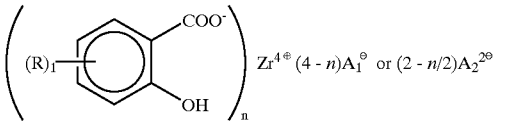

(41)

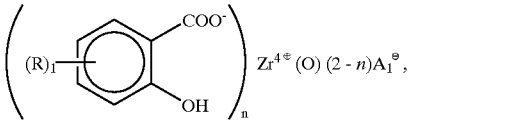

In the above formulas (40) and (41), R denotes a substituent of hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amido or carbamoyl, a plurality (when l≧2) of R can be mutually linked to form an alicyclic, aromatic or heterocyclic ring capable of having 1–8 similar R substituent(s); a plurality of R can be identical or different; $A_1$ denotes a monovalent anion of halogen, hydroxyl, nitrate or carboxylate; $A_2$ denotes a divalent anion of sulfate, hydrogenphosphate or carbonate; l is an integer of 1–7; and n is 1, 2, 3 or 4. In case of n≧2 for each metal salt, the anions $A_1$ and $A_2$ and a plurality of acid ions, i.e., aromatic hydroxycarboxylates as acid ions, may be identical to or different from each other, and that each metal salt of a formula can be a mixture of different salts having different numbers of n. In view of improvement in dispersibility in binder resin and chargeability of the zirconium salt, it is preferred that the optional substituent is alkyl, alkenyl, carboxyl, hydroxyl or acyloxy, thus providing the resultant toner with excellent environmental stability and continuous image-forming performance.

The organic zirconium compound used in the present invention may be synthesized by dissolving a zirconium compound, such as zirconium chloride oxide, zirconium sulfate or an organic acid salt of zirconium in a solvent, such as water, alcohol or aqueous alcohol solution, and adding thereto (1) an aromatic carboxylic acid, an aromatic diol or an alkaline metal salt of these or (2) an aromatic carboxylic acid or an aromatic diol and an alkaline agent. The product organic zirconium compound may be purified by recrystallization from, e.g., an aqueous alcohol solution and washing with alcohol. Further, in the case of producing a complex salt, the above-prepared product may be treated with a mineral acid, an alkaline agent, an amine agent, etc., to prepare complex salts having various counter-ions. Thus, it is also possible to obtain an organic zirconium compound usable in the present invention which is a mixture of complex salts having a plurality of counter-ions selected from, e.g., hydrogen ion, alkaline metal ions and ammonium ion.

Hereinbelow, specific examples of the organic zirconium compound used in the present invention are enumerated with their rational formulas. Such organic zirconium compounds can include 2–4 water molecules as ligands but such water molecules are omitted from showing from the following examples. Further, such organic zirconium compound may include plural species of counter-ions but only a major counter-ion (largest in amount) is indicated in the following examples. In the following formulas, tBu- denotes a tertiary butyl group ($CH_3$—$C(CH_3)_2$—), Bu- denotes a normal-butyl group (n—$C_4H_9$—), MeO— denotes a methoxy group ($CH_3O$—), Me- denotes a methyl group ($CH_3$—), and iPr- denotes an iso-propyl group ($(CH_3)_2CH$—).

(42)
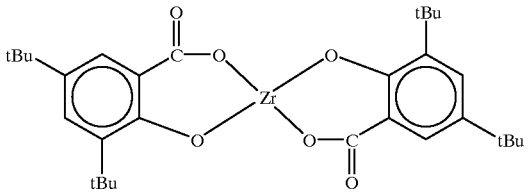
(43)
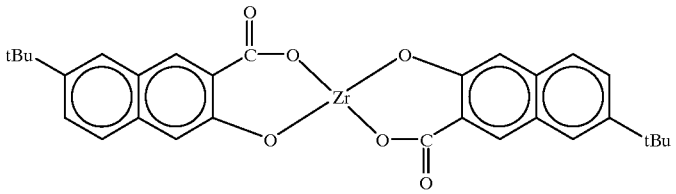
(44)
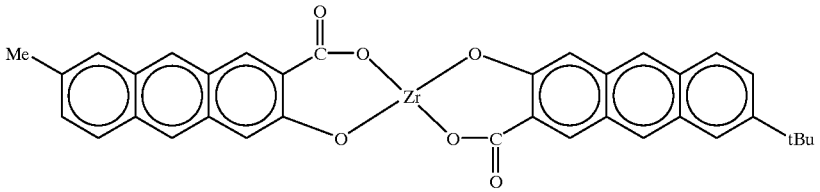
(45)
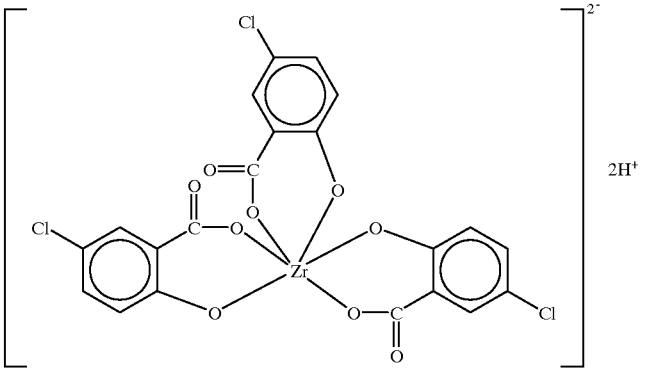
(46)
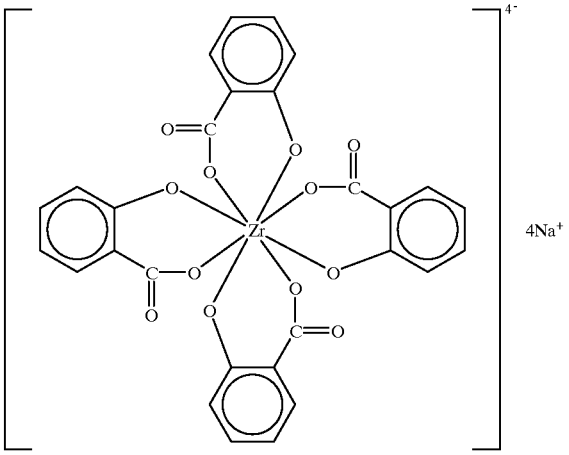

-continued
(47)
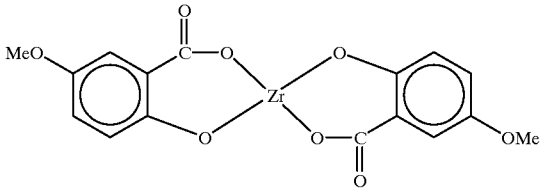
(48)
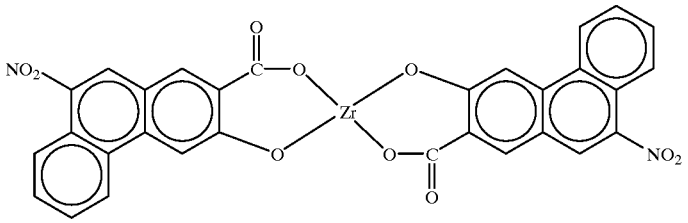
(49)
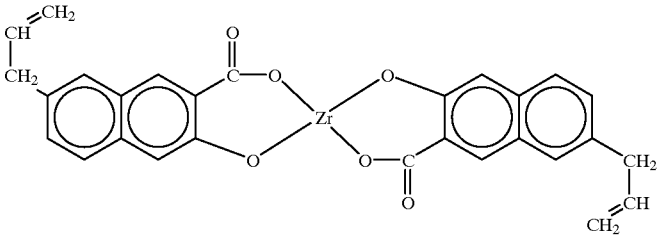
(50)
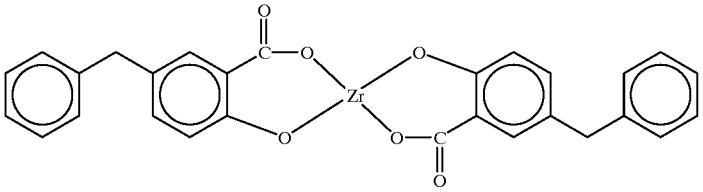
(51)
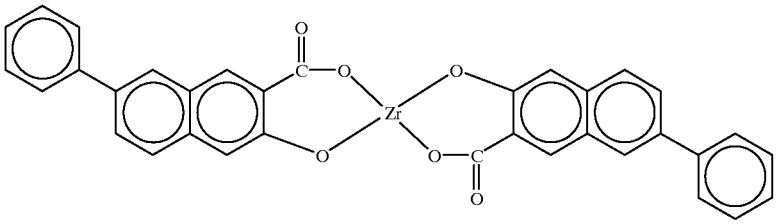
(52)
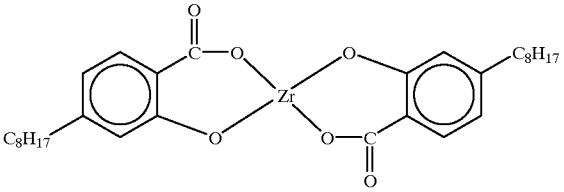
(53)
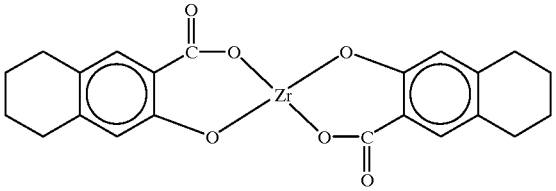

-continued
(54)
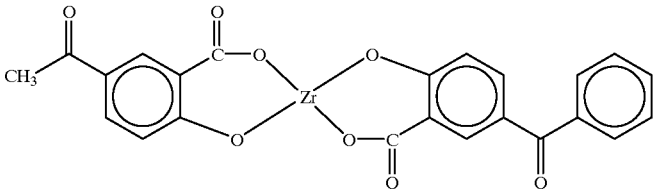
(55)
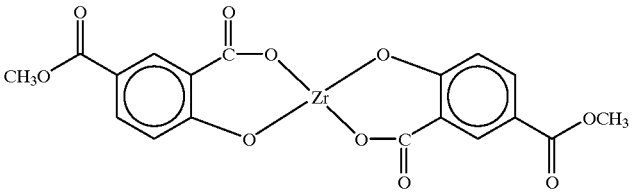
(56)
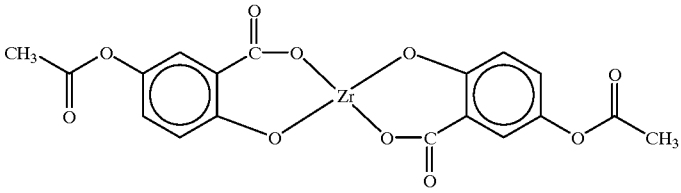
(57)
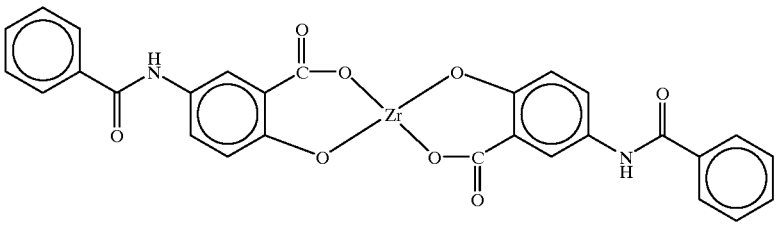
(58)
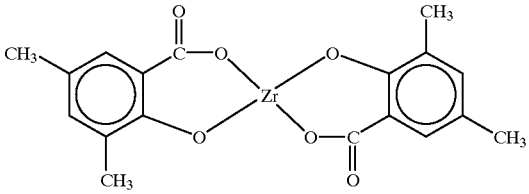
(59)
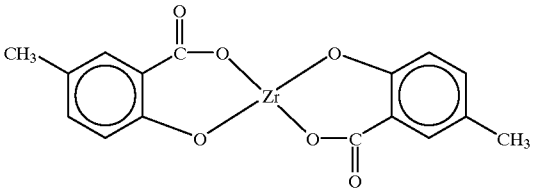
(60)
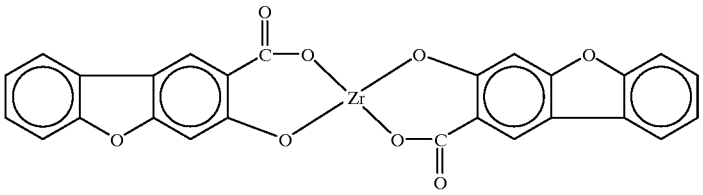
(61)
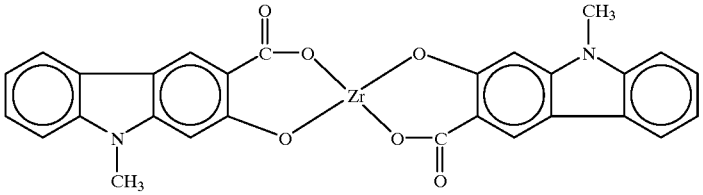

-continued
(62)
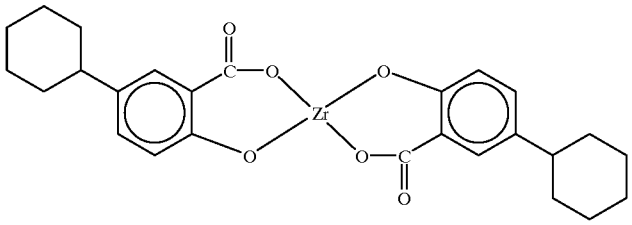
(63)
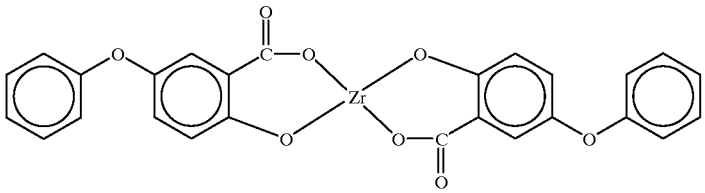
(64)
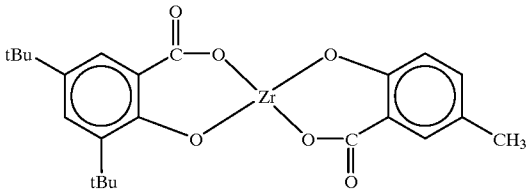
(65)
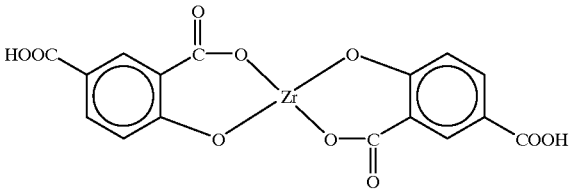
(66)
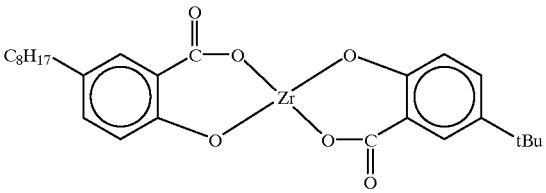
(67)
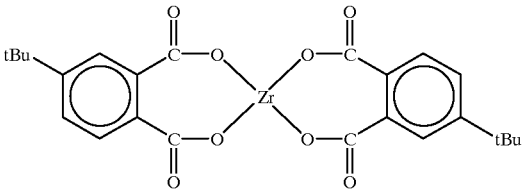
(68)
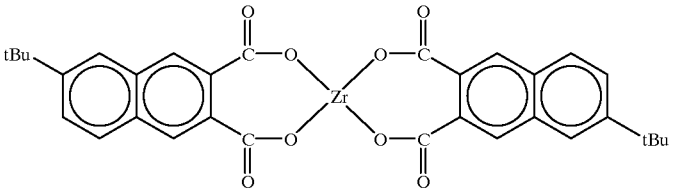
(69)
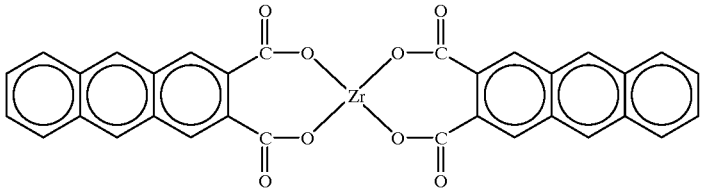

-continued
(70)
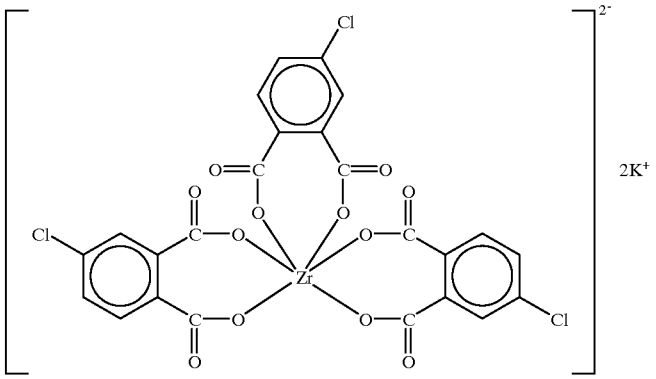
(71)
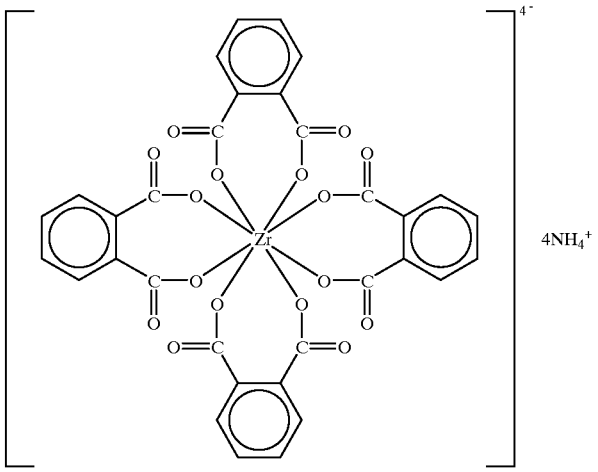
(72)
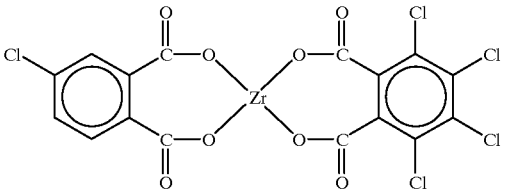
(73)
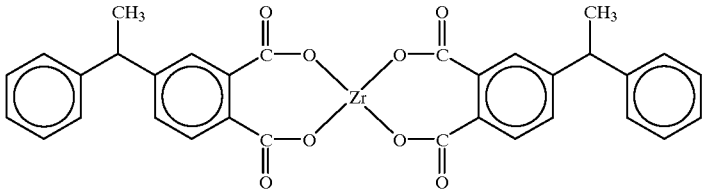
(74)
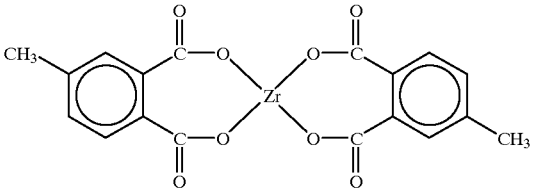

-continued
(75)
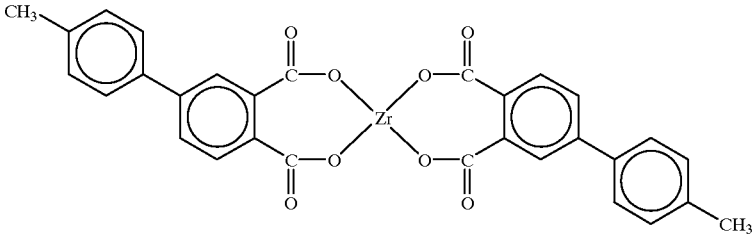
(76)
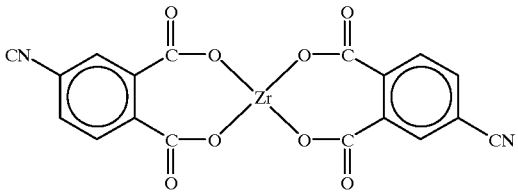
(77)
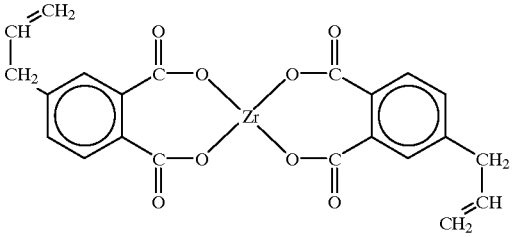
(78)
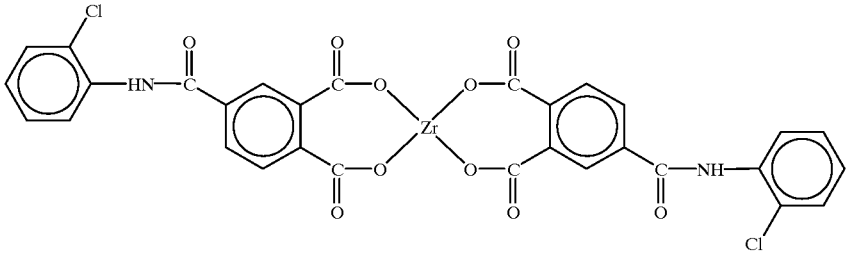
(79)
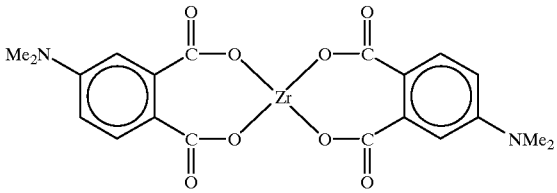
(80)
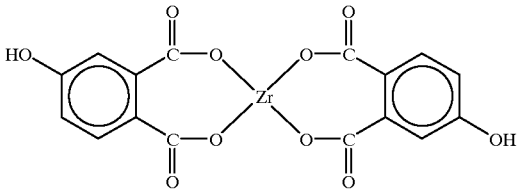
(81)
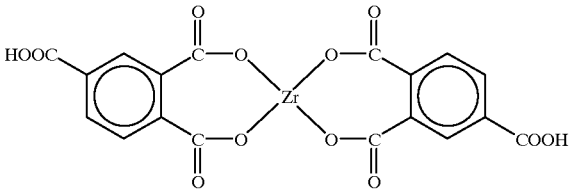
(82)
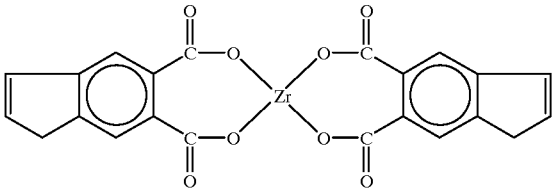

-continued
(83)
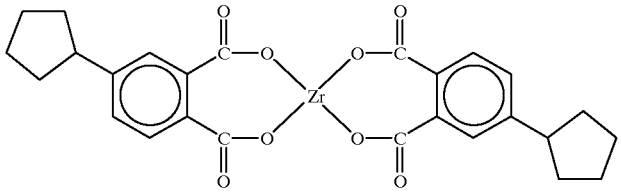
(84)
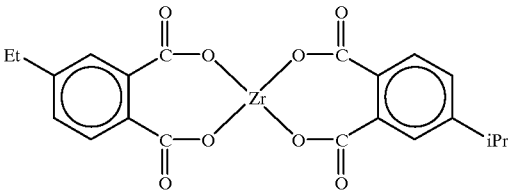
(85)
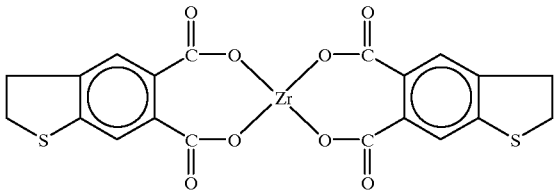
(86)
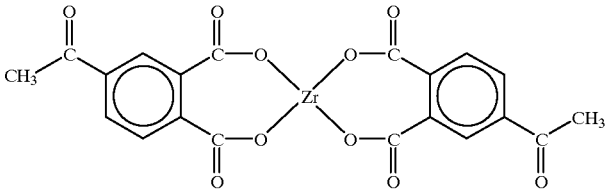
(87)
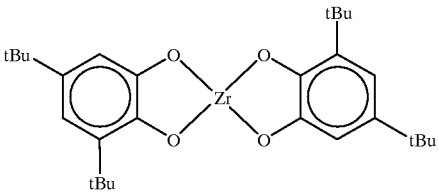
(88)
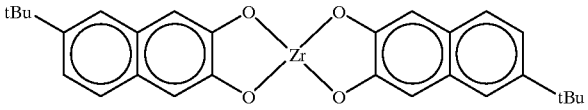
(89)
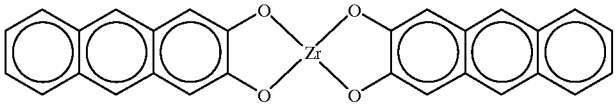
(90)
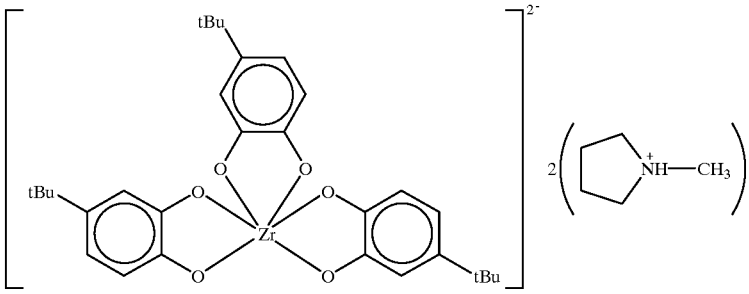

-continued
(91)
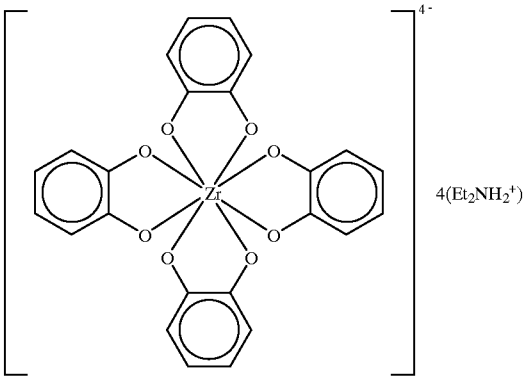
(92)
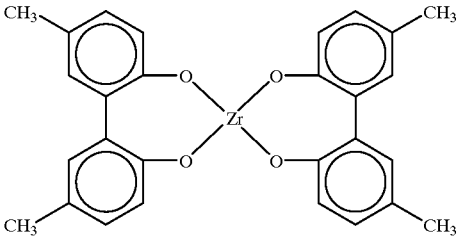
(93)
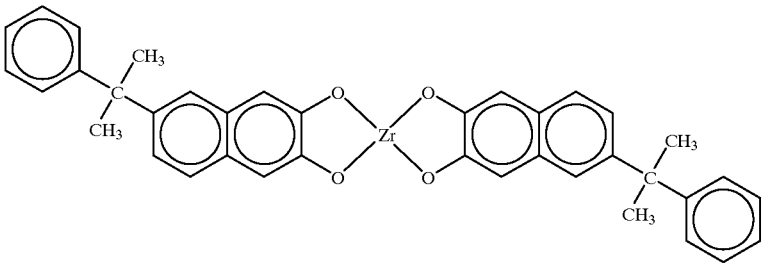
(94)
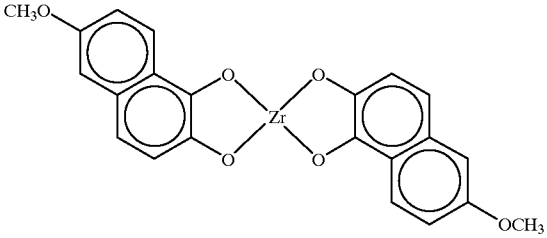
(95)
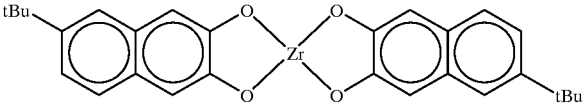
(96)
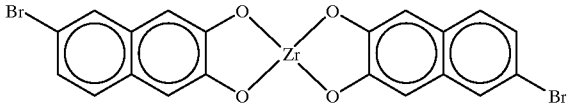
(97)
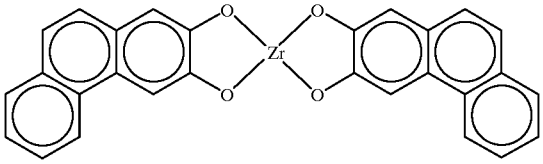
(98)
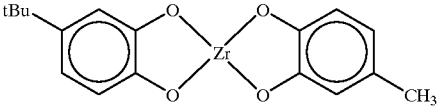
(99)
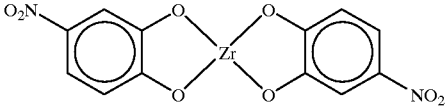

-continued
(100)
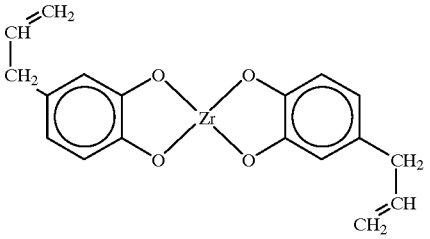
(101)
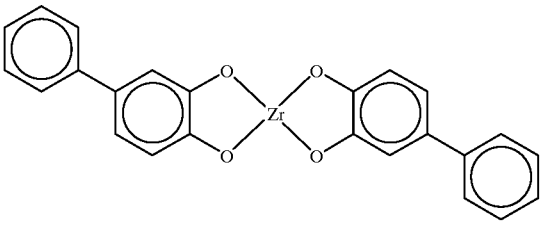
(102)
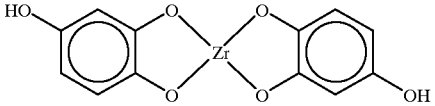
(103)
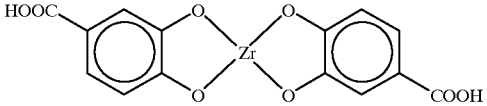
(104)
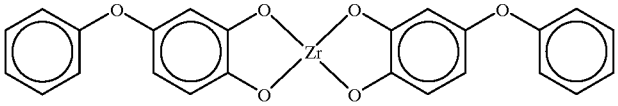
(105)
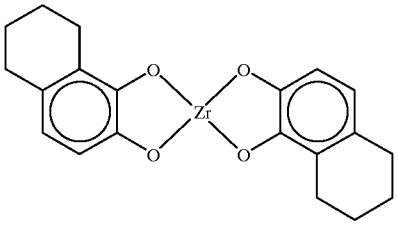
(106)
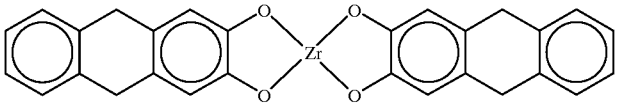
(107)
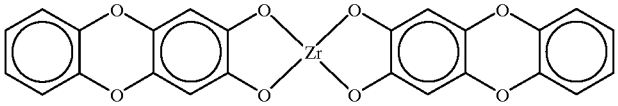
(108)
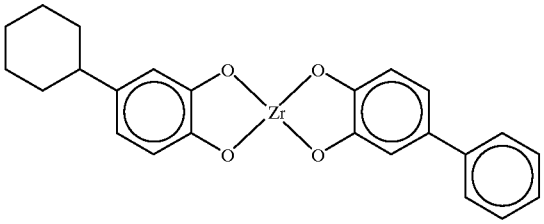
(109)
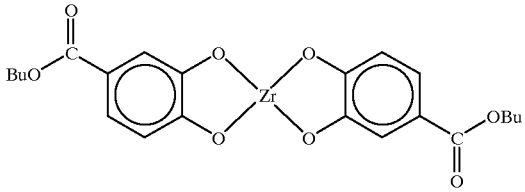
(110)
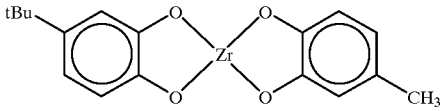

-continued
(111)
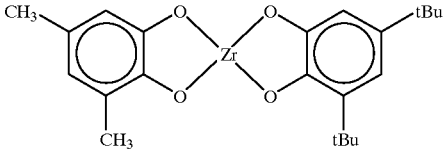
(112)
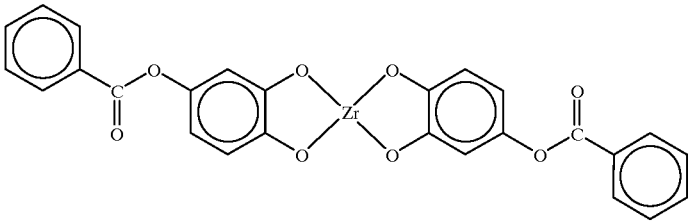
(113)
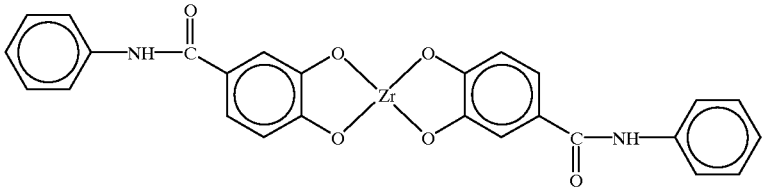
(114)
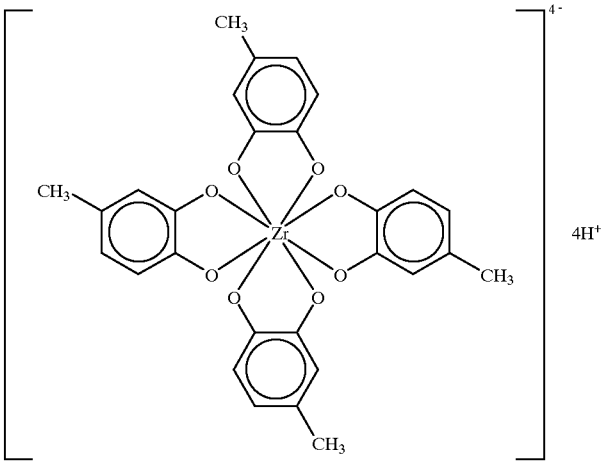
(115)
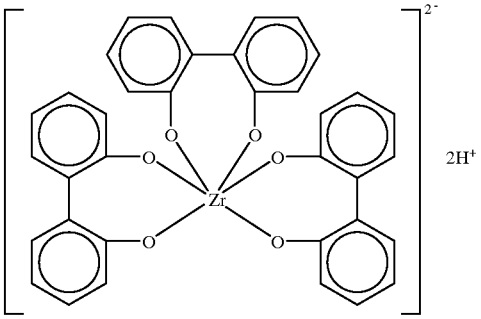
(116)
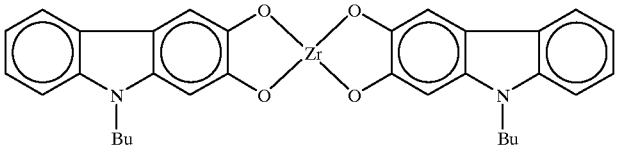

-continued
(117)
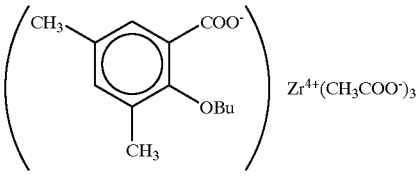
(118)
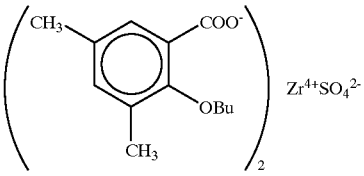
(119)
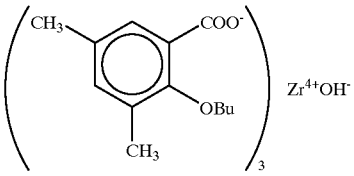
(120)
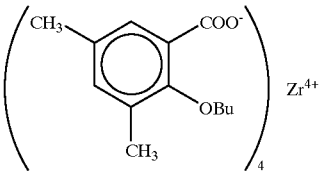
(121)
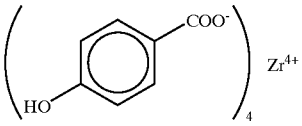
(122)
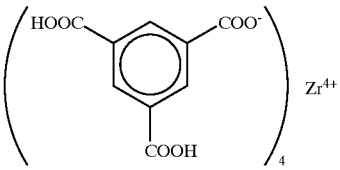
(123)
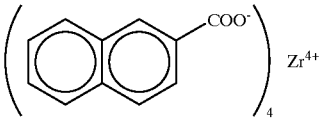
(124)
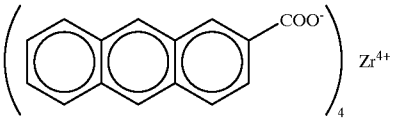
(125)
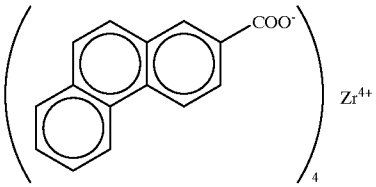
(126)
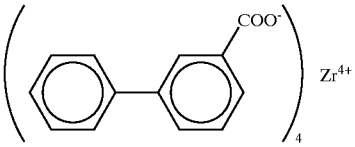
(127)
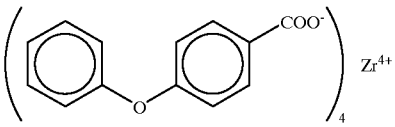
(128)
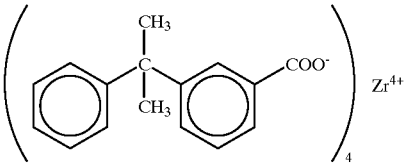
(129)
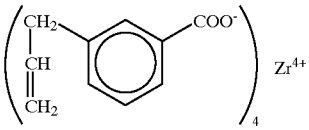
(130)
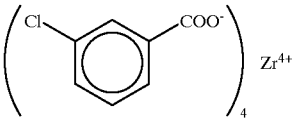
(131)
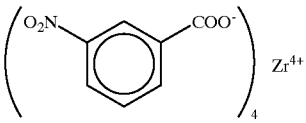
(132)
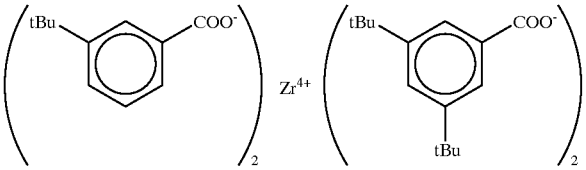

-continued
(133)
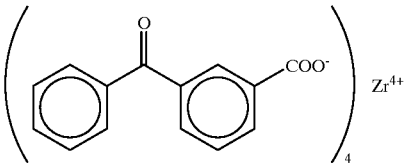
(134)
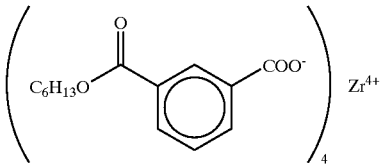
(135)
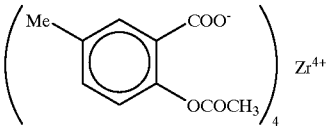
(136)
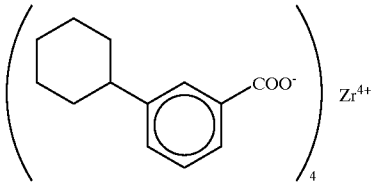
(137)
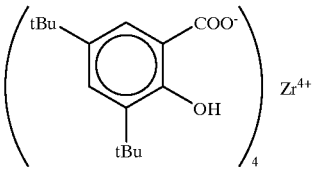
(138)
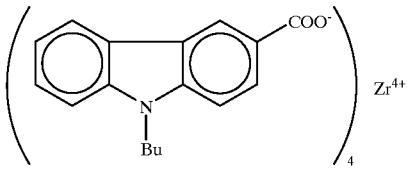
(139)
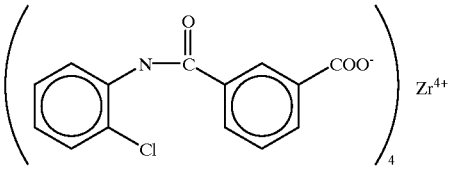
(140)
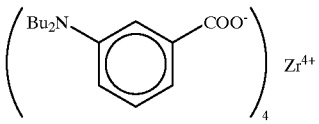
(141)
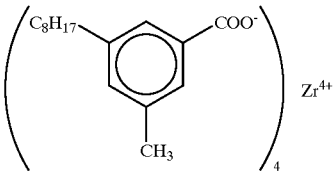
(142)
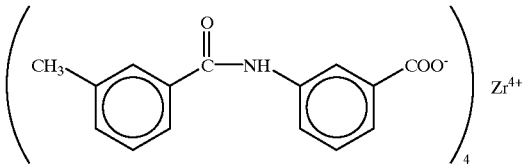
(143)
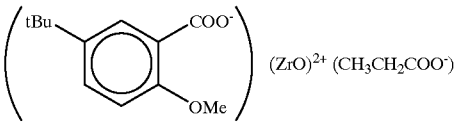
(144)
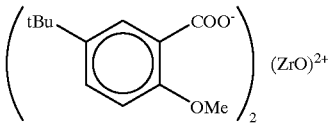
(145)
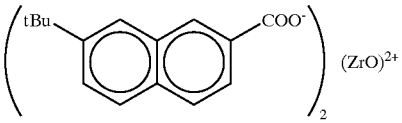
(146)
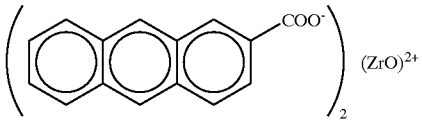
(147)
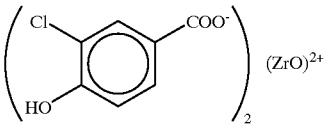
(148)
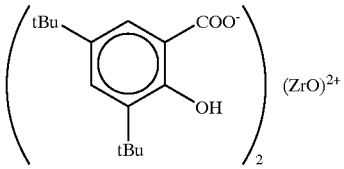

-continued
(149)
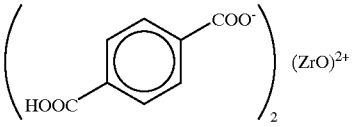
(150)
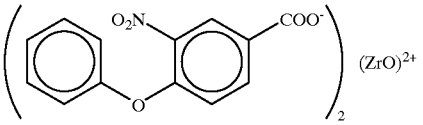
(151)
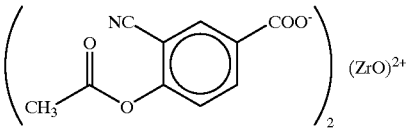
(152)
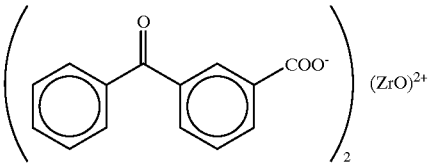
(153)
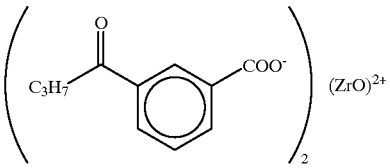
(154)
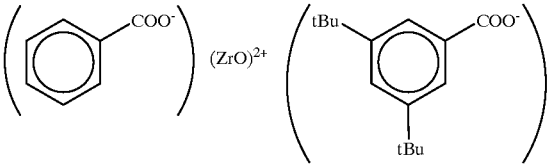
(155)
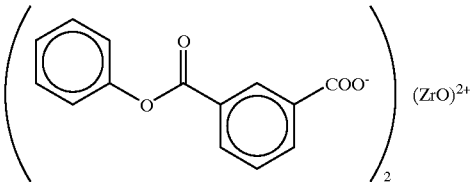
(156)
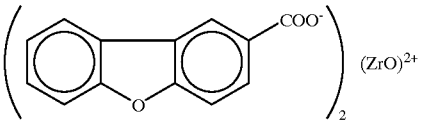
(157)
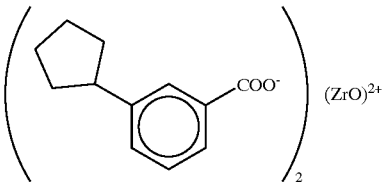
(158)
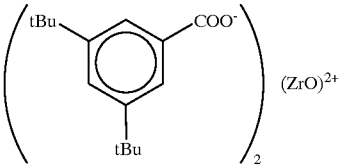
(159)
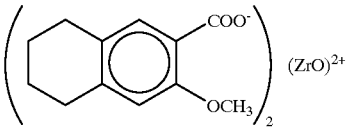
(160)
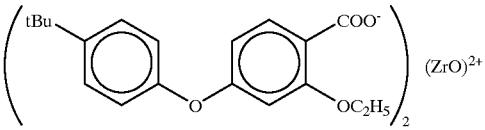
(161)
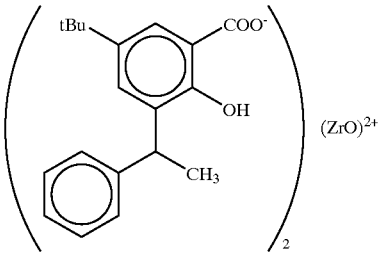
(162)
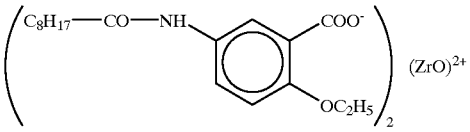

-continued
(163)
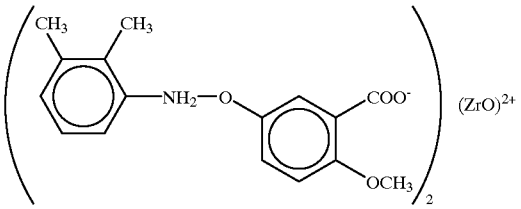
(164)
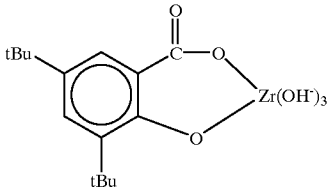
(165)
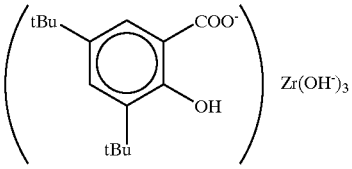
(166)
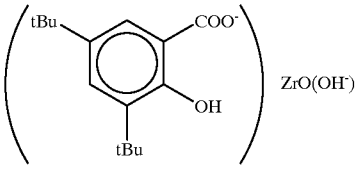
(167)
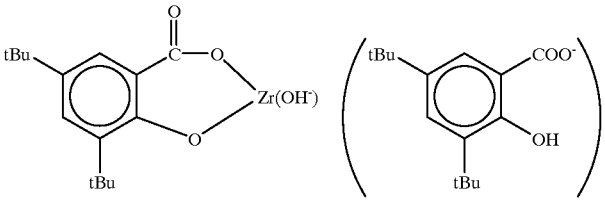
(168)
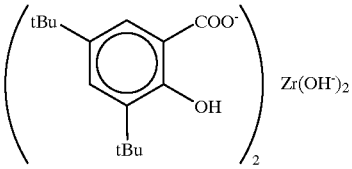
(169)
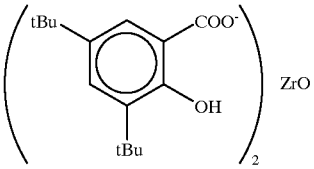
(170)
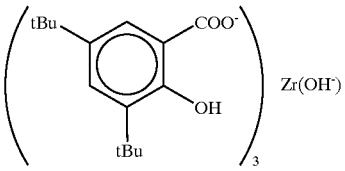
(171)
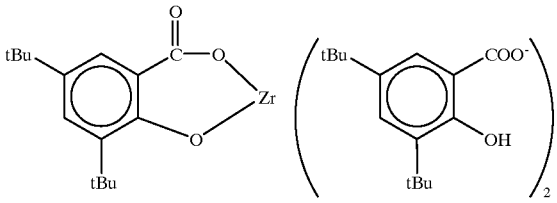
(172)
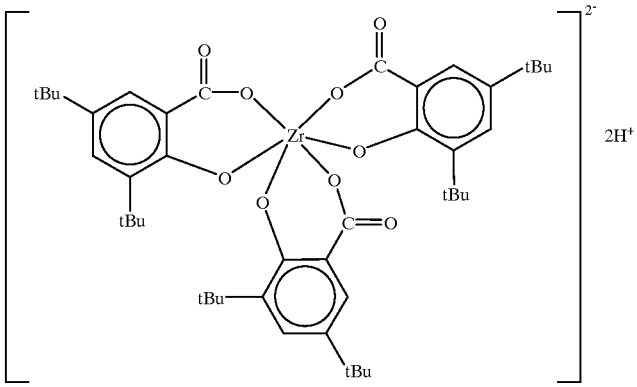

-continued (173)

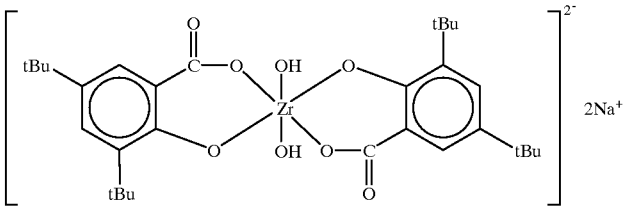

(174)

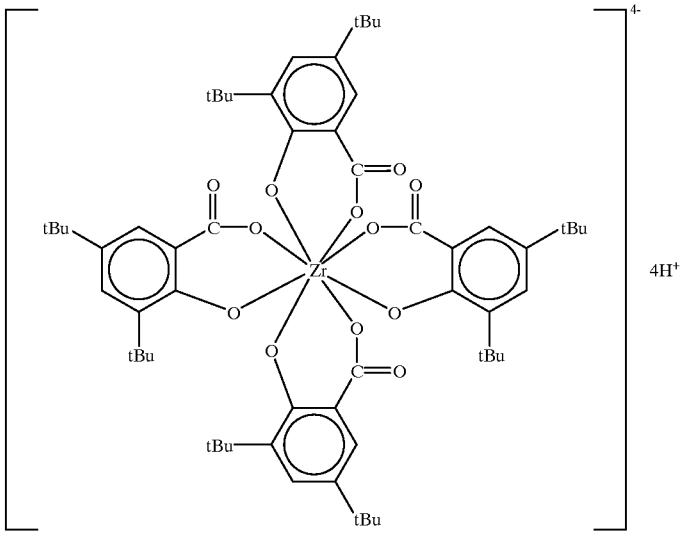

(175)

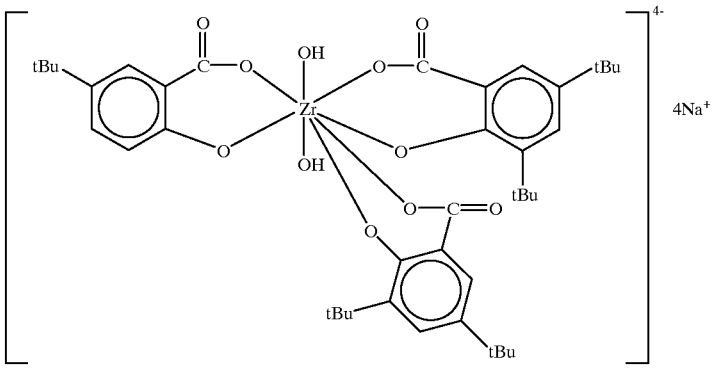

The organic zirconium compound used in the present invention may be incorporated in the toner by adding the organic zirconium compound internally into toner particles (i.e., as a component of toner particles) or externally to toner particles (i.e., as a powder blend with the toner particles). Addition amount of the organic zirconium compound in the case of internal addition may preferably be 0.5–10 wt. parts, more preferably 1.0–8.0 wt. parts, further preferably 1.5–5.0 wt. parts, per 100 wt. parts of the binder resin. In the case of external addition, the organic zirconium compound may preferably be added in 0.01–5 wt. parts per 100 wt. parts of the binder resin and it is particularly preferred that the organic zirconium compound is mechanochemically attached to the surface of toner particles. In the present invention, the organic zirconium compound may preferably be internally incorporated in the toner particles in view of a sufficient interaction thereof with the vinyl polymer having the carboxyl group over the entire toner particles.

The organic zirconium compound can also be used in combination with a conventional charge control agent as described in the part of the related art herein, such as another organic metal complex, metal salt or chelate compound. Specific examples of such a known charge control agent may include: mono-azo metal complexes, acetylacetone metal complexes, hydroxycarboxy acid metal complexes, polycarboxylic acid metal complexes, and polyol metal complexes. Other examples may include: carboxylic acid derivatives, such as carboxylic acid metal salts, carboxylic acid anhydrides and carboxylic acid esters; condensation products of aromatic compounds; and phenol derivatives, such as bisphenols and calixarene.

It has been found that the toner according to the present invention exhibits an excellent chargeability-imparting performance in a triboelectric charging step with a developer-carrying member. Specifically, the toner containing the binder resin having an acid value and the organic zirconium compound has been found to provide a larger chargeability even in less contact state with the developer-carrying member surface.

For adjusting the acid value of the binder resin, it is appropriate to use a carboxyl group-containing monomer, examples of which may include: acrylic acid and α- or β-alkyl derivatives thereof, such as acrylic acid, methacrylic acid, α-ethylacrylic acid, crotonic acid, cinnamic acid, vinylacetic acid, isocrotonic acid and angelic acid; and unsaturated dicarboxylic acids, such as fumaric acid, maleic acid, citraconic acid, alkenylsuccinic acid, itaconic acid, mesaconic acid, dimethylmaleic acid, and dimethylfumaric acid, and mono-ester derivatives and anhydrides thereof. Desired polymers may be synthesized by polymerizing these monomers alone or in mixture for copolymerization with other monomers. Among these, it is particularly preferred to use monoester derivatives of unsaturated dicarboxylic acids for controlling the acid value.

Preferred examples thereof may include: monoesters of α,β-unsaturated dicarboxylic acids, such as monomethyl maleate, monoethyl maleate, monobutyl maleate, monooctyl maleate, monoallyl maleate, monophenyl maleate, monomethyl fumarate, monoethyl fumarate, monobutyl fumarate and monophenyl fumarate; and monoesters of alkenyldicarboxylic acids, such as monobutyl n-butenylsuccinate, monomethyl n-octenylsuccinate, monoethyl n-butenylmalonate, monomethyl n-dodecenylglutarate, and monobutyl n-butenyladipate.

The above-mentioned carboxyl group-containing monomer may preferably constitute 0.1–20 wt. parts, particularly 0.2–15 wt. parts, per 100 wt. parts of the total monomers providing the binder resin.

A reason why a monomer in the form of a dicarboxylic acid monoester is preferred is that an ester having a lower solubility in aqueous suspension medium and having a high solubility in an organic solvent or other monomers, is preferred.

In the present invention, the carboxylic acid group and carboxylic acid ester site can be subjected to saponification by an alkaline treatment. It is also preferred to convert the carboxylic acid group and the carboxylic acid ester site into a polar functional group by reaction with an alkaline cationic component.

The alkaline treatment may be performed by adding an alkali into the solvent medium used in polymerization after the preparation of the binder resin. Examples of the alkali may include: hydroxides of alkaline metals or alkaline earth metals, such as Na, K, Ca, Li, Mg and Ba; hydroxides of transition metals, such as Zn, Ag, Pb and Ni; and ammonium hydroxide, alkylammonium hydroxides, such as pyridinium hydroxide. Particularly preferred examples may include NaOH and KOH.

In the present invention, the above-mentioned saponification need not be effected with respect to all the carboxylic acid group and carboxylic ester site of the copolymer, but a part of the carboxylic groups can be saponified into a polar functional group.

The alkali for the saponification may be used in an amount of 0.02–5 equivalents to the acid value of the binder resin. Below 0.02 equivalent, the saponification is liable to be insufficient to provide insufficient polar functional groups, thus being liable to cause insufficient crosslinking thereafter. On the other hand, in excess of 5 equivalents, the functional group, such as the carboxylic ester site, can receive adverse effects, such as hydrolysis of the ester site and salt formation through the saponification.

If the alkalline treatment in an amount of 0.02–5 equivalents to the acid value is effected, the remaining cation concentration may be within the range of 5–1000 ppm, thus advantageously controlling the amount of the alkali.

The binder resin and the toner composition containing the binder resin may preferably have a glass transition temperature (Tg) of 45–75° C., more preferably 50–70° C., in view of the storage stability of the toner. If Tg is below 45° C., the toner is liable to be deteriorated in a high-temperature environment and liable to cause offset at the time of fixation. If Tg is above 75° C., the fixability is liable to be lowered.

The binder resin used in the present invention may be produced by solution polymerization, emulsion polymerization or suspension polymerization.

In the emulsion polymerization process, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitute a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer at a high purity. The suspension polymerization is more convenient in this respect.

The suspension polymerization may preferably be performed by using at most 100 wt. parts, preferably 10–90 wt. parts, of a monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium. The polymerization temperature may suitably be in the range of 50–95° C. and selected depending on the polymerization initiator used and the objective polymer.

The binder resin used in the present invention may suitably be produced in the presence of a polyfunctional polymerization initiator or a combination thereof with a monofunctional polymerization initiator, as enumerated hereinbelow.

Specific examples of the polyfunctional polymerization initiator may include: polyfunctional polymerization initiators having at least two functional groups having a polymerization-initiating function, such as peroxide groups, per molecule, inclusive of 1,1-di-t-butylperoxy-3,3,5-trimethylcyclohexane, 1,3-bis-(t-butylperoxyisopropyl) benzene, 2,5-dimethyl-2,5-(t-butylperoxy)hexane, 2,5-dimethyl-2,5-di-(t-butylperoxy)hexine, tris(t-butylperoxy)-triazine, 1,1-di-t-butylperoxycyclohexane, 2,2-di-t-butylperoxybutane, 4,4-di-t-butylperoxyvaleric acid n-butyl ester, di-t-butylperoxyhexahydroterephthalate, di-t-butylperoxyazelate, di-t-butylperoxytrimethyladipate, 2,2-bis-(4,4-di-t-butylperoxycyclohexyl)propane, and 2,2-t-butylperoxyoctane; and polyfunctional polymerization initiators having both a polymerization-initiating functional group, such as peroxide group, and a polymerizable unsaturation group in one molecule, such as diallylperoxydicarbonate, t-butylperoxymaleic acid, t-butylperoxyallylcarbonate, and t-butylperoxyisopropylfumarate.

Among these, particularly preferred examples may include: 1,1-di-t-butylperoxy-3,3,5-trimethylcyclohexane, 1,1-di-t-butylperoxycyclohexane, di-t-butylperoxyhexahydroterephthalate, di-t-butylperoxyazelate, 2,2-bis(4,4-di-t-butylperoxycyclohexyl) propane, and t-butylperoxyallylcarbonate.

These polyfunctional polymerization initiators may be used in combination with a monofunctional polymerization initiator, preferably one having a 10 hour-halflife temperature (a temperature providing a halflife of 10 hours by decomposition thereof) which is lower than that of the polyfunctional polymerization initiator, so as to provide a toner binder resin satisfying various requirements in combination.

Examples of the monofunctional polymerization initiator may include: organic peroxides, such as benzoyl peroxide, 1,1-di(t-butylperoxy)-3,3,5-trimethylcyclohexane, n-butyl-4,4-di(t-butylperoxy)valerate, dicumyl peroxide, α,α'-bis(t-butylperoxydiisopropyl)benzene, t-butylperoxycumene and di-t-butyl peroxide; and azo and diazo compounds, such as azobisisobutyronitrile, and diazoaminoazobenzene.

The monofunctional polymerization initiator can be added to the monomer simultaneously with the above-mentioned polyfunctional polymerization initiator but may preferably be added after lapse of a polymerization time which exceeds the halflife of the polyfunctional polymerization initiator, in order to appropriately retain the initiator efficiency of the polyfunctional polymerization initiator.

In the case where the vinyl polymer constituting the binder resin of the toner of the present invention is prepared through, e.g., solution polymerization or bulk polymerization, an ordinary radical polymerization scheme may be adopted. In this instance, a radical polymerization initiator having at least two peroxide groups per molecule and different 1 hour-halflife temperatures including a first 10 hour-halflife temperature and a second 10 hour-halflife temperature which provide a difference therebetween of at least 5° C., preferably at least 7° C., further preferably at least 10° C., may be employed, and a monomer composition (mixture) preferably comprising aromatic vinyl monomer and (meth)acrylate monomer may be added at respective polymerization temperatures providing a difference in radical polymerization reaction temperature of at least 5° C., preferably at least 7° C., further preferably at least 10° C., thus preparing a vinyl polymer used in the present invention. The binder resin used in the present invention may preferably comprise at least 10 wt. % of the thus-prepared vinyl polymer.

The above-mentioned polymerization initiators may preferably be used in an amount of 0.05–2 wt. parts per 100 wt. parts of the monomer in view of the initiator efficiency.

It is also preferred that the vinyl polymer as the binder resin used in the present invention may be crosslinked by using a crosslinking monomer as enumerated hereinbelow.

The crosslinking monomer may principally be a monomer having two or more polymerizable double bonds. Specific examples thereof may include: aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K. K.). Polyfunctional crosslinking agents, such as pentaerythritol triacrylate, trimethylolethane triacrylate, trimethylolpropane triacrylate, tetramethylolpropane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of 0.0001–1 wt. part, particularly 0.001–0.5 wt. parts, per 100 wt. parts of the other vinyl monomer components.

Among the above-mentioned crosslinking monomers, aromatic divinyl compounds (e.g., divinylbenzene) and diacrylate compounds connected with a chain including an aromatic group and an ether bond may suitably be used in a toner binder resin in view of fixing characteristic and anti-offset characteristic.

As described above, known bulk polymerization and solution polymerization may be used in the present invention. According to the bulk polymerization, however, a variety of polymers including a low-molecular weight polymer can be produced by adopting a high polymerization temperature providing an accelerated reaction speed, the reaction control is liable to be difficult. In contrast thereto, according to the solution polymerization process, such a low-molecular weight polymer can be produced under moderate conditions by utilizing the radical chain transfer function of the solvent and by adjusting the polymerization initiator amount or reaction temperature, so that the solution polymerization process is preferred for formation of a low-molecular weight component to be contained in the binder resin. It is also effective to perform the solution polymerization under an elevated pressure, so as to suppress the amount of the polymerization initiator to the minimum and suppress the adverse effect of the residual polymerization initiator.

Examples of the monomer constituting the vinyl polymer constituting the binder resin used in the toner according to the present invention may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene and isoprene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacrylonitrile, and acrylamide; the esters of the above-mentioned $\alpha,\beta$-unsaturated acids and the diesters of the above-mentioned dibasic acids. These vinyl monomers may be used singly or in combination of two or more species.

Among these, a combination of monomers providing styrene-based copolymers and styrene-acrylate-based copolymers may be particularly preferred.

It is preferred that the binder resin contains at least 65 wt. % of styrene polymer or styrene copolymer so as to exhibit good mixability with the organic zirconium compound.

The binder resin used in the present invention may be in the form of a mixture of a high-molecular weight polymer component and a low-molecular weight polymer component obtained through various processes, inclusive of: a solution blend process wherein a high-molecular weight polymer and a low-molecular weight polymer produced separately are blended in solution, followed by removal of the solvent; a dry blend process wherein the high- and low-molecular weight polymers are melt-kneaded by means of, e.g., an extruder; and a two-step polymerization process wherein a low-molecular weight polymer prepared, e.g., by solution polymerization is dissolved in a monomer constituting a high-molecular weight polymer, and the resultant solution is subjected to suspension polymerization, followed by washing with water and drying to obtain a binder resin. However, the dry blend process leaves a problem regarding the uniform dispersion and mutual solubilities, and the two-step polymerization process makes it difficult to increase the low-molecular weight component in excess of the high-molecular weight component while it is advantageous in providing a uniform dispersion. Further, the two-step polymerization process providing a difficulty that, in the presence of a low-molecular weight polymer component, it is difficult to form an adequately high-molecular weight component and an unnecessary low-molecular weight component is by-produced. Accordingly, the solution blend process is most suitable in the present invention. Further, it is preferred to use a low-molecular weight polymer component having a prescribed acid value through solution polymerization because of easier setting of the acid value than in the aqueous system polymerization.

When the toner according to the present invention is formed as a magnetic toner, the toner contains a powdery magnetic material as a colorant.

The magnetic material used in the present invention may comprise a magnetic iron oxide, such as magnetite, maghemite, ferrite or a mixture of these containing a different (i.e., non-iron) element.

It is particularly preferred to use a magnetic iron oxide containing at least one element selected from lithium, beryllium, boron, magnesium, aluminum, silicon, phosphorus, sulfur, germanium, titanium, zirconium, tin, lead, zinc, calcium, barium, scandium, vanadium, chromium, manganese, cobalt, copper, nickel, gallium, indium, silver, palladium, gold, platinum, tungsten, molybdenum, niobium, osmium, strontium, yttrium, technetium, ruthenium, rhodium, and bismuth. It is particularly preferred to contain at least one of lithium, beryllium, boron, magnesium, aluminum, silicon, phosphorus, germanium, zirconium, tin, sulfur, calcium, scandium, titanium, vanadium, chromium, manganese, cobalt, nickel, copper, zinc and gallium. It is most preferred to use a magnetic iron oxide containing a different element selected from the group consisting of magnesium, aluminum, silicon, phosphorus and zirconium.

Such a different element may be introduced into the crystal lattice of the iron oxide, incorporated as an oxide thereof in the iron oxide, or present as an oxide or a hydroxide thereon on the surface of the iron oxide particles. In a preferred embodiment, such a different element is contained as an oxide in the iron oxide.

Such a different element may be incorporated into magnetic iron oxide particles at the time of separation of the magnetic iron oxide in the co-presence of the different element under a controlled pH or alternately may be precipitated on the surface of the magnetic iron oxide particles by controlling the pH or adding a salt of the different element and controlling the pH, respectively after forming the magnetic iron oxide particles.

The magnetic material containing such a different element exhibits a good affinity with and very good dispersibility in the binder resin. Further, the good dispersibility of the magnetic material also improves the dispersibility of the organic zirconium compound used in the present invention, thus allowing full exhibition of the effect of the organic zirconium compound. Thus, the magnetic material functions as a dispersion promoting medium to promote the dispersion of the organic zirconium compound. Further, the magnetic material adsorbs water to promote the chargeability-imparting effect of the organic zirconium compound exhibited in cooperation with water molecules. The effect is further promoted when used in combination with a binder resin having an acid value.

The magnetic material particles may have a uniform particle size distribution, thus providing the resultant toner with a stable chargeability, in cooperation with a good dispersibility of the organic zirconium compound based on the good dispersibility thereof in the binder resin. Further, while the toner particle size has been reduced for providing higher image qualities in recent years, the toner thus obtained according to the present invention may be provided with an enhanced uniformity of chargeability and reduced toner agglomeratability, thus providing an increased image density and improved fog prevention effect, even at a weight-average particle size of 2.5–10 $\mu$m of the toner particles. The effect is particularly remarkable for a toner having a weight-average particle size of 2.5–6 $\mu$m, and a very high-definition image can be produced. A weight-average particle size of at least 2.5 $\mu$m is preferred in order to obtain a sufficient image density. On the other hand, as the toner particle size is reduced, the liberation of the zirconium compound is more liable to occur. However, as the toner according to the present invention is excellent in changing uniformity, the toner is less liable to be affected by sleeve soiling with some isolated zirconium compound.

The toner according to the present invention including the magnetic toner and non-magnetic toner may preferably have a weight-average particle size of 2.5–10 $\mu$m, more preferably 2.5–6.0 $\mu$m.

The above-mentioned different element may preferably be contained in 0.05–10 wt. % based on the iron element in the magnetic iron oxide. The content is more preferably be 0.1–7 wt. %, particularly preferably 0.2–5 wt. %, most preferably 0.3–4 wt. %. Below 0.05 wt. %, the addition effect of the different element is scarce, thus failing to achieve good dispersibility and uniformity of chargeability. Above 10 wt. %, the charge liberation is liable to be excessive to cause insufficient chargeability, thus resulting in a lower image density and an increased fog.

It is preferred that the different element is distributed so that it is richer in the vicinity of the surface of the magnetic iron oxide particles. For example, it is preferred that 20–100% of the different element is present at the surface portion to be dissolved up to an iron dissolution percentage of 20%. The percentage is preferably 25–100%, more preferably 30–100%. By increasing the proportion of the presence at the surface portion, the dispersibility and electrical diffusion effect of the different element can be improved.

The magnetic material, preferably magnetic iron oxide particles containing a different element as described above, may preferably have a number-average particle size of 0.05–1.0 $\mu$m, further preferably 0.1–0.5 $\mu$m. The magnetic material may preferably have a BET specific surface area of 2–40 $m^2/g$, more preferably 4–20 $m^2/g$. The magnetic material particles may have an arbitrary shape without particular restriction. As for magnetic properties, the magnetic material may desirably have a saturation magnetization ($\sigma s$) of 10–200 $Am^2/kg$, preferably 70–100 $Am^2/kg$, a residual magnetization ($\sigma r$) of 1–100 $Am^2/kg$, preferably 2–20 $Am^2/kg$, and a coercive force (Hc) of 1–30 kA/m, preferably 2–15 kA/m as measured under a magnetic field of 795.8 kA/m. The magnetic material may be added in 20–200 wt. parts per 100 wt. parts of the binder resin.

The toner according to the present invention can contain a colorant comprising any suitable pigment or dye in addition to the above-described magnetic material. For example, suitable examples of the pigment may include: carbon black, aniline black, acetylene black, Naphthol Yellow, Hansa Yellow, Rhodamine Lake, Alizarin Lake, red iron oxide, Phthalocyanine Blue, and Indanthrene Blue. Such a pigment may be used in an amount necessary to provide a required optical density of fixed image, e.g., 0.1–20 wt. parts, preferably 0.2–10 wt. parts, per 100 wt. parts of the binder resin. For similar purpose, a dye may be used. There are, for example, azo dyes, anthraquinone dyes, xanthene dyes and methin dyes, which may be added in 0.1–20 wt. parts, preferably 0.3–10 wt. parts, per 100 wt. parts of the binder resin.

In the present invention, it is preferred to externally add inorganic fine powder, e.g., fine powder of inorganic oxides, such as silica, alumina and titanium oxide; carbon black or fine powdery fluorinated carbon.

For example, silica powder, alumina powder or titanium oxide powder may preferably be in such a fine particulate form as to be attached as fine particles onto the surface of the toner particles, thus improving a flowability-imparting performance. More specifically, such an inorganic fine powder may preferably have a number-average particle size of 5–100 nm, more preferably 5–50 nm, and a specific surface area of at least 30 $m^2/g$, particularly 60–400 $m^2/g$, as base powder, and a specific surface area of at least 20 $m^2/g$, particularly 40–300 $m^2/g$, as surface-treated powder, respectively as measured by the BET method according to nitrogen adsorption.

Such inorganic fine powder may be added externally in 0.03–5 wt. parts per 100 wt. parts of toner particles so as to provide an adequate surface coverage rate.

The inorganic fine powder may preferably have a hydrophobicity of at least 30%, more preferably at least 50%, in terms of methanol wettability. The hydrophobicity-imparting agent (or hydrophobizing agent) may preferably comprise a silicon-containing surface-treating agent, such as a silane compound and/or a silicone oil.

For example, it is appropriate to use a silane coupling agent, examples of which may include: alkylalkoxysilanes, such as dimethyldimethoxysilane, trimethylethoxysilane and butyltrimethoxysilane; dimethyldichlorosilane, trimethylchlorosilane, allyldimethylchlorosilane, hexamethyldisilazane, allylphenyldichlorosilane, benzyldimethylchlorosilane, vinyltriethoxysilane, γ-methacryloxypropyltrimethoxysilane, vinyltriacetoxysilane, divinylchlorosilane, and dimethylvinylchlorosilane.

To the toner according to the present invention, it is also possible to add various additives in order to impart various properties. Examples of such additives are as follows:

(1) Abrasive: metal oxides (strontium titanate, cerium oxide, aluminum oxide, magnesium oxide, chromium oxide, etc.), nitrides (silicon nitride, etc.), carbide (silicon carbide, etc.), metal salts (calcium sulfate, barium sulfate, calcium carbonate, etc.), etc.

(2) Lubricants: powder of fluorine-containing resin (polyvinylidene fluoride, polytetrafluoroethylene, etc.), aliphatic acid metal salts (zinc stearate, calcium stearate, etc.), etc.

(3) Charge control particles: particles of metal oxides (tin oxide, titanium oxide, zinc oxide, silicon oxide, aluminum oxide), carbon black, resin particles, etc.

These additives may preferably be added externally in 0.05–10 wt. parts, more preferably 0.1–5 wt. parts per 100 wt. parts of the toner particles. These additives may be added singly or in combination of two or more species.

In the case of a magnetic toner, it is preferred to use fine powder of two or more species of inorganic oxides or metal oxides in order to provide good developing performance in continuous image formation and stable developing performance after standing. In the case of a non-magnetic monocomponent developer, it is preferred to use titanium oxide or alumina in order to provide improved flowability and image uniformity.

Toner particles constituting the toner according to the present invention may preferably be formed through a process wherein the above-mentioned toner component materials (including the (polyester or hybrid) binder resin, colorant, organic zirconium oxide, etc.) are sufficiently blended by a blender, such as a ball mill, well kneaded by a hot kneading machine, such as a hot roller kneader or an extruder, and the kneaded product, after cooling for solidification, is mechanically pulverized and classified, to provide toner particles. It is also possible to adopt a polymerization toner production process wherein prescribed materials are mixed with a monomer (mixture) constituting the binder resin to form an emulsion or suspension liquid, followed by polymerization; a microencapsulation for providing so-called microcapsule toner particles wherein prescribed materials are incorporated into either one or both of the core material and the shell material; and a spray drying process wherein constituent materials are dispersed in a binder resin solution, and the resultant dispersion is spray-dried into toner particles. Further, the resultant toner particles may be further blended sufficiently with additive particles, as desired by a blender, such as a Henschel mixer, to provide a toner according to the present invention.

The toner according to the present invention can also be blended with a carrier to provide a two-component developer. The carrier particles may preferably have a resistivity of $10^6$–$10^{10}$ ohm.cm by controlling the surface roughness and the amount of coating resin.

The carrier particles may be coated with a resin, examples of which may include: styrene-acrylate copolymer, styrene-methacrylate copolymer, acrylate copolymers, methacrylate copolymers, silicone resin, fluorine-containing resin, polyamide resin, ionomer resin, polyphenylene sulfide resin, and mixtures of these.

The carrier core particles may comprise a magnetic material, examples of which may include: iron oxides, such as ferrite, iron-excessive ferrite, magnetite, and γ-iron oxide; metals such as iron cobalt or nickel, and alloys of these metals. Further, the magnetic material may contain an element, such as iron, cobalt, nickel, aluminum, copper, lead, magnesium, tin, zinc, antimony, beryllium, bismuth, calcium, manganese, selenium, titanium, tungsten, or vanadium.

Hereinbelow, some preferred embodiments of the image forming method according to the present invention using the toner of the present invention will be described with reference to drawings.

First, developing means (apparatus) applicable to the image forming method of the present invention will be explained.

Referring to FIG. 1, an electrophotographic photosensitive drum 7 (as an example of an image-bearing member for bearing an electrostatic latent image formed by a known process) is rotated in a direction of arrow B. On the other hand, a developing sleeve 14 (as a developer-carrying member) carrying a toner 10 (as a mono-component developer) supplied from a hopper 9 is rotated in a direction of arrow A to convey a layer of the toner 10 to a developing region D where the developing sleeve 14 and the photosensitive drum 7 oppose each other. In case where the toner 10 is a magnetic toner, a magnet 11 is disposed within the developing sleeve so as to magnetically attract and hold the magnetic toner 10 on the developing sleeve, whereby the toner is subjected to friction with the developing sleeve 14 to acquire a triboelectric charge sufficient for developing an electrostatic latent image on the photosensitive drum 7.

In order to regulate the layer thickness of the magnetic toner 10, a regulating magnetic blade 8 comprising a ferromagnetic metal is hung down from the hopper 9 to confront the developing sleeve 14 with a gap of ca. 200–300 μm from the surface of the developing sleeve 14. Lines of magnetic induction from a magnetic pole $N_1$ of the magnet 11 are concentrated to the blade 8, whereby a thin layer of the toner 10 is formed on the developing sleeve 14. The blade 8 can also comprise a non-magnetic blade. Further, in case where the toner 10 is a non-magnetic toner, the blade 8 may be an elastic blade comprising urethane rubber, silicone rubber, tip blade, etc.

The thin layer thickness of the toner 10 formed on the developing sleeve 14 may preferably be smaller than the minimum gap between the developing sleeve 14 and the photosensitive drum 7 at the developing region D. The image forming method according to the present invention is particularly effective in such a developing apparatus for the scheme wherein an electrostatic latent image is developed with such a thin layer of toner, i.e., a non-contact type developing apparatus. However, the image forming method according to the present invention is also applicable to a developing apparatus wherein the toner layer thickness is larger than the minimum gap between the developing sleeve 14 and the photosensitive drum 7 at the developing region, i.e., a contact-type developing apparatus.

Hereinbelow, further description of a non-contact type developing apparatus will be made.

Referring again to FIG. 1, the developing sleeve 14 is supplied with a developing bias voltage from a power supply 15 so as to cause a jumping of a toner 10 (as a mono-component developer) carried on the developing sleeve 14. In case where the developing bias voltage is a DC voltage, it is preferred that the developing sleeve 14 is supplied with a developing bias voltage which is equal to a voltage given as a difference between a potential of an image region (where the toner 10 is attached to provide a visual image region) and a potential of a background region of an electrostatic latent image. On the other hand, in order to increase the density or gradational characteristic of a developed image, it is also possible to apply an alternating bias voltage to the developing sleeve 14, thereby forming a vibrating field of which the voltage polarity alternates with time at the developing region D. In this case, it is preferred that the developing sleeve 14 is supplied with an alternating bias voltage superposed with a DC voltage component equal to the above-mentioned difference between the image region potential and the background region potential.

Further, in the case of so-called normal development scheme wherein a toner is attached to a higher potential region of an electrostatic latent image having such a higher-potential region and a lower potential region, a toner charged to a polarity opposite to that of the electrostatic latent image is used. On the other hand, in the case of the reversal development scheme wherein a toner is attached to a lower-potential region of an electrostatic latent image, a toner charged to a polarity identical to that of the electrostatic latent image is used. Herein, a higher-potential and a lower-potential refers to potential in terms of absolute value. In any case, the toner 10 is triboelectrically charged due to friction between the toner 10 and the developing sleeve 14 to a polarity appropriate for developing an electrostatic latent image on the photosensitive drum 7.

Figure 2:
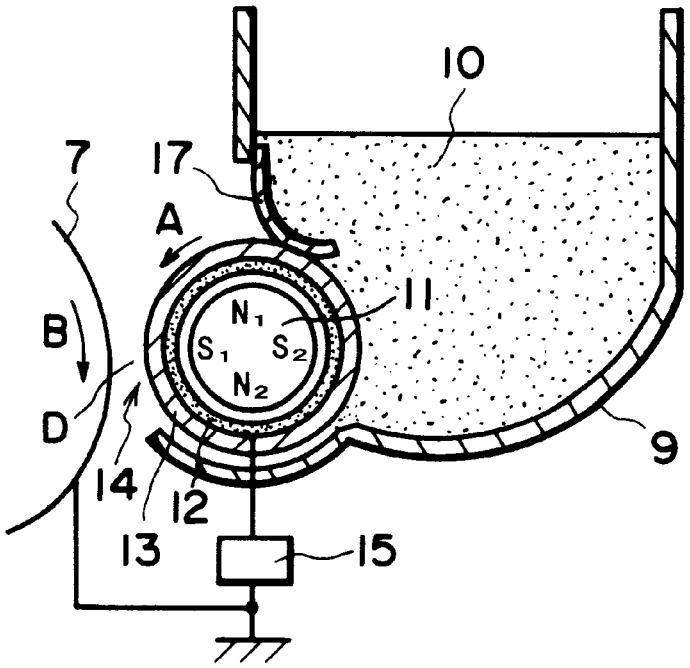

In a developing apparatus shown in FIG. 2, an elastic plate 17 comprising a material having a rubber elasticity, such as urethane rubber or silicone rubber, or a material having a metal elasticity, such as phosphor bronze or stainless steel, is used as a member for regulating the layer thickness of toner 10 on a developing sleeve 14, and the elastic plate 17 is pressed against the developing sleeve 14. In such a developing apparatus, a further thin toner layer can be formed on the developing sleeve 14. The other structure of the developing apparatus shown in FIG. 2 is basically identical to that of the apparatus shown in FIG. 1, and identical numerals in FIG. 2 represent identical members as in FIG. 1.

In the developing apparatus of FIG. 2, the toner is applied by rubbing with the elastic plate 17 onto the developing sleeve 14 to form a toner layer thereon, so that the toner can be provided with a larger triboelectric charge and thus results in a higher image density. This type of developing apparatus is used for a non-magnetic mono-component toner.

Figure 3:
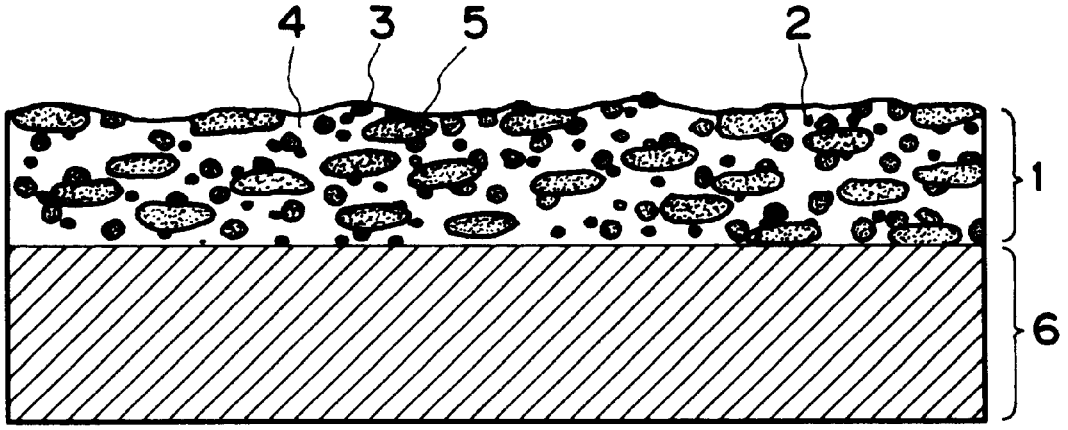
FIG. 3 is a partial sectional illustration of a developer-carrying member applicable to an embodiment of the image forming method according to the invention.

The developing sleeve used as a developer-carrying member in the present invention may preferably comprise a cylindrical substrate and a resinous coating layer coating the substrate surface. An example of such a structure is illustrated in FIG. 3 which is a partial sectional view of the sleeve. Referring to FIG. 3, a cylindrical substrate 6 is coated with a resinous coating layer 1 which may comprise a binder resin 4 and optionally an electroconductive substance 2, a filler 3, a solid lubricant 5, etc., as desired. In case where the electroconductive substance 2 is contained, the resin coating layer 1 becomes electroconductive. This is effective for preventing excessive charge of the toner. In case where the filler 3 is contained, the wearing of the resin coating layer 1 may be suppressed, and the toner charge can be suitably controlled by the charge-imparting ability of the filler 3. Further, in the case where the solid lubricant 5 is contained, the releasability between the toner and the developing sleeve can be improved, thereby preventing melt-sticking of the toner onto the developing sleeve.

In the case of incorporating an electroconductive substance in a resinous coating layer, the resinous coating layer may preferably exhibit a volume resistivity of at most $10^6$ ohm.cm, more preferably at most $10^3$ ohm.cm. In case where the volume resistivity of the resinous coating layer exceeds $10^6$ ohm.cm, the toner is liable to be excessively charged, thus resulting in occurrence of blotches or inferior developing performance.

The resinous coating layer may preferably have a surface roughness Ra in the range of 0.2–3.5 $\mu$m in terms of JIS center-line-average roughness. If Ra is below 0.2 $\mu$m, the toner charge in proximity to the sleeve is liable to be excessive, so that the toner is rather firmly held by the sleeve due to an image force and accordingly a fresh toner portion cannot be charged by the sleeve, thereby lowering the developing performance. If Ra exceeds 3.5 $\mu$m, the toner coating amount on the sleeve is liable to be excessive, so that the toner cannot be sufficiently charged but is ununiformly charged, thereby causing a lowering and irregularity of image density.

The resinous coating layer 1 may comprise materials as follows.

Referring to FIG. 3, examples of the electroconductive substance 2 may include: powder of metals, such as aluminum, copper, nickel and silver; powder of metal oxides, such as antimony oxide, indium oxide and tin oxide; and carbon homologues, such as carbon fiber, carbon black and graphite powder. Among these, carbon black is particularly excellent in electroconductivity and is suitably used because it imparts an electroconductivity when incorporated in a polymeric material at a fairly arbitrarily controlled level by controlling the addition amount thereof. The carbon black may preferably have a number-average particle size of 0.001–1.0 $\mu$m, more preferably 0.01–0.8 $\mu$m. In excess of 1 $\mu$m, it becomes difficult to control the volume resistivity of the resinous coating layer.

The electroconductive substance 2 may preferably be added in 0.1–300 wt. parts, more preferably 1–100 wt. parts, per 100 wt. parts of the binder resin 4 constituting the resinous coating layer 1.

The filler 3 may comprise a negative or positive charge control agent for toners. Examples of other materials constituting the filler 3 may include: inorganic compounds, such as aluminum, asbestos, glass fiber, calcium carbonate, magnesium carbonate, barium carbonate, barium sulfate, silica and calcium silicate; phenolic resin, epoxy resin, melamine resin, silicone resin, polymethyl methacrylate, methacrylate copolymers such as styrene/n-butylmethacrylate/silane terpolymer, styrene-butadiene copolymer, polycaprolactone; nitrogen-containing compounds, such as polycaprolactam, polyvinylpyridine, and polyamide; halogen-containing polymer, such as polyvinylidene fluoride, polyvinyl chloride, polytetrafluoroethylene, polychlorotrifluoroethylene, perfluoroalkoxyltrifluoroethylene, polytetrafluoroalkoxyethylene, hexafluoropropylene-tetrafluoroethylene copolymer, and trifluorochloroethylene-vinyl chloride copolymer; polycarbonate, and polyester. Among these, silica and alumina are preferred because of their hardness and toner chargeability controlling effect.

Such fillers 3 may preferably be used in 0.1–500 wt. part, more preferably 1–200 wt. parts, per 100 wt. parts of the binder resin 4.

The solid lubricant 5 may comprise, e.g., molybdenum disulfide, boron nitride, graphite, fluorinated graphite, silver-niobium selenide, calcium chloride-graphite, or talc. Among these, graphite may preferably be used because it has electroconductivity in addition to lubricity and may exhibit a function of reducing a portion of toner having an excessive charge to provide a level of charge suitable for development.

The solid lubricant 5 may preferably be added in 0.1–300 wt. parts, more preferably 1–150 wt. parts, per 100 wt. parts of the binder resin 4.

The binder resin 4 used for constituting the resinous coating layer 1 optionally together with such electroconductive substance 2, filler 3 or/and solid lubricant 5, added as desired, may comprise a resin, such as phenolic resin, epoxy resin, polyamide resin, polyester resin, polycarbonate resin, polyolefin resin, silicone resin, fluorine-containing resin, styrene resin or acrylic resin. It is particularly preferred to use a thermosetting or photocurable resin.

The developing sleeve may be provided with further preferable performances by surface treatment thereof as by abrasion or polishing for surface smoothing so as to expose the electroconductive substance 2, filler 3 or/and solid lubricant 5 to the sleeve surface at an appropriate level, or/and to smooth the surface for providing a surface with a uniform unevenness. This is particularly effective for suppressing longitudinal streaks appearing in solid black or halftone images or quickly providing a sufficient image density at the startup of image formation, particularly in a high temperature/high humidity environment. The abrasion or polishing treatment may be performed by using an abrasion or polishing stripe of felt or abrasive particle-attached strip for finishing the sleeve surface to a uniform unevenness, whereby the toner coating amount on the sleeve can be uniformized, thereby allowing only toner particles subjected to triboelectrification with the sleeve to be conveyed to the developing region. This is assumed to be the mechanism for the improved performances.

After the surface-smoothing treatment, the coating layer may preferably retain a surface roughness Ra (according to JIS B0601) in the range of 0.2–3.5 $\mu$m, more preferably 0.3–2.5 $\mu$m, for the same reason as described above.

The cylindrical substrate 6 may preferably comprise a cylinder of a non-magnetic metal or a resin. For example, a non-magnetic cylindrical tube, such as that of stainless steel, aluminum or copper. Such a cylindrical tube may be produced through drawing or extrusion, preferably followed by cutting or polishing for improving the size accuracy to a prescribed size accuracy. The cylindrical tube may preferably have a straight allowance of at most 30 $\mu$m, more preferably at most 20 $\mu$m, thus providing good images. The tube may be subjected to sand blasting or abrasion for provide a rough surface with an appropriate degree of surface unevenness. The blasting may be performed by using abrasive particles which may be definitely shaped or indefinitely shaped.

Now, an example of the image forming method according to the present invention, will be described with reference to FIG. 4, which illustrates an image forming apparatus including a contact charging means and a contact transfer means. In the present invention, it is possible to employ an image forming method including a corona charging scheme or/and a corona transfer scheme.

Figure 4:
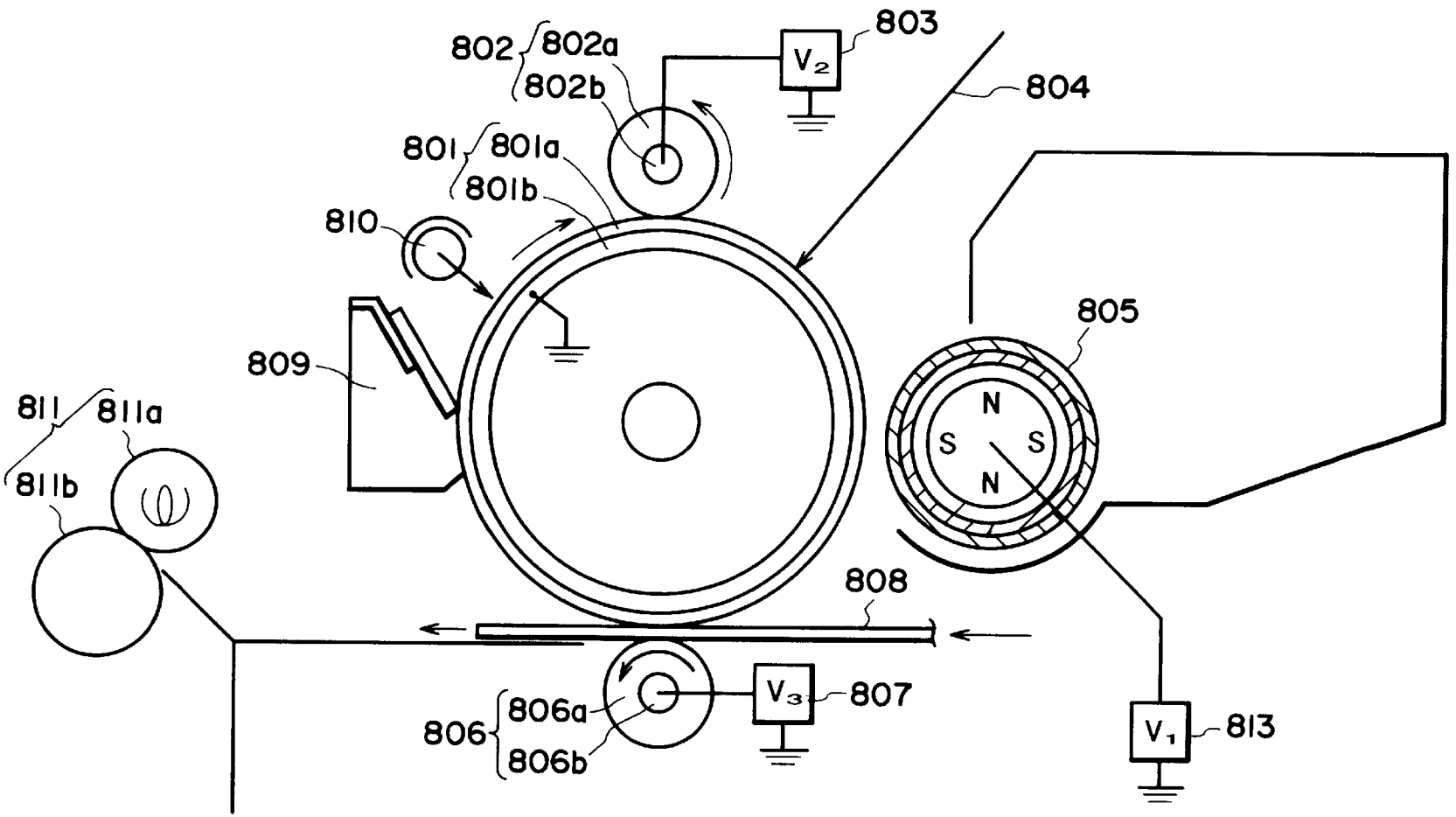
FIG. 4 is an illustration of an image forming apparatus to which the image forming method according to the invention is applicable.

Referring to FIG. 4, a rotating drum-type photosensitive member 801 comprising a photoconductor layer 801*a* and an electroconductive substrate 801*b* is rotated at a prescribed peripheral speed (process speed) in a clockwise direction as shown on the drawing. A charging roller 802 comprising an electroconductive elastic layer 802*a* and a core metal 802*b* is supplied with a bias voltage V2 from a charging bias voltage supply 803. The charging roller 802 is pressed against the photosensitive member 801 and is rotated following the rotation of the photosensitive member 801.

Based on the bias voltage applied to the charging roller 802, the surface of the photosensitive member 801 is charged to a prescribed voltage of a prescribed polarity. Then, the charged photosensitive member 801 is exposed to image light 804 to form an electrostatic latent image thereon, which is then visualized as a toner image by a developing means 805. The developing means 805 includes a developing sleeve which is supplied with a bias voltage V1 from a developing bias voltage supply 813.

The toner image formed on the photosensitive member 801 is electrostatically transferred onto a transfer-receiving material 808 under the action of a transfer bias voltage V3 supplied from a voltage supply 807 via a transfer roller 806 (as a contact transfer means for pressing the transfer-receiving material 808 onto the photosensitive member 801) comprising an electroconductive elastic layer 806*a* and a core metal 806*b*. The toner image transferred onto the transfer-receiving material 808 is then fixed onto the transfer-receiving material 808 under application of heat and pressure by a heat-pressure fixing means 811 comprising a heating roller 811*a* and a pressure roller 811*b*. The surface of the photosensitive member 801 is subjected to cleaning for removal of attached soiling substance, such as transfer residual toner by a cleaning device 809 having an elastic cleaning blade abutted against the photosensitive member 801 in a counter direction, and then charge-removed by a charge-removing exposure means 810, to be used for a subsequent cycle of image formation.

While the charging roller 802 has been described as a contact charging means in the above embodiment, the primary charging means can also comprise another contact charging means, such as a charging blade or a charging brush, or alternatively a non-contact corona charging means. However, the contact charging means is less liable to cause the generation of ozone.

Further, while the transfer roller 806 has been described, the transfer means can also comprise another contact transfer means, such as a transfer blade or a transfer belt, or alternatively a non-contact corona transfer means. The contact transfer means is less liable to cause the occurrence of ozone.

Figure 5:
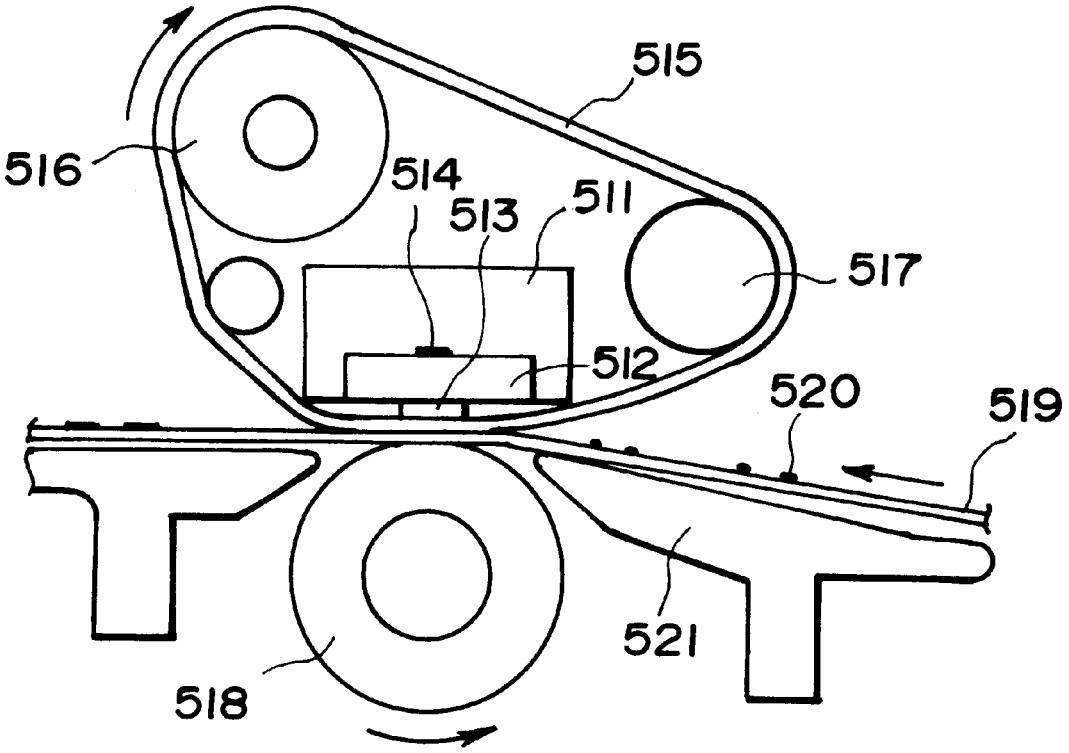
FIG. 5 is a schematic illustration of a film heat-fixing device as another heat-fixing means usable in an embodiment of the image forming method of the present invention.

In the image forming method according to the present invention, the heat-pressure fixing means used in a fixing step can be replaced a film heat-fixing device as another heat-fixing means. FIG. 5 shows an example of such a film heat-fixing device, wherein a transfer material 519 carrying thereon an unfixed toner image is passed between oppositely disposed heating member 511 and pressing member 518 via a fixing film 515 under a prescribed pressure to obtain a fixed toner image.

Referring to FIG. 5, the fixing device includes the heating member 511 which has a heat capacity smaller than that of a conventional hot roller (e.g., 811 shown in FIG. 4) and has a linear heating part exhibiting a maximum temperature of preferably 100–300° C.

The fixing film 515 disposed between the heating member 511 and the pressing member 518 (pressing roller in this case) may preferably comprise a heat-resistant sheet having a thickness of 1–100 μm. The heat-resistant sheet may comprise a sheet of a heat-resistant polymer, such as polyester, PET (polyethylene terephthalate), PFA (tetrafluoroethylene-perfluoroalkyl vinyl ether copolymer), PTFE (polytetrafluoroethylene), polyimide, or polyamide; a sheet of a metal such as aluminum, or a laminate of a metal sheet and a polymer sheet.

The fixing film 515 may preferably have a release layer and/or a low resistivity layer on such a heat-resistant sheet.

An specific embodiment of the fixing device will be described with reference to FIG. 5.

The device includes a low-heat capacity linear heating member 511, which may for example comprise an aluminum substrate 512 of 1.0 mm-t×10 mm-W×240 mm-L, and a resistance material 513 which has been applied in a width of 1.0 mm on the aluminum substrate and is energized from both longitudinal ends. The energization is performed by applying pulses of DC 100 V and a cycle period of 20 msec while changing the pulse widths so as to control the evolved heat energy and provide a desired temperature depending on the output of a temperature sensor 514. The pulse width may range from ca. 0.5 msec to 5 msec. In contact with the heating member 511 thus controlled with respect to the energy and temperature, a fixing film 515 is moved in the direction of an indicated arrow.

The fixing film 515 may for example comprise an endless film including a 20 μm-thick heat-resistant film (of, e.g., polyimide, polyether imide, PES or PFA, provided with a coating of a fluorine-containing-resin such as PTFE or PAF on its image contact side) and a 10 μm-thick coating release layer containing an electroconductive material therein. The total thickness may generally be less than 100 μm, preferably less than 40 μm. The film is driven in the arrow direction under tension between a drive roller 516 and a mating roller 517.

The fixing device further includes a pressure roller 518 having a releasable elastomer layer of, e.g., silicone rubber and pressed against the heating member 511 via the film 515 at a total pressure of 4–20 kg, while moving together with the film 515 in contact therewith. A transfer material 519 carrying an unfixed toner image 520 is guided along an inlet guide 521 to the fixing station to obtain a fixed image by the heating described above.

The above-described embodiment includes a fixing film 515 in the form of an endless belt but the film can also be an elongated sheet driven between a sheet supply axis and a sheet winding axis.

Various properties and/or parameters described herein for characterizing the toner according to the present invention are based on measurement methods described below.

(1) Chloroform-insoluble content

The chloroform-insoluble content of a binder resin contained in a toner is measured in the following manner.

2 g of a toner sample is accurately weighed (at $T_A$ g), placed in a cylindrical filter (e.g., "No. 86R", available from Toyo Roshi K.K.) and then subjected to extraction with 200 ml of solvent chloroform in a Soxhlet's extractor for 10 hours in an oil bath temperature-controlled at ca. 120° C. The solvent is evaporated from the extract solution to leave a chloroform-soluble resin content, which is dried under vacuum at 60° C. for 24 hours and then weighed (at $T_B$ g). The weight of components, such as a magnetic material or a pigment, other than the resinous component is determined (at $T_D$ g). THF-insoluble content ($T_C$) of the binder resin contained in the toner sample is calculated as follows:

$$T_C \text{ (wt. \%)}=\{[T_A-(T_B+T_D)]/(T_A-T_D)\}\times 100.$$

Alternately, THF-insoluble content ($T_C$) may also be determined based on the extraction residue (weighed at $T_E$ g) as follows:

$$T_C \text{ (wt. \%)}=[(T_E-E_D)/(T_A-T_D)]\times 100.$$

(2) Acid value

The acid value of a binder resin as a toner material, a binder resin after contained in a toner or a wax is measured basically according to JIS K-0070 in the following manner.

Apparatus: Automatic potentiometer titration apparatus, "AT-400" (available from Kyoto Denshi K.K.)

Apparatus calibration: Performed by using a mixture solvent of toluene 120 ml and ethanol 30 ml Temperature: 25° C.

Sample: Prepared by adding 1 g of a toner or a wax in 120 ml of toluene, followed by stirring at room temperature (ca. 25° C.) for ca. 10 hours for dissolution, and addition of 30 ml of ethanol.

As a specific preparatory step, from a toner sample, the other components are removed to recover a binder resin (polymer component) as a sample to be used for measurement. Alternatively, the acid value and content of components other than the polymer components are determined in advance. (For example, in the case where a toner sample is directly subjected to measurement, the contributions of the other components, such as a colorant or a magnetic material are determined based on their acid values and contents and subtracted from the measured value of the sample toner to calculate an acid value of the binder resin.) The measurement is performed as follows.

1) Ca. 0.5–2 g (e.g., 1 g) of a sample is accurately weighed to record its weight at W (g).

2) The sample is placed in a 300 ml-beaker and 150 ml of a toluene/ethanol (4/1) mixture solution is added thereto to dissolve the sample.

3) The solution in the beaker is titrated with a 0.1 mol/liter-KOH ethanol solution by using a potentiometric titrator (e.g., automatically titrated by using a potentiometric titrator and an electrically driven burette (e.g., "AT-400" (equipped with Win workstation) and "ABP-410", respectively, available from Kyoto Denshi K.K.).

4) The amount of the KOH solution used for the titration is denoted by S (ml). A blank test is performed in parallel to determine the amount of the KOH solution for the blank titration at B (ml).

5) The acid value of the sample is calculated by the following formula:

$$\text{Acid value (mgKOH/g)}=(S-B)\times f\times 5.61/W,$$

wherein f denotes a factor of the KOH solution.

Further, the acid value of a chloroform-insoluble (gel) content (Av.G) of the binder resin contained in the toner is calculated by the following formula:

$$\text{Av.G}=(\text{Av.B}-\text{Av.S}\times\text{chloroform-soluble content (wt. \%)}\times(1/100))/\text{chloroform-insoluble content (wt. \%)}\times(1/100),$$

wherein Av.B represents an acid value of the binder resin contained in the toner and Av.S represents an acid value of the chloroform-soluble content of the binder resin contained in the toner.

(3) THF-insoluble content

The THF-insoluble contents of a binder resin contained in a toner and a binder resin as a toner material are measured in the following manner, respectively.

Ca. 0.5–1.0 g of a toner sample is weighed (at $W_1$ g), placed in a cylindrical filter (e.g., "No. 86R", available from Toyo Roshi K.K.) and then subjected to extraction with 200 ml of solvent THF in a Soxhlet's extractor for 10 hours. The solvent is evaporated from the extract solution to leave a THF-soluble resin content, which is dried under vacuum at 100° C. for several hours and then weighed (at $W_2$ g). The weight of components, such as a magnetic material or a pigment, other than the resinous component is determined (at $W_3$ g). THF-insoluble content ($THF_{ins.}$) of the binder resin contained in the toner sample is calculated as follows:

$$THF_{ins.} \text{ (wt. \%)}=\{[W_1-(W_2+W_3)]/(W_1-W_3)\}\times 100$$

Alternately, THF-insoluble content ($THF_{ins.}$) may also be determined based on the extraction residue (weighed at $W_4$ g) as follows:

$$THF_{ins.} \text{ (wt. \%)}=[(W_4-W_3)/(W_1-W_3)]\times 100.$$

The insoluble content ($THF_{ins.}$) of the binder resin as a toner material (before contained in the toner) may be determined in the same manner as in the above case based on a binder sample before the extraction (weighed at $W_5$ g) and the extraction residue (weighed at $W_6$ g) as follows:

$$THF_{ins.} \text{ (wt. \%)}=(W_6/W_5)\times 100.$$

(4) Melting point of a wax

Measurement may be performed in the following manner by using a differential scanning calorimeter ("DSC-7", available from Perkin-Elmer Corp.) according to ASTM D3418-82.

A sample in an amount of 2–10 mg, preferably about 5 mg, is accurately weighed.

The sample is placed on an aluminum pan and subjected to measurement in a temperature range of 30–200° C. at a temperature-raising rate of 10° C./min in a normal temperature—normal humidity environment in parallel with a blank aluminum pan as a reference.

In the course of temperature increase, a main absorption peak appears at a temperature ($T_{MHA}$) in the range of 30–200° C. on a DSC curve. The temperature is taken as a wax melting point.

(5) Toner DSC curve

A toner's DSC curve is taken in the course of temperature increase similarly as in the above-described wax melting point measurement.

(6) Glass transition temperature (Tg) of a binder resin

Measurement may be performed in the following manner by using a differential scanning calorimeter ("DSC-7", available from Perkin-Elmer Corp.) according to ASTM D3418-82.

A sample in an amount of 5–20 mg, preferably about 10 mg, is accurately weighed.

The sample is placed on an aluminum pan and subjected to measurement in a temperature range of 30–200° C. at a temperature-raising rate of 10° C./min in a normal temperature—normal humidity environment in parallel with a blank aluminum pan as a reference.

In the course of temperature increase, a main absorption peak appears in the temperature region of 40–100° C.

In this instance, the glass transition temperature (Tg) is determined as a temperature of an intersection between a DSC curve and an intermediate line passing between the base lines obtained before and after the appearance of the absorption peak.

(7) Molecular weight distribution of a wax

The molecular weight (distribution) of a wax may be measured by GPC under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and recalculated into a distribution corresponding to that of polyethylene using a conversion formula based on the Mark-Houwink viscosity formula.

(8) Molecular weight distribution

The molecular weight (distribution) of a binder resin as a starting material or a THF-soluble content in a toner may be measured with respect to molecular weight of at least 800 based on a chromatogram obtained by GPC (gel permeation chromatography) using THF as a solvent in the following manner.

In the GPC apparatus, a column is stabilized in a heat chamber at 40° C., tetrahydrofuran (THF) solvent is caused to flow through the column at that temperature at a rate of 1 ml/min., and 50–200 $\mu$l of a GPC sample solution adjusted at a concentration of 0.05–0.6 wt. % is injected. In the case of a starting binder resin, the GPC sample solution may be prepared by passing the binder resin through a roll mill at 130° C. for 15 min. and dissolving the rolled resin in THF and, in the case of a toner sample, the GPC sample solution may be prepared by dissolving the toner in THF and then filtrating the solution through a 0.2 $\mu$m-filter to recover a THF-solution. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Pressure Chemical Co. or Toso K.K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The detector may be an RI (refractive index) detector. For accurate measurement, it is appropriate to constitute the column as a combination of several commercially available polystyrene gel columns in order to effect accurate measurement in the molecular weight range of $10^3$–$2\times10^6$. A preferred example thereof may be a combination of $\mu$-styragel 500, $10^3$, $10^4$ and $10^5$ available from Waters Co.; or a combination of Shodex KA-801, 802, 803, 804, 805, 806 and 807 available from Showa Denko K.K.

Based on the thus-obtained molecular weight distribution, a proportion of a component (% based on integrated value) in a molecular weight region of $1\times10^4$–$10\times10^4$ to a component (% based on integrated value) in a molecular weight region of at least 800 is calculated to determine a content of a component (% based on integrated value) having molecular weight of $1\times10^4$–$10\times10^4$.

The GPC sample may be prepared as follows.

A resinous sample is placed in THF and left standing for several hours. Then, the mixture is sufficiently shaken until a lump of the resinous sample disappears and then further left standing for at least 12 hours at room temperature. In this instance, a total time of from the mixing of the sample with THF to the completion of the standing in THF is taken for at least 24 hours. Thereafter, the mixture is caused to pass through a sample treating filter having a pore size of 0.2–0.5 $\mu$m (e.g., "Maishoridisk H-25-2", available from Toso K.K.) to recover the filtrate as a GPC sample. The sample concentration is adjusted to provide a resin concentration within the range of 0.5–5 mg/ml.

(9) Contact angle of a toner

The contact angle of a toner with respect to water is measured in the following manner.

Apparatus: FACE contact angle measurement apparatus (available from Kyowa Kaimen Kagaku K.K.)

Temperature: 23–25° C.

Humidity: 40–60% RH

A sample is prepared in the following manner. Ca. 10 g of a toner is compressed for 2 min. under a pressure of 200 kgf/cm$^2$ into a cylindrical tablet (diameter=25 mm, thickness=ca. 10 mm). The toner tablet is placed in a glass sample bottle (inner diameter=ca. 27 mm) (e.g., "Snap cup No. 30") and placed on a hot plate heated at 100–120° C. via a Teflon sheet, followed by application of a pressure of 5–10 kgf/cm$^2$ for ca. 5–10 min. After the toner is softened or melted, the glass sample bottle containing the toner is cooled and broken to take out the toner therefrom. The resultant melt-formed toner is successively abraded with abrasive papers (#280, #800 and #1500) to prepare a cylindrical tablet sample (diameter=25 mm, thickness=5 mm) having a measurement surface free from scars or flaws by eye observation.

Measurement of a contact angle is performed five times for the sample by using the above measurement apparatus in combination with deionized water or commercially-available purified water.

Based on the thus-measured five values, an average thereof is taken as a contact angle to water of the sample toner.

(10) Weight-average particle size ($D_4$) of a toner

The weight-average particle size and particle size distribution of a toner may be measured according to the Coulter counter method, e.g., by using Coulter Counter TA-IL or Coulter Multisizer (available from Coulter Electronics Inc.) together with an electrolytic solution comprising a ca. 1% NaCl aqueous solution which may be prepared by dissolving a reagent-grade sodium chloride or commercially available as "ISOTON-II" (from Counter Scientific Japan). For measurement, into 100 to 150 ml of the electrolytic solution, 0.1 to 5 ml of a surfactant (preferably an alkyl benzenesulfonic acid salt) is added as a dispersant, and 2–20 mg of a sample is added. The resultant dispersion of the sample in the electrolytic solution is subjected to a dispersion treatment by an ultrasonic disperser for ca. 1–3 min., and then subjected to measurement of particle size distribution by using the above-mentioned apparatus equipped with a 100 $\mu$m-aperture. The volume and number of toner particles having particle sizes of 2.00 $\mu$m or larger are measured for respective channels to calculate a volume-basis distribution and a number-basis distribution of the toner. From the volume-basis distribution, a weight-average particle size ($D_4$) of the toner is calculated by using a central value as a representative for each channel.

The channels used include 13 channels of 2.00–2.52 $\mu$m; 2.52–3.17 $\mu$m; 3.17–4.00 $\mu$m; 4.00–5.04 $\mu$m; 5.04–6.35 $\mu$m;

6.35–8.00 μm; 8.00–10.08 μm, 10.08–12.70 μm; 12.70–16.00 μm; 16.00–20.20 μm; 20.20–25.40 μm; 25.40–32.00 μm: and 32.00–40.30 μm.

(11) Different element quantity in magnetic iron oxide

The different element quantity in the magnetic iron oxide may be measured by fluorescent X-ray analysis using a fluorescent X-ray analyzer (e.g., "SYSTEM 3080", mfd. by Rigaku Denki Kogyo K.K.) according to JIS K0119 "General Rules for Fluorescent X-ray Analysis").

(12) Different element distribution and concentration in magnetic iron oxide

The different element distribution may be measured by gradual fractional dissolution of the magnetic iron oxide particles with hydrochloric acid or hydrofluoric acid and measurement of the element concentration in the solution at each fractional dissolution relative to the element concentration in the complete solution, respectively according to ICP (inductively coupled plasma) emission spectroscopy.

(13) Number-average particle size of a magnetic material

The number-average particle size of the magnetic material may be measured by taking photographs (magnification: 40,000) of particles thereof through a transmission electron microscope and measuring the particle sizes on the photographs with respect to randomly selected 300 particles by a digitizer.

(14) Magnetic properties of a magnetic material

The magnetic properties of the magnetic material are based on values measured by using a vibrating sample-type magnetometer ("VSM-3S-15", available from Toei Kogyo K.K.) under an external magnetic filed of 795.8 kA/m.

(15) Specific surface area of a magnetic material and external additive powder

The specific surface area values are based on values measured by using a specific surface area meter ("Autosorb 1", available from Yuasa Ionics K.K.) through the nitrogen adsorption according to the BET multi-point method.

(16) Methanol wettability of inorganic fine powder 0.2 g of a sample inorganic fine powder is added to 50 ml of water in a 250 ml-Erlenmeyer flask. While continuously stirring the liquid in the flask with a magnetic stirrer, methanol is added in the flask from a buret until the whole sample powder is wetted with the liquid (water+methanol mixture) in the flask. The end point can be confirmed by the suspension of the total amount of the sample powder. The methanol wettability is given as the percentage of methanol in the methanol-water mixture on reaching the end point.

(17) Zr proportion in chloroform-insoluble content (Zr-gel (%))

The proportion of zirconium (element) contained in the chloroform-insoluble (gel) content of the toner is determined in the following manner.

5 species of toner samples each comprising a toner binder resin and an organic zirconium compound (content: 0.0 wt. %, 0.5 wt. %, 1.0 wt. %, 2.0 wt. % or 5.0 wt. %) for preparation of a calibration curve (Zr content vs. X-ray intensity) are prepared and press-molded by a press molding machine.

Each of the thus-prepared toner samples is subjected to measurement of X-ray intensity by using a fluorescent X-ray analyzer ("Model 3080", mfd. by Rigaku Denki K.K.) under the following conditions:

Potential and Current: 50 kV and 50 mA

ZrKα peak angle: 22.5 degrees

Crystal plate: LiF plate

Time: 60 sec.

Based on the thus-measured X-ray intensities for 5 toner samples, a calibration curve is prepared.

A Zr content ($Z_1$ wt. %) of a toner is determined based on an X-ray intensity of the toner and the above-prepared calibration curve.

The toner is then subjected to Soxhlet's extraction with chloroform, followed by evaporation to dryness to obtain a chloroform-soluble content.

The thus-obtained chloroform-soluble content is subjected to measurement of X-ray intensity similarly as in the toner to determine a Zr content ($Z_2$ wt. %) of the chloroform-soluble content.

From a difference between $Z_1$ (Zr content (wt. %) of the toner) and $Z_2$ (Zr content (wt. %) of the chloroform-soluble content) (i.e., $Z_1-Z_2=Z_3$ (Zr content (wt. %) of the chloroform-insoluble (gel) (content), the proportion of zirconium (Zr element) contained in the gel content (chloroform-insoluble content) of the toner (Zr-gel %) is determined according to the following equation:

$$\text{Zr-gel } (\%)=(Z_1-Z_2)\times 100/Z_1=100\times Z_3/Z_1.$$

Hereinbelow, the present invention will be described more specifically based on Examples, to which the present invention should not be however construed to be limited. In the following, "part(s)" means "weight part(s)".

(Polymer Production Example 1)

| | |
|---|---|
| Styrene | 67 parts |
| n-Butyl acrylate | 17 " |
| Mono-n-butylmaleate | 16 " |
| Di-t-butyl peroxide (polymerization initiator) | 5 " |

200 parts of xylene was placed in a reaction vessel equipped with a reflux condenser, a stirring device, a thermometer, a nitrogen gas induction device, a dropping device and a vacuum device.

Into the xylene, the above vinyl monomer composition (mixture) was added and heated to a refluxing temperature while supplying nitrogen gas thereto and kept at that temperature for 12 hours, followed by distilling-off of the xylene under reduced pressure to obtain a vinyl polymer (Polymer (1)).

The thus-obtained Polymer (1) exhibited a weight-average molecular weight (Mw) of 7,000, a ratio of Mw to Mn number-average molecular weight (Mw/Mn) of 2.3, a glass transition temperature (Tg) of 59.4° C. and an acid value (Av) of 38.1 mgKOH/g.

(Polymer Production Example 2)

A vinyl polymer (Polymer (2)) was prepared in the same manner as in Polymer Production Example 1 except for changing the vinyl monomer composition to the following vinyl monomer composition.

| | |
|---|---|
| Styrene | 78 parts |
| n-Butyl acrylate | 20 " |
| Mono-n-butylmaleate | 3 " |
| Di-t-butyl peroxide (polymerization initiator) | 4 " |

The thus-obtained Polymer (2) exhibited Mw=9,000, Mw/Mn=2.3, Tg=60.2° C. and Av=8.2 mgKOH/g.

(Polymer Production Example 3)

A vinyl polymer (Polymer (3)) was prepared in the same manner as in Polymer Production Example 1 except for changing the vinyl monomer composition to the following vinyl monomer composition.

| | |
|---|---|
| Styrene | 75 parts |
| n-Butyl acrylate | 20 " |
| Mono-n-butylmaleate | 6 " |
| Di-t-butyl peroxide (polymerization initiator) | 4 " |

The thus-obtained Polymer (3) exhibited Mw=8,000, Mw/Mn=2.2, Tg=60.4° C. and Av=17.7 mgKOH/g.

(Polymer Production Example 4)

A vinyl polymer (Polymer (4)) was prepared in the same manner as in Polymer Production Example 1 except for changing the vinyl monomer composition to the following vinyl monomer composition.

| | |
|---|---|
| Styrene | 75 parts |
| n-Butyl acrylate | 20 " |
| Mono-n-butylmaleate | 5 " |
| Di-t-butyl peroxide (polymerization initiator) | 3.2 " |

The thus-obtained Polymer (4) exhibited Mw=14,000, Mw/Mn=2.3, Tg=58.8° C. and Av=27.3 mgKOH/g.

(Polymer Production Example 5)

A vinyl polymer (Polymer (5)) was prepared in the same manner as in Polymer Production Example 1 except for changing the vinyl monomer composition to the following vinyl monomer composition.

| | |
|---|---|
| Styrene | 73 parts |
| n-Butyl acrylate | 24 " |
| Mono-n-butylmaleate | 3 " |
| Di-t-butyl peroxide (polymerization initiator) | 3 " |

The thus-obtained Polymer (5) exhibited Mw=14,000, Mw/Mn=2.5, Tg=59.2° C. and Av=8.7 mgKOH/g.

(Polymer Production Example 6)

A vinyl polymer (Polymer (6)) was prepared in the same manner as in Polymer Production Example 1 except for changing the vinyl monomer composition to the following vinyl monomer composition.

| | |
|---|---|
| Styrene | 72 parts |
| n-Butyl acrylate | 25 " |
| Mono-n-butylmaleate | 3 " |
| Di-t-butyl peroxide (polymerization initiator) | 2.5 " |

The thus-obtained Polymer (6) exhibited Mw=20,000, Mw/Mn=2.3, Tg=59.1° C. and Av=9.4 mgKOH/g.

(Polymer Production Example 7)

| | |
|---|---|
| Styrene | 32 parts |
| n-Butyl acrylate | 13 " |
| Mono-n-butylmaleate | 5 " |

-continued

| | |
|---|---|
| 1,1-Bis(t-butylperoxy)cyclohexane (polymerization initiator) | 3 " |

200 parts of xylene was placed in a reaction vessel equipped with a reflux condenser, a stirring device, a thermometer, a nitrogen gas induction device, a dropping device and a vacuum device, and heated to 107° C. while supplying nitrogen gas thereto.

Into the xylene, the above first vinyl monomer composition (mixture) was added dropwise and kept at that temperature for 8 hours (first polymerization reaction).

The reaction mixture was heated to 120° C. and to which the following second vinyl polymer composition was added dropwise in 1 hour.

| | |
|---|---|
| Styrene | 32 parts |
| n-Butyl acrylate | 13 " |
| Mono-n-butylmaleate | 5 " |
| xylene | 50 " |

The resultant mixture was kept at that temperature for 8 hours to complete a second polymerization reaction, followed by distilling-off of the xylene under reduced pressure to obtain a vinyl polymer (Polymer (7)).

The thus-obtained Polymer (7) exhibited Mw=15,000, Mw/Mn=2.1, Tg=60.8° C. and Av=31.0 mgKOH/g.

(Polymer Production Example 8)

A vinyl polymer (Polymer (8)) was prepared in the same manner as in Polymer Production Example 7 except for changing the first and second vinyl monomer compositions to those shown below, respectively.

First vinyl monomer composition

| | |
|---|---|
| Styrene | 35 parts |
| n-Butyl acrylate | 13 " |
| Mono-n-butylmaleate | 2 " |
| 1,1-Bis(t-butylperoxy)cyclohexane (polymerization initiator) | 3 " |

Second vinyl monomer composition

| | |
|---|---|
| Styrene | 35 parts |
| n-Butyl acrylate | 13 " |
| Mono-n-butylmaleate | 2 " |
| Xylene | 50 " |

The thus-obtained Polymer (8) exhibited Mw=15,000, Mw/Mn=2.1, Tg=59.8° C. and Av=14.2 mgKOH/g.

(Polymer Production Example 9)

A vinyl polymer (Polymer (9)) was prepared in the same manner as in Polymer Production Example 7 except for changing the first and second vinyl monomer compositions to those shown below, respectively.

First vinyl monomer composition

| | |
|---|---|
| Styrene | 35 part(s) |
| n-Butyl acrylate | 14 " |
| Mono-n-butylmaleate | 1 " |

-continued

| | |
|---|---|
| 1,1-Bis(t-butylperoxy)cyclohexane (polymerization initiator) | 3 " |

Second vinyl monomer composition

| | |
|---|---|
| Styrene | 35 part(s) |
| n-Butyl acrylate | 14 " |
| Mono-n-butylmaleate | 1 " |
| Xylene | 50 " |

The thus-obtained Polymer (9) exhibited Mw=14,000, Mw/Mn=2.1, Tg=59.1° C. and Av=6.7 mgKOH/g.

(Polymer Production Example 10)

A vinyl polymer (Polymer (10)) was prepared in the same manner as in Polymer Production Example 7 except for changing the first and second vinyl monomer compositions to those shown below, respectively, and changing the polymerization (reaction) temperature (107° C.) of the first polymerization reaction to 100° C.

First vinyl monomer composition

| | |
|---|---|
| Styrene | 70 parts |
| Mono-n-butylmaleate | 2 " |
| 1,1-Bis(t-butylperoxy)cyclohexane (polymerization initiator) | 3 " |

Second vinyl monomer composition

| | |
|---|---|
| n-Butyl acrylate | 26 part(s) |
| Mono-n-butylmaleate | 1 " |
| Xylene | 50 " |

The thus-obtained Polymer (10) exhibited Mw=21,000, Mw/Mn=2.3, Tg=58.8° C. and Av=11.2 mgKOH/g.

(Polymer Production Example 11)

A vinyl polymer (Polymer (11)) was prepared in the same manner as in Polymer Production Example 8 except for changing the polymerization temperature (107° C.) of the first polymerization reaction to 100° C.

The thus-obtained Polymer (11) exhibited Mw=19,000, Mw/Mn=2.3, Tg=59.1° C. and Av=7.2 mgKOH/g.

(Polymer Production Example 12)

| | |
|---|---|
| Styrene | 69 part(s) |
| n-Butyl acrylate | 29 " |
| Mono-n-butylmaleate | 2 " |
| 2,2-Bis(4,4-di-t-butylperoxy-cyclohexyl)propane (polymerization initiator) | 0.2 " |

2 parts of polyvinyl alcohol and 200 parts of deaerated deionized water was placed in a reaction vessel equipped with a reflux condenser, a stirring device, a thermometer and a nitrogen gas induction device.

Into the mixture, the above vinyl monomer composition (mixture) was added and heated to 77° C. while supplying nitrogen gas thereto and kept at that temperature for 20 hours. Thereafter, 0.5 part of benzolyl peroxide was added to the resultant mixture at that temperature and kept for 4 hours. The mixture was then heated to 95° C. and kept at that temperature for 2 hours to complete polymerization reaction.

After the reaction, the reaction mixture (suspension) was subjected to filtration, followed by washing and drying to obtain a vinyl polymer (Polymer (12)).

The thus-obtained polymer (12) exhibited Mw=1,435,600, Mw/Mn=3.3, Tg=56.3° C., Av=6.2 mgKOH/g and a THF-insoluble content (THFins.)=3.4 wt. %.

(Polymer Production Example 13)

A vinyl polymer (Polymer (13)) was prepared in the same manner as in Polymer Production Example 12 except that the polymerization temperature (77° C.) was changed to 75° C. and the vinyl monomer composition was changed to the following vinyl monomer composition.

| | |
|---|---|
| Styrene | 69 part(s) |
| n-Butyl acrylate | 29 " |
| Mono-n-butylmaleate | 2 " |
| t-Amylperoxy 2-ethylhexanoate (polymerization initiator) | 0.2 " |

The thus-obtained Polymer (13) exhibited Mw=835,100, Mw/Mn=2.3, Tg=58.9° C. and Av=6.9 mgKOH/g.

(Polymer Production Example 14)

A vinyl polymer (Polymer (14)) was prepared in the same manner as in Polymer Production Example 12 except for changing the vinyl monomer composition to the following vinyl monomer composition.

| | |
|---|---|
| Styrene | 64 part(s) |
| n-Butyl acrylate | 28 " |
| Mono-n-butylmaleate | 8 " |
| 2,2-Bis(4,4-di-t-butylperoxy-cyclohexyl)propane | 0.2 " |

The thus-obtained Polymer (14) exhibited Mw=787,000, Mw/Mn=2.3, Tg=58.7° C. and Av=22.2 mgKOH/g.

(Polymer Production Example 15)

A vinyl polymer (Polymer (15)) was prepared in the same manner as in Polymer Production Example 5 except for changing the vinyl monomer composition to the following vinyl monomer composition.

| | |
|---|---|
| Styrene | 75.5 part(s) |
| n-Butyl acrylate | 20 " |
| Mono-n-butylmaleate | 4 " |
| Divinylbenzene | 0.5 " |
| Di-t-butyl peroxide | 3 " |

The thus-obtained Polymer (15) exhibited Mw=165,000, Mw/Mn=24.4, Tg=60.3° C. and Av=13.2 mgKOH/g.

(Polymer Production Example 16)

A vinyl polymer (Polymer (16)) was prepared in the same manner as in Polymer Production Example 5 except for changing the vinyl monomer composition to the following vinyl monomer composition.

| | |
|---|---|
| Styrene | 78.5 part(s) |
| n-Butyl acrylate | 20.0 " |
| Mono-n-butylmaleate | 1.0 " |

-continued

| | |
|---|---|
| Divinylbenzene | 0.5 " |
| Di-t-butyl peroxide | 3 " |

The thus-obtained Polymer (16) exhibited Mw=186,000, Mw/Mn=22.7, Tg=60.7° C. and Av=3.8 mgKOH/g.

(Comparative Polymer Production Example 1)

A comparative vinyl polymer (Comparative Polymer (1)) was prepared in the same manner as in Polymer Production Example 1 except for changing the vinyl monomer composition to the following vinyl monomer composition.

| | |
|---|---|
| Styrene | 80 parts |
| n-Butyl acrylate | 20 " |
| Di-t-butyl peroxide (polymerization initiator) | 10 " |

The thus-obtained Comparative Polymer (1) exhibited Mw=4,000, Mw/Mn=2.2, Tg=59.6° C. and Av=0.6 mgKOH/g.

(Comparative Polymer Production Example 2)

A comparative vinyl polymer (Comparative Polymer (2)) was prepared in the same manner as in Polymer Production Example 1 except for changing the vinyl monomer composition to the following vinyl monomer composition.

| | |
|---|---|
| Styrene | 58 parts |
| n-Butyl acrylate | 20 " |
| Mono-n-butylmaleate | 22 " |
| Di-t-butyl peroxide (polymerization initiator) | 8 " |

The thus-obtained Comparative Polymer (2) exhibited Mw=4,000, Mw/Mn=2.5, Tg=59.3° C. and Av=46.1 mgKOH/g.

(Comparative Polymer Production Example 3)

A comparative vinyl polymer (Comparative Polymer (3)) was prepared in the same manner as in Polymer Production Example 1 except for changing the vinyl monomer composition to the following vinyl monomer composition.

| | |
|---|---|
| Styrene | 80 parts |
| n-Butyl acrylate | 20 " |
| Di-t-butyl peroxide (polymerization initiator) | 5 " |

The thus-obtained Comparative Polymer (3) exhibited Mw=236,000, Mw/Mn=3.2, Tg=60.2° C. and Av=0.4 mgKOH/g.

(Comparative Polymer Production Example 4)

A comparative vinyl polymer (Comparative Polymer (4)) was prepared in the same manner as in Polymer Production Example 12 except for changing the vinyl monomer composition to the following vinyl monomer composition.

| | |
|---|---|
| Styrene | 52 parts |
| n-Butyl acrylate | 28 " |
| Mono-n-butylmaleate | 20 " |
| Benzoyl peroxide (polymerization initiator) | 5 " |

The thus-obtained Comparative Polymer (4) exhibited Mw=234,000, Mw/Mn=3.3, Tg=58.7° C. and Av=43.3 mgKOH/g.

(Comparative Polymer Production Example 5)

A comparative vinyl polymer (Comparative Polymer (5)) was prepared in the same manner as in Polymer Production Example 1 except for changing the vinyl monomer composition to the following vinyl monomer composition.

| | |
|---|---|
| Styrene | 80 parts |
| n-Butyl acrylate | 20 " |
| Di-t-butyl peroxide (polymerization initiator) | 3 " |

The thus-obtained Comparative Polymer (5) exhibited Mw=292,000, Mw/Mn=4.3, Tg=60.2° C. and Av=0.5 mgKOH/g.

(Comparative Polymer Production Example 6)

A comparative vinyl polymer (Comparative Polymer (6)) was prepared in the same manner as in Polymer Production Example 12 except for changing the vinyl monomer composition to the following vinyl monomer composition.

| | |
|---|---|
| Styrene | 52 parts |
| n-Butyl acrylate | 28 " |
| Mono-n-butylmaleate | 20 " |
| Benzoyl peroxide (polymerization initiator) | 3 " |

The thus-obtained Comparative Polymer (6) exhibited Mw=288,000, Mw/Mn=3.6, Tg=59.4° C. and Av=41.8 mgKOH/g.

Physical properties of the thus-prepared vinyl and comparative vinyl polymers (Polymers (1)–(16) and Comparative Polymers (1)–(6)) were summarized in Table 2.

TABLE 2

Vinyl Polymer Production

| | Production Ex. No. | Polymer No. | Mp* ($\times 10^4$) | Mw ($\times 10^4$) | Mw/Mn | Tg (° C.) | Av (mgKOH/g) |
|---|---|---|---|---|---|---|---|
| Ex. | 1 | Polymer (1) | 0.7 | 0.7 | 2.3 | 59.4 | 38.1 |
| | 2 | Polymer (2) | 0.8 | 0.9 | 2.3 | 60.2 | 8.2 |
| | 3 | Polymer (3) | 0.8 | 0.8 | 2.2 | 60.4 | 17.7 |

TABLE 2-continued

Vinyl Polymer Production

| Production Ex. No. | | Polymer No. | Mp* ($\times 10^4$) | Mw ($\times 10^4$) | Mw/Mn | Tg (° C.) | Av (mgKOH/g) |
|---|---|---|---|---|---|---|---|
| | 4 | Polymer (4) | 1.3 | 1.4 | 2.3 | 58.8 | 27.3 |
| | 5 | Polymer (5) | 1.3 | 1.4 | 2.5 | 59.2 | 8.7 |
| | 6 | Polymer (6) | 1.9 | 2.0 | 2.3 | 59.1 | 9.4 |
| | 7 | Polymer (7) | 1.3 | 1.5 | 2.1 | 60.8 | 31.0 |
| | 8 | Polymer (8) | 1.4 | 1.5 | 2.1 | 59.8 | 14.2 |
| | 9 | Polymer (9) | 1.2 | 1.4 | 2.1 | 59.1 | 6.7 |
| | 10 | Polymer (10) | 2.0 | 2.1 | 2.3 | 58.8 | 11.2 |
| | 11 | Polymer (11) | 1.8 | 1.9 | 2.3 | 59.1 | 7.2 |
| | 12 | Polymer (12) | 80.1 | 143.5 | 3.3 | 56.3 | 6.2 |
| | 13 | Polymer (13) | 67.8 | 83.5 | 2.3 | 58.9 | 6.9 |
| | 14 | Polymer (14) | 67.6 | 78.7 | 2.3 | 58.7 | 22.2 |
| | 15 | Polymer (15) | 1.31 | 16.5 | 24.4 | 60.3 | 13.2 |
| | 16 | Polymer (16) | 1.47 | 18.6 | 22.7 | 60.7 | 3.8 |
| Comp. | 1 | Comp. Polymer (1) | 0.4 | 0.4 | 2.2 | 59.6 | 0.6 |
| Ex. | 2 | Comp. Polymer (2) | 0.4 | 0.4 | 2.5 | 59.3 | 46.1 |
| | 3 | Comp. Polymer (3) | 23.4 | 23.6 | 3.2 | 60.2 | 0.4 |
| | 4 | Comp. Polymer (4) | 23.2 | 23.4 | 3.3 | 58.7 | 43.3 |
| | 5 | Comp. Polymer (5) | 28.3 | 29.2 | 4.3 | 60.2 | 0.5 |
| | 6 | Comp. Polymer (6) | 28.1 | 28.8 | 3.6 | 59.4 | 41.8 |

*Mp: peak molecular weight (Binder Resin Production Example 1)

In a reaction vessel equipped with a reflux condenser, a stirring device, a thermometer and a vacuum device, 75 parts of Polymer (1) and 25 parts of Polymer (14) were added to 200 parts of xylene and heated to refluxing temperature (of xylene) while stirring the mixture, followed by stirring for blending at that temperature for 2 hours and then distilling-off of the xylene to obtain Binder Resin 1.

The thus-prepared Binder Resin 1 exhibited a main peak molecular weight (Mp) of 8,000, a sub-peak molecular weight (Msp) of 639,000, Mw=215,000, Mw/Mn=48.0 and Av=33.3 mgKOH/g.

The results are summarized in Table 4 appearing hereinafter.

(Binder Resin Production Examples 2–26)

Binder Resins 2–26 were prepared in the same manner as in Binder Resin Production Example 1 except that the vinyl polymers (Polymers (1) and (14)) were changed to those shown in Table 2, respectively, and waxes shown in Table 3 according to prescriptions shown in Table 4 were added in xylene together with the corresponding vinyl polymers, respectively.

Physical properties of the thus-prepared Binder Resins 2–26 are also summarized in Table 4.

(Reference Binder Resin Production Examples 1 and 2)

Reference Binder Resins 1 and 2 were prepared in the same manner as in Binder Resin Production Example 1 except that the vinyl polymers (Polymers (1) and (14)) were changed to Polymer (15) (for Reference Binder Resin 2) shown in Table 2, respectively.

Physical properties and prescriptions are summarized in Table 5 appearing hereinafter.

(Comparative Binder Resin Production Examples 1–6)

Comparative Binder Resins 1–6 were prepared in the same manner as in Binder Resin Production Example 1 except that the vinyl polymers (Polymers (1) and (14)) were changed to comparative vinyl polymers shown in Table 2 and comparative waxes shown in Table 3, as desired, according to prescriptions shown in Table 5, respectively.

Physical properties of the thus-prepared Comparative Binder Resins 1–6 are also summarized in Table 5.

TABLE 3

Waxes

| Wax No. | | Species of wax | Mp | Mw/Mn | Tmain* (° C.) |
|---|---|---|---|---|---|
| Wax | (1) | Hydrocarbon wax | 500 | 1.3 | 83 |
| Wax | (2) | Wax of formula (1) (A = hydroxyl) | 780 | 1.8 | 112 |
| Wax | (3) | Hydrocarbon wax | 950 | 1.7 | 108 |
| Wax | (4) | Maleic acid-modified polypropylene wax | 2900 | 6.6 | 120 |
| Wax | (5) | Polypropylene wax | 3100 | 8.8 | 132 |
| Ref. Wax | (1) | Polyethylene wax | 710 | 1.4 | 90 |
| " | (2) | Polypropylene wax | 3600 | 8.6 | 135 |
| " | (3) | Polyethylene wax | 3400 | 1.5 | 130 |
| Comp. Ex. | (1) | Hydrocarbon wax | 340 | 1.2 | 64 |
| " | (2) | Polypropylene wax | 5800 | 24 | 139 |

* Tmain (° C.): Heat absorption main peak temperature

TABLE 4

Binder Resin production

| Ex. No. | Binder resin No. | Combination of Polymers Polymer No. | Parts/ | Polymer No. | Parts | Mp ($\times 10^4$) | Msp ($\times 10^4$) | Mw ($\times 10^4$) | Mw/Mn | Component ($10^4$–$10^5$)*(%) | Av | Wax No. | Parts |
|---|---|---|---|---|---|---|---|---|---|---|---|---|---|
| 1 | 1 | (1) | 75 | (14) | 25 | 0.8 | 63.9 | 21.5 | 48.0 | 30.7 | 33.3 | — | — |
| 2 | 2 | (1) | 75 | (14) | 25 | 0.8 | 63.8 | 21.6 | 48.2 | 30.4 | 34.0 | (3) | 7 |
| 3 | 3 | (1) | 80 | (12) | 20 | 0.8 | 76.4 | 23.9 | 40.8 | 34.2 | 31.7 | (3) | 7 |
| 4 | 4 | (2) | 75 | (12) | 25 | 0.9 | 76.3 | 23.8 | 40.4 | 34.6 | 7.8 | (3) | 7 |
| 5 | 5 | (2) | 80 | (13) | 20 | 0.9 | 63.6 | 20.2 | 47.9 | 25.9 | 8.0 | (3) | 7 |
| 6 | 6 | (3) | 80 | (13) | 20 | 0.9 | 64.0 | 21.0 | 49.2 | 26.1 | 15.3 | (3) | 7 |
| 7 | 7 | (4) | 80 | (13) | 20 | 1.4 | 69.3 | 22.4 | 47.3 | 43.5 | 20.3 | (3) | 7 |
| 8 | 8 | (5) | 80 | (13) | 20 | 1.3 | 69.6 | 21.8 | 48.7 | 43.8 | 8.4 | (3) | 7 |
| 9 | 9 | (6) | 75 | (13) | 25 | 2.2 | 63.0 | 24.1 | 22.2 | 55.3 | 8.7 | (3) | 7 |
| 10 | 10 | (7) | 80 | (13) | 20 | 1.3 | 69.4 | 25.1 | 47.2 | 54.1 | 26.1 | (3) | 7 |
| 11 | 11 | (8) | 80 | (12) | 20 | 1.3 | 79.3 | 25.3 | 34.6 | 36.4 | 12.0 | (3) | 7 |
| 12 | 12 | (8) | 80 | (13) | 20 | 1.3 | 69.1 | 22.5 | 38.7 | 42.8 | 11.8 | (3) | 7 |
| 13 | 13 | (8) | 80 | (14) | 20 | 1.3 | 69.0 | 22.3 | 29.1 | 43.5 | 15.2 | (3) | 7 |
| 14 | 14 | (9) | 80 | (13) | 20 | 1.3 | 69.6 | 23.1 | 36.7 | 43.3 | 5.5 | (3) | 7 |
| 15 | 15 | (10) | 75 | (14) | 25 | 2.3 | 63.2 | 24.3 | 23.2 | 54.7 | 13.4 | (3) | 7 |
| 16 | 16 | (4) | 80 | (13) | 20 | 1.4 | 68.9 | 21.7 | 45.3 | 42.8 | 20.7 | (2) | 7 |
| 17 | 17 | (4) | 80 | (13) | 20 | 1.4 | 69.3 | 22.9 | 47.1 | 43.3 | 20.6 | (4) | 7 |
| 18 | 18 | (4) | 80 | (13) | 20 | 1.4 | 69.1 | 24.3 | 45.7 | 43.7 | 20.8 | (5) | 4 |
| 19 | 19 | (4) | 80 | (13) | 20 | 1.4 | 69.4 | 24.7 | 47.6 | 42.9 | 19.8 | (4) | 4 |
| | | | | | | | | | | | | (1) | 3 |
| 20 | 20 | (4) | 80 | (13) | 20 | 1.4 | 69.6 | 24.8 | 47.3 | 43.2 | 20.4 | (5) | 4 |
| | | | | | | | | | | | | (1) | 3 |
| 21 | 21 | (4) | 80 | (13) | 20 | 1.4 | 69.3 | 24.4 | 47.2 | 43.6 | 21.0 | (3) | 4 |
| | | | | | | | | | | | | (4) | 3 |
| 22 | 22 | (4) | 80 | (13) | 20 | 1.4 | 68.8 | 23.0 | 48.4 | 44.1 | 19.8 | (3) | 4 |
| | | | | | | | | | | | | (5) | 3 |
| 23 | 23 | (4) | 80 | (13) | 20 | 1.4 | 69.2 | 23.7 | 47.0 | 43.8 | 20.9 | (4) | 4 |
| | | | | | | | | | | | | (5) | 3 |
| 24 | 24 | (8) | 80 | (13) | 20 | 1.3 | 69.4 | 22.3 | 48.7 | 43.8 | 15.4 | (3) | 4 |
| | | | | | | | | | | | | (1) | 3 |
| 25 | 25 | (8) | 80 | (13) | 20. | 1.3 | 69.7 | 21.9 | 48.7 | 43.8 | 15.3 | (4) | 4 |
| | | | | | | | | | | | | (1) | 3 |
| 26 | 26 | (8) | 80 | (13) | 20 | 1.3 | 69.5 | 22.1 | 48.7 | 43.8 | 15.4 | (5) | 4 |
| | | | | | | | | | | | | (1) | 3 |

*Component ($10^4$–$10^5$): Component having molecular weights of $1 \times 10^4$–$10 \times 10^4$.

TABLE 5

Reference and Comparative Binder Resin Production

| Ref. or Comp. Ex. No. | Binder resin No. | Combination of Polymers Polymer No. | Parts/ | Polymer No. | Parts | Mp ($\times 10^4$) | Msp ($\times 10^4$) | Mw ($\times 10^4$) | Mw/Mn | Component ($10^4$–$10^5$)*(%) | Av | Comp. Wax No. | Parts |
|---|---|---|---|---|---|---|---|---|---|---|---|---|---|
| Ref. 1 | Ref. 1 | (15) | 100 | — | — | 1.31 | 23.5 | 16.5 | 24.4 | 38.7 | 13.2 | — | — |
| Ref. 2 | Ref. 2 | (16) | 100 | — | — | 1.47 | 26.7 | 18.6 | 22.7 | 32.2 | 3.8 | — | — |
| Comp. 1 | Comp. 1 | Comp. (1) | 70 | Comp. (3) | 30 | 0.4 | 25.7 | 11.5 | 32.1 | 13.4 | 0.5 | — | — |
| Comp. 1 | Comp. 2 | Comp. (2) | 70 | Comp. (4) | 30 | 0.4 | 25.6 | 11.3 | 32.3 | 13.7 | 44.5 | — | — |
| Comp. 3 | Comp. 3 | Comp. (1) | 70 | Comp. (3) | 30 | 0.4 | 26.1 | 12.0 | 33.0 | 15.4 | 0.3 | (1) | 7 |
| Comp. 4 | Comp. 4 | Comp. (1) | 70 | Comp. (3) | 30 | 0.4 | 25.6 | 11.2 | 32.3 | 13.6 | 0.7 | (2) | 7 |
| Comp. 5 | Comp. 5 | Comp. (2) | 70 | Comp. (4) | 30 | 0.4 | 25.7 | 11.5 | 32.7 | 14.1 | 43.2 | (1) | 7 |
| Comp. 6 | Comp. 6 | Comp. (2) | 70 | Comp. (4) | 30 | 0.4 | 25.3 | 11.6 | 32.2 | 13.6 | 44.6 | (2) | 7 |

EXAMPLE 1

| | |
|---|---|
| Binder Resin (1) | 100 parts |
| Organic zirconium compound (164) | 2 " |
| Wax (3) | 7 " |
| Magnetic iron oxide (Dav. (average particle diameter) = 0.18 $\mu$m, Hc = 10.7 kA/n, $\sigma r$ = 11.2 $Am^2/kg$, $\sigma s$ = 81.5 $Am^2/kg$) | 90 " |

The above mixture was melt-kneaded through a twin-screw extruder heated at 130° C., and after being cooled, was coarsely crushed by a hammer mill, followed by fine pulverization by a jet mill and classification by a pneumatic classifier, to obtain a magnetic toner (toner particles) having a D4 (weight-average particle size) of 6.9 $\mu$m.

100 wt. parts of the magnetic toner was blended with 1.0 wt. part of externally added hydrophobic dry-process silica ($S_{BET}$ (BET specific surface area)=200 $m^2/g$) by a Henschel mixer to obtain Toner (1).

As a result of various measurements and analysis, the thus-prepared Toner (1) exhibited an acid value (Av.T) of 15.1 mgKOH/g and a contact angle to water ($\theta_{CA}$) of 107 degrees and contained both a chloroform-soluble central having an acid value (Av.S) and a chloroform-insoluble content having an acid value (Av.G). The difference between the acid values (Av.G–Av.S) was 53.3 mgKOH/g.

Binder resin (1) contained in Toner (1) was found to contain a chloroform-insoluble content in an amount of 46.2 wt. % and a THF-insoluble content in an amount of 54.5 wt. %.

Toner (1) contained zirconium (Zr) element in an amount of 0.22 wt. % and a THF-soluble content providing a GPC chromatogram exhibiting a main peak molecular weight (Mp) of 8,000 and a sub-peak molecular weight (Msp) of 561,000.

The measurement and analysis results including other properties are summarized in Tables 6 and 7 appearing hereinbelow.

The above-prepared Toner (1) was subjected to a continuous image forming test on 50,000 sheets by using a digital copying machine ("GP-215" (process speed: 105 mm/sec), mfd. by Canon K.K.) and copying machines ("NP-6650" (process speed: 320 mm/sec) and "NP-6085" (process speed: 513 mm/sec), both mfd. by Canon K.K.) each remodeled so as to remove a cleaning member from the fixing device (using a heat-resistant film 515 as shown in FIG. 5 for "GP-215" or using hot rollers 811 as shown in FIG. 4 for "NP-6650" and "NP-6085") to evaluate image forming characteristic (image density) and cleaning performance for the toner on the photosensitive member in an environment of 23° C. and 50% RH in the following manner, whereby good image forming and cleaning performances as shown in Table 8 were obtained.

(Image density)

The image density was measured by using a Macbeth densitometer (available from Macbeth Co.) equipped with an SPI filter for measurement of a reflection density with respect to a circular image of 5 mm in diameter.

(Cleaning performance)

The cleaning performance was evaluated after the continuous copying test according to the following standard:

A: No filming on the photosensitive member surface.

B: Slight filming on the photosensitive member surface was observed at the portion not contacting the paper.

C: Slight filming on the photosensitive member surface was observed at the paper-contacting portion but no adverse effect was observed on the images.

D: Filming leading to fogs on the images was observed on the photosensitive member surface.

E: Toner melt-sticking leading to image spots was observed on the photosensitive member surface.

Further, in an environment of 23° C. and 50% RH, a fixing test was performed at varying fixing temperatures by using test apparatus obtained by taking out the fixing devices of the copying apparatus ("GP-215", "NP-6650", and "NP-6085") and attaching thereto an external drive and a temperature controller, whereby good fixing performances as shown in Table 9 were obtained.

Toner fixability shown in Table 30 was evaluated with respect to image density lowering percentage (IDLP) and occurrence of hot offset (HO, i.e., high temperature-offset) and occurrence of toner soiling (TS) of the fixing member (heat-resistant film, heating-roller or pressure roller) according to the following methods.

(Low-temperature fixability for "GP-215")

The low-temperature fixability was evaluated as an image density lowering percentage (IDLP) after rubbing a fixed solid black image having an image density of 1.3–1.4 with a paper ("Dasper", mfd. by Ozu Sangyo K.K.) under a load of 50 g/cm$^2$, relative to the image density before the rubbing. The fixing of the solid black image was performed by using a fixing device set at 150° C.

A: IDLP of below 5%.

B: IDLP of at least 5% and below 10%.

C: IDLP of at least 10% and below 15%.

D: IDLP of at least 15% and below 20%.

E: IDLP of at least 20%.

(Low-temperature fixability for "GP-6650" and "GP-6085")

The low-temperature fixability was evaluated in the same manner as in the case of "GP-215" except for changing the fixing temperature (150° C.) to 180° C.

(Hot offset)

The hot offset (HO) was evaluated according to the following standard.

A: No hot offset occurred.

B: Slight hot offset occurred but at a practically acceptable level.

C: Hot offset readily recognized by eye observation occurred.

D: Remarkable hot offset occurred.

E: The transfer paper was wound about the fixing roller due to hot offset.

(Toner soiling)

The toner soiling (TS) of the fixing device was evaluated by a degree of soiling of heating members (e.g. heat-resistant film, heating roller and pressure roller) by toner particles according to the following standard.

A: No toner soiling was observed.

B: Slight toner soiling was observed but at a practically acceptable level.

C: Toner soiling was readily observed by eyes.

D: Remarkable toner soiling was observed.

E: Soiling toner particles was attached to the front and/or back surface of the transfer paper.

The above-prepared Toner (1) was also evaluated as to a wax dispersibility (WD) within toner particles in the following manner.

(Wax dispersibility)

A sample toner was observed through an optical microscope equipped with a polarizing plate at a relatively low magnification (e.g., 30–100) to count the number of bright spots indicating the presence of (free) wax particles liberated from toner in a region including ca. 500 toner particles.

A: No bright spots.

B: 1–10 bright spots (at a practically acceptable level).

C: 11–20 bright spots (at a level of increased fog density on fixed images).

D: 21–30 bright spots (at a level of wax-sticking onto the photosensitive member).

E: 31 or more bright spots (at a level of wax and toner-sticking onto the photosensitive member).

EXAMPLES 2–23

Toners (2)–(23) were prepared according to prescriptions shown in Table 6 otherwise in a similar manner as in Example 1 and evaluated in the same manner as in Example 1. The properties of the respective toners are shown in Tables 6 and 7, and the evaluation results are shown in Tables 8–9.

Reference Examples 1 and 2

Reference Toners (1) and (2) were prepared according to prescriptions shown in Table 6 otherwise in a similar manner as in Example 1 and evaluated in the same manner as in Example 1. The properties of the respective reference toners are shown in Tables 6 and 7, and the evaluation results are shown in Tables 8–9.

Comparative Example 1

| | |
|---|---|
| Comparative Binder Resin (1) | 100 parts |
| Organic zinc compound (176) shown below | 2 parts |
| Comparative Wax (1) | 7 parts |
| Magnetic iron oxide | 90 parts |
| (Dav. = 0.18 $\mu$m, Hc = 10.7 kA/n, | |
| $\sigma r$ = 11.2 $Am^2/kg$, $\sigma s$ = 81.5 $Am^2/kg$) | |

-continued

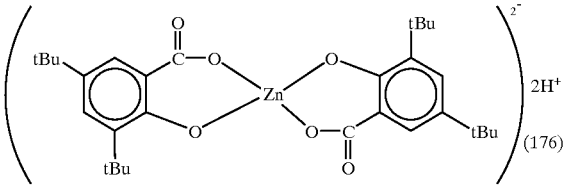

Comparative Toner (1) was prepared by using the above mixture otherwise in a similar manner as in Example 1 and evaluated in the same manner as in Example 1. The properties of the comparative toner are shown in Tables 6 and 7, and the evaluation results are shown in Tables 8–9.

Comparative Examples 2–6

Comparative Toners (2)–(6) were prepared according to prescriptions shown in Table 6 otherwise in a similar manner as in Comparative Example 1 and evaluated in the same manner as in Example 1. The properties of the respective toners are shown in Tables 6 and 7, and the evaluation results are shown in Tables 8–9.

TABLE 6

| Binder resin No. | Wax (for toner production) | (parts) | Organic Zr compound No. | Insoluble Content (wt. %) parts | Chloroform | THF | Mp ($\times 10^4$) | Msp ($\times 10^4$) | Mw/Mn | Component ($10^4$—$10^5$)(%) |
|---|---|---|---|---|---|---|---|---|---|---|
| (1) | Wax (3) | (7) | 164 | 2 | 46.2 | 54.5 | 0.8 | 56.1 | 41.3 | 40.7 |
| (2) | | — | 164 | 2 | 34.5 | 41.8 | 0.8 | 61.7 | 35.2 | 38.2 |
| (7) | | — | 42 | 2 | 14.4 | 20.6 | 1.3 | 68.8 | 48.4 | 45.1 |
| (7) | | — | 164 | 2 | 27.6 | 36.2 | 1.3 | 66.5 | 50.2 | 42.3 |
| (7) | | — | 166 | 2 | 24.5 | 31.7 | 1.3 | 67.1 | 49.0 | 43.6 |
| (7) | | — | 171 | 2 | 21.3 | 29.9 | 1.3 | 67.5 | 49.5 | 44.1 |
| (7) | | — | 173 | 2 | 18.7 | 25.6 | 1.3 | 67.5 | 49.5 | 44.3 |
| (13) | | — | 42 | 2 | 7.1 | 10.3 | 1.3 | 68.2 | 28.8 | 45.8 |
| (13) | | — | 164 | 2 | 22.4 | 26.7 | 1.3 | 67.1 | 32.2 | 48.8 |
| (13) | | — | 166 | 2 | 20.3 | 25.1 | 1.3 | 67.7 | 31.8 | 47.7 |
| (13) | | — | 171 | 2 | 19.2 | 24.4 | 1.3 | 68.0 | 31.1 | 47.2 |
| (13) | | — | 173 | 2 | 19.0 | 24.1 | 1.3 | 68.0 | 30.8 | 46.6 |
| (16) | | — | 166 | 2 | 24.2 | 30.9 | 1.3 | 67.5 | 47.8 | 47.8 |
| (17) | | — | 166 | 2 | 24.6 | 32.2 | 1.3 | 66.3 | 48.0 | 50.0 |
| (18) | | — | 166 | 2 | 25.1 | 33.8 | 1.3 | 66.1 | 47.0 | 50.5 |
| (19) | | — | 166 | 2 | 26.8 | 37.1 | 1.3 | 66.6 | 47.8 | 49.3 |
| (20) | | — | 166 | 2 | 27.3 | 37.8 | 1.3 | 65.8 | 46.3 | 51.1 |
| (21) | | — | 173 | 2 | 28.0 | 39.0 | 1.3 | 65.0 | 45.1 | 50.3 |
| (22) | | — | 166 | 2 | 28.2 | 39.0 | 1.3 | 64.5 | 44.0 | 52.8 |
| (23) | | — | 166 | 2 | 31.2 | 39.7 | 1.3 | 64.4 | 43.3 | 53.0 |
| Ex. 21 | (24) | — | 166 | 2 | 25.5 | 35.2 | 1.3 | 67.0 | 49.2 | 50.4 |
| Ex. 22 | (25) | — | 166 | 2 | 26.2 | 36.3 | 1.3 | 67.0 | 48.3 | 49.1 |
| Ex. 23 | (26) | — | 160 | 2 | 26.4 | 36.6 | 1.3 | 66.3 | 47.8 | 49.5 |
| Ref. Ex. 1 | Ref. (1) | Ref. Wax (1) (2) Ref. Wax (2) (4) | 42 | 2 | 16.8 | 24.0 | 1.28 | 217 | 330 | 29.3 |
| Ref. Ex. 2 | Ref. (2) | Ref. Wax (1) (3) Ref. Wax (3) (3) | 67 | 2 | 7.3 | 14.0 | 1.42 | 28.9 | 32.8 | 71.4 |
| Comp. Ex. 1 | Comp. (1) | Comp. Wax (1) (7) | 176 | 2 | 0 | 0 | 0.4 | 24.3 | 31.9 | 13.8 |
| Comp. Ex. 2 | Comp. (2) | Comp. Wax (2) (7) | 176 | 2 | 0 | 0 | 0.4 | 23.9 | 30.3 | 14.4 |
| Comp. Ex. 3 | Comp. (3) | — | 176 | 2 | 0 | 0 | 0.4 | 25.5 | 31.6 | 14.6 |
| Comp. Ex. 4 | Comp. (4) | — | 176 | 2 | 0 | 0 | 0.4 | 25.3 | 32.4 | 13.9 |
| Comp. Ex. 5 | Comp. (5) | — | 176 | 2 | 0 | 1.0 | 0.4 | 25.3 | 31.7 | 14.5 |
| Comp. Ex. 6 | Comp. (6) | — | 176 | 2 | 0 | 1.0 | 0.4 | 24.6 | 30.8 | 14.1 |

TABLE 7

| Ex. No. | Av. T (mmKOH/g) | Av. B (mmKOH/g) | Av. S (mmKOH/g) | Av.G (mmKOH/g) | Av. G − Av. S | $\theta_{CA}$ | Wax Mp | Wax Mw/Mn | Zr content in toner (wt. %) | Localiation of Zr gel* (%) |
|---|---|---|---|---|---|---|---|---|---|---|
| Ex. 1 | 15.1 | 30.0 | 10.1 | 53.3 | 43.2 | 107 | 950 | 1.7 | 0.22 | 92 |
| Ex. 2 | 15.7 | 31.2 | 13.6 | 64.7 | 51.1 | 108 | 950 | 1.7 | 0.23 | 84 |
| Ex. 3 | 9.4 | 18.7 | 7.0 | 88.1 | 81.1 | 106 | 950 | 1.7 | 0.15 | 36 |
| Ex. 4 | 8.6 | 17.1 | 4.3 | 50.8 | 46.5 | 108 | 950 | 1.7 | 0.23 | 74 |
| Ex. 5 | 8.8 | 17.5 | 7.9 | 47.2 | 39.3 | 112 | 950 | 1.7 | 0.27 | 72 |
| Ex. 6 | 9.0 | 17.9 | 10.4 | 45.8 | 45.4 | 112 | 950 | 1.7 | 0.10 | 53 |
| Ex. 7 | 9.0 | 17.9 | 11.7 | 45.1 | 33.4 | 112 | 950 | 1.7 | 0.13 | 45 |
| Ex. 8 | 7.0 | 14.0 | 8.9 | 80.1 | 71.2 | 109 | 950 | 1.7 | 0.15 | 30 |
| Ex. 9 | 6.1 | 12.1 | 4.0 | 40.3 | 36.3 | 113 | 950 | 1.7 | 0.23 | 69 |
| Ex. 10 | 6.4 | 12.7 | 4.3 | 45.9 | 41.6 | 113 | 950 | 1.7 | 0.27 | 66 |
| Ex. 11 | 6.6 | 13.1 | 4.9 | 47.8 | 42.9 | 112 | 950 | 1.7 | 0.10 | 48 |
| Ex. 12 | 6.6 | 13.1 | 5.2 | 47.1 | 41.9 | 113 | 950 | 1.7 | 0.13 | 43 |
| Ex. 13 | 9.3 | 18.5 | 7.1 | 54.3 | 47.2 | 110 | 780 | 1.8 | 0.27 | 68 |
| Ex. 14 | 8.8 | 17.5 | 6.6 | 51.0 | 44.4 | 115 | 2900 | 6.6 | 0.27 | 72 |
| Ex. 15 | 8.5 | 16.9 | 6.8 | 47.1 | 40.3 | 115 | 3100 | 8.8 | 0.27 | 72 |
| Ex. 16 | 8.0 | 15.9 | 5.3 | 44.9 | 39.6 | 110 | 450 | 9.3 | 0.27 | 73 |
| Ex. 17 | 7.6 | 15.1 | 5.2 | 41.6 | 36.4 | 110 | 450 | 12.9 | 0.27 | 75 |
| Ex. 18 | 7.5 | 14.9 | 4.9 | 40.7 | 35.8 | 118 | 900 | 7.8 | 0.27 | 76 |
| Ex. 19 | 7.3 | 14.5 | 4.5 | 40.1 | 35.6 | 122 | 900 | 13.3 | 0.27 | 76 |
| Ex. 20 | 7.3 | 14.5 | 3.9 | 38.0 | 34.1 | 124 | 2900 | 9.1 | 0.27 | 79 |
| Ex. 21 | 8.5 | 16.9 | 6.5 | 47.3 | 40.8 | 112 | 450 | 1.8 | 0.27 | 72 |
| Ex. 22 | 8.5 | 16.9 | 6.1 | 47.5 | 41.4 | 112 | 450 | 10.6 | 0.27 | 73 |
| Ex. 23 | 8.3 | 16.8 | 5.8 | 46.4 | 40.6 | 112 | 450 | 9.0 | 0.27 | 73 |
| Ref. Ex. 1 | 11.9 | 11.0 | 8.6 | 28.2 | 19.6 | 107 | 3200 | 8.7 | 0.15 | 57 |
| Ref. Ex. 2 | 2.6 | 2.6 | 0.8 | 25.5 | 24.7 | 106 | 3300 | 3.6 | 0.15 | 28 |
| Comp. Ex. 1 | 0.5 | 1.6 | 1.6 | — | — | 97 | 340 | 1.3 | — | — |
| Comp. Ex. 2 | 44.2 | 45.3 | 45.3 | — | — | 100 | 5800 | 24 | — | — |
| Comp. Ex. 3 | 0.5 | 1.8 | 1.8 | — | — | 98 | 340 | 1.3 | — | — |
| Comp. Ex. 4 | 0.5 | 1.3 | 1.3 | — | — | 98 | 5800 | 24 | — | — |
| Comp. Ex. 5 | 43.0 | 43.7 | 43.7 | — | — | 98 | 340 | 1.3 | — | — |
| Comp. Ex. 6 | 44.5 | 44.8 | 44.8 | — | — | 102 | 5800 | 24 | — | — |

TABLE 8

| Ex. No. | Image forming performance and cleanability | | | | | | | | |
|---|---|---|---|---|---|---|---|---|---|
| | GP-215 | | | NP-6650 | | | NP-6085 | | |
| | Initial | After 50000 sheets | Clean-ability | Initial | After 50000 sheets | Clean-ability | Initial | After 50000 sheets | Clean-ability |
| 1 | 1.35 | 1.36 | B | 1.36 | 1.37 | B | 1.35 | 1.36 | B |
| 2 | 1.37 | 1.37 | A | 1.38 | 1.38 | B | 1.38 | 1.38 | B |
| 3 | 1.36 | 1.37 | B | 1.36 | 1.38 | B | 1.36 | 1.38 | B |
| 4 | 1.37 | 1.38 | A | 1.38 | 1.38 | B | 1.38 | 1.38 | B |
| 5 | 1.39 | 1.37 | A | 1.37 | 1.38 | B | 1.38 | 1.38 | B |
| 6 | 1.39 | 1.39 | B | 1.38 | 1.39 | B | 1.37 | 1.39 | B |
| 7 | 1.38 | 1.40 | B | 1.38 | 1.40 | B | 1.38 | 1.40 | B |
| 8 | 1.37 | 1.37 | A | 1.37 | 1.37 | A | 1.37 | 1.37 | A |
| 9 | 1.37 | 1.39 | A | 1.38 | 1.38 | A | 1.38 | 1.38 | A |
| 10 | 1.38 | 1.38 | A | 1.38 | 1.38 | A | 1.38 | 1.38 | A |
| 11 | 1.39 | 1.39 | A | 1.39 | 1.39 | A | 1.39 | 1.39 | A |
| 12 | 1.39 | 1.40 | A | 1.39 | 1.40 | A | 1.39 | 1.40 | A |
| 13 | 1.40 | 1.41 | B | 1.38 | 1.38 | B | 1.38 | 1.38 | B |
| 14 | 1.38 | 1.38 | A | 1.40 | 1.41 | A | 1.38 | 1.39 | A |
| 15 | 1.39 | 1.38 | A | 1.40 | 1.40 | A | 1.40 | 1.41 | A |
| 16 | 1.37 | 1.38 | B | 1.40 | 1.40 | B | 1.38 | 1.39 | B |
| 17 | 1.38 | 1.38 | B | 1.38 | 1.39 | A | 1.41 | 1.40 | B |
| 18 | 1.40 | 1.41 | B | 1.39 | 1.40 | B | 1.37 | 1.38 | B |
| 19 | 1.38 | 1.39 | B | 1.40 | 1.41 | A | 1.38 | 1.38 | A |
| 20 | 1.40 | 1.40 | B | 1.40 | 1.40 | A | 1.39 | 1.42 | A |
| 21 | 1.38 | 1.38 | A | 1.37 | 1.38 | A | 1.37 | 1.38 | B |
| 22 | 1.37 | 1.39 | B | 1.39 | 1.40 | A | 1.38 | 1.39 | B |
| 23 | 1.39 | 1.39 | B | 1.40 | 1.41 | A | 1.3 | 1.39 | B |
| Ref. 1 | 1.37 | 1.38 | C | 1.38 | 1.38 | C | 1.39 | 1.40 | B |
| Ref. 2 | 1.39 | 1.37 | B | 1.37 | 1.38 | C | 1.36 | 1.38 | C |
| Comp. 1 | 0.93 | 0.91 | E | 0.98 | 0.91 | E | 0.90 | 0.83 | E |
| Comp. 2 | 0.95 | 0.98 | D | 0.96 | 1.01 | D | 0.98 | 0.97 | D |
| Comp. 3 | 0.96 | 1.02 | D | 0.93 | 0.94 | D | 0.95 | 0.91 | D |
| Comp. 4 | 1.02 | 1.07 | D | 1.03 | 1.06 | D | 1.01 | 1.02 | D |
| Comp. 5 | 1.04 | 1.05 | D | 0.99 | 0.97 | E | 0.99 | 0.98 | E |
| Comp. 6 | 1.06 | 1.07 | D | 1.05 | 1.09 | D | 1.06 | 1.06 | D |

TABLE 9

| Ex. No. | Toner fixability | | | | | | | | | |
|---|---|---|---|---|---|---|---|---|---|---|
| | GP-215 | | | NP-6650 | | | NP-6085 | | | |
| | IDLP | HO | TS | IDLP | HO | TS | IDLP | HO | TS | WD |
| 1 | B | A | B | B | A | B | B | A | B | B |
| 2 | A | B | B | B | B | B | B | B | B | A |
| 3 | A | B | B | A | B | B | B | B | B | B |
| 4 | A | A | B | A | B | B | B | A | B | A |
| 5 | A | B | A | A | B | B | B | A | B | A |
| 6 | A | B | A | A | B | B | B | A | B | A |
| 7 | A | B | A | A | B | B | A | B | B | A |
| 8 | A | B | B | A | B | B | B | B | B | A |
| 9 | A | A | A | A | A | A | B | A | B | A |
| 10 | A | A | A | A | A | A | A | A | B | A |
| 11 | A | A | A | A | A | A | A | A | B | A |
| 12 | A | A | A | A | A | A | A | A | B | A |
| 13 | A | B | B | B | B | A | B | B | B | A |
| 14 | B | A | B | B | A | B | A | A | B | B |
| 15 | B | A | A | A | A | B | A | A | B | A |
| 16 | B | B | A | A | B | A | B | B | A | B |
| 17 | B | B | A | A | A | A | A | A | A | B |
| 18 | A | A | A | A | B | B | A | B | B | B |
| 19 | A | A | B | B | A | A | A | A | A | A |
| 20 | B | B | B | B | B | B | A | B | A | B |
| 21 | A | A | B | B | A | B | A | B | B | A |
| 22 | A | A | A | A | A | B | B | A | B | B |
| 23 | A | A | B | B | A | B | A | A | B | A |
| Ref. 1 | A | A | B | B | A | B | A | B | B | B |
| Ref. 2 | A | B | B | A | B | C | B | B | C | B |
| Comp. 1 | D | E | E | D | E | E | D | E | E | E |

TABLE 9-continued

| Ex. No. | Toner fixability | | | | | | | | | |
|---|---|---|---|---|---|---|---|---|---|---|
| | GP-215 | | | NP-6650 | | | NP-6085 | | | |
| | IDLP | HO | TS | IDLP | HO | TS | IDLP | HO | TS | WD |
| Comp. 2 | E | D | D | E | E | D | E | D | D | E |
| Comp. 3 | D | E | D | D | E | E | D | E | E | E |
| Comp. 4 | D | D | D | D | E | D | E | D | D | D |
| Comp. 5 | E | D | D | D | D | D | D | D | D | D |
| Comp. 6 | D | D | D | D | D | D | E | D | D | D |

As described hereinabove, according to the present invention, by using a negative charge control agent comprising the above-described organic zirconium compound in combination with a binder resin comprising the above-described vinyl polymer having a specific acid value and molecular weight distribution, it is possible to realize a toner having a negative triboelectric chargeability capable of exhibiting a good low-temperature fixability and causing no heating member soiling due to offset phenomenon in a low to high temperature range even when used in a high to medium-speed apparatus using a hot roller fixing device or a medium to low-speed apparatus using a fixed heater via a heat-resistant film.

The toner can also provide a halftone image exhibiting good fixability even when formulated as a smaller particle size toner containing a large amount of a colorant, particularly a magnetic material.

The toner can further retain a sufficient offset-prevention effect even on a fixing member and a cleaning member which have been deteriorated with time (year) and providing an excellent releasability and a good developing performance in combination.

What is claimed is:

1. A toner having a negative triboelectric chargeability, comprising: at least a binder resin, a colorant, a wax and an organic metal compound, wherein (a) the toner has an acid value of 5–35 mgKOH/g, (b) the binder resin comprises a vinyl polymer, (c) the binder resin in the toner contains a chloroform-insoluble content in an amount of 3–50 wt. %, (d) the toner contains a THF (tetrahydrofuran)-soluble content providing a GPC (gel permeation chromatography) chromatogram exhibiting a main peak in a molecular weight range of 5,000–30,000 and at least one sub-peak and/or shoulder in a molecular weight range of $2\times10^5$–$15\times10^5$ and including 15–70% of a component having molecular weights of $1\times10^4$–$10\times10^4$, and (e) the organic metal compound is an organic zirconium compound comprising a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids.

2. The toner according to claim 1, wherein the toner has an acid value of 10–30 mgKOH/g.

3. The toner according to claim 1, wherein the chloroform-insoluble content is 5–45 wt. %.

4. The toner according to claim 1, wherein the chloroform-insoluble content is 10–40 wt. %.

5. The toner according to claim 1, wherein the main peak is in a molecular weight range of 7,000–25,000.

6. The toner according to claim 1, wherein the main peak is in a molecular weight range of 9,000–20,000.

7. The toner according to claim 1, wherein the THF-soluble content contains 20–60% of a component having molecular weights of $1\times10^4$–$10\times10^4$.

8. The toner according to claim 1, wherein the THF-soluble content contains 25–50% of a component having molecular weights above $10^5$.

9. The toner according to claim 1, wherein said at least one sub-peak and/or shoulder is in a molecular range of $3\times10^5$–$12\times10^5$.

10. The toner according to claim 9, wherein the THF soluble content contains 25–50% of a component having molecular weights above $10^5$.

11. The toner according to claim 1, wherein said organic zirconium compound is contained in the toner as a charge control agent.

12. The toner according to claim 1, wherein said organic zirconium compound is a zirconium complex comprising a coordination with an aromatic diol, an aromatic hydroxycarboxylic acid or an aromatic polycarboxylic acid.

13. The toner according to claim 1, wherein said organic zirconium compound is a zirconium complex salt comprising a coordination with an aromatic diol, an aromatic hydroxycarboxylic acid or an aromatic polycarboxylic acid.

14. The toner according to claim 1, wherein said organic zirconium compound comprises a zirconium complex or complex salt having a structure including one ligand of an aromatic diol, an aromatic hydroxycarboxylic acid or an aromatic carboxylic acid.

15. The toner according to claim 1, wherein said organic zirconium compound comprises a zirconium complex or complex salt having a structure including two ligands of an aromatic diol, an aromatic hydroxycarboxylic acid or an aromatic carboxylic acid.

16. The toner according to claim 1, wherein said organic zirconium compound comprises a zirconium complex or complex salt having a structure including three ligands of an aromatic diol, an aromatic hydroxycarboxylic acid or an aromatic carboxylic acid.

17. The toner according to claim 1, wherein said organic zirconium compound comprises a zirconium complex or complex salt having a structure including four ligands of an aromatic diol, an aromatic hydroxycarboxylic acid or an aromatic carboxylic acid.

18. The toner according to claim 1, wherein said organic zirconium compound is a zirconium salt comprising an ionic bonding with an aromatic carbolic acid, an aromatic hydroxycarboxylic acid or an aromatic polycarboxylic acid.

19. The toner according to claim 1, wherein said organic zirconium compound comprises a structure represented by the following formula (1):

(1)

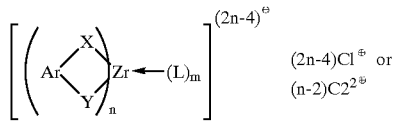

wherein Ar denotes an aromatic residual group capable of having a substituent of alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes O or —CO—O—; L denotes a neutral ligand of water, alcohol, ammonia, alkylamine or pyridine; C1 denotes a monovalent cation of hydrogen ion, monovalent metal ion, ammonium ion or alkylammonium ion; C2 denotes a divalent cation of a metal ion; n is 2, 3 or 4; m is 0, 2 or 4; a plurality (n) of ligands of aromatic carboxylic acids and diols can be identical to or different from each other, and a plurality (m>0) of neutral ligands can be identical to or different from each other in each complex or complex salt of a formula; with the proviso that each complex or complex salt of a formula can also be a mixture of complex compounds having mutually different n or/and m, or a mixture of complex salts having mutually different counter ions C1 or/and C2.

20. The toner according to claim 1, wherein said organic zirconium compound comprises a structure represented by the following formula (2):

(2)

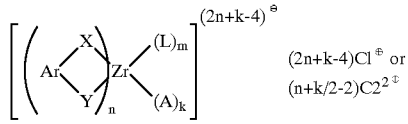

wherein Ar denotes an aromatic residue group capable of having a substituent of alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes O or —CO—O—; L denotes a neutral ligand of water, alcohol, ammonia, alkylamine or pyridine; A denotes an anion of halogen, hydroxyl, carboxylate, carbonate, nitrate, sulfate, cyano or thiocyano, a plurality of A can be identical or different when k≧2; C1 denotes a monovalent cation of hydrogen ion, monovalent metal ion, ammonium ion or alkylammonium ion; C2 denotes a divalent cation of a metal ion; n is 1, 2, 3 or 4; m is 0, 1, 2, 3 or 4; k is 1, 2, 3, 4, 5 or 6; a number (when n≧2) of ligands (of aromatic carboxylic acids and diols) can be identical to or different from each other, and a number (when m≧2) of neutral ligands can be identical to or different from each other in each complex or complex salt of a formula; with the proviso that each complex or complex salt of a formula can also be a mixture of complex compounds having mutually different n or/and m, or a mixture of complex salts having mutually different counter ions C1 or/and C2, and k is doubled when A is a divalent anion.

21. The toner according to claim 1, wherein said organic zirconium compound comprises a structure represented by the following formula (3), (4) or (5):

(3)

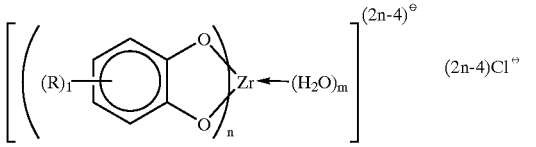

(4)

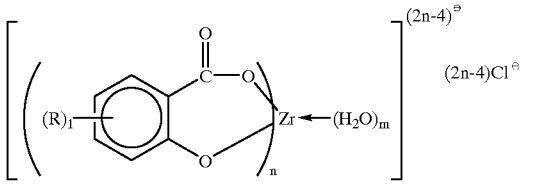

(5)

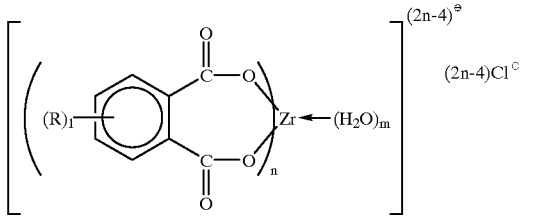

wherein R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when l≧2) of R can be mutually linked to form an alicyclic, aromatic or heterocyclic ring capable of having 1–8 similar R substituent(s); a plurality of R can be identical or different; C1 denotes a monovalent cation of hydrogen, alkaline metal, ammonium or alkylammonium; l is an integer of 1– 8; n is 2, 3 or 4; m is 0, 2 or 4; a plurality (n) of ligands can be identical or different in each complex or complex salt of a formula; with the proviso that each complex or complex salt of a formula can be a mixture of complex compounds having mutually different n or/and m, or a mixture of complex salts having mutually different counter ions C1.

22. The toner according to claim 1, wherein the organic zirconium compound comprises a structure represented by the following formula (6), (7) or (8):

(6)

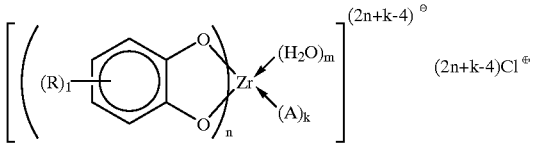

(7)

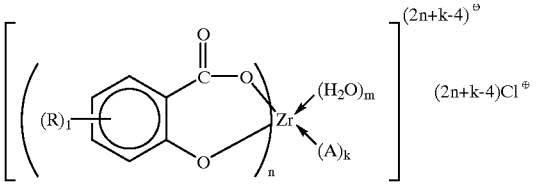

(8)

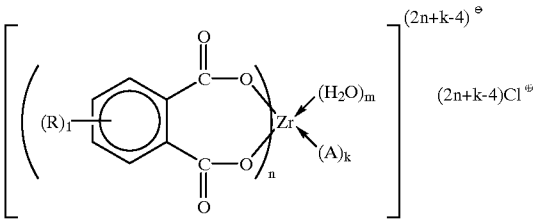

wherein R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when l≧2) of R can be mutually linked to form an alicyclic, aromatic or heterocyclic ring capable of having 1–8 similar R substituent(s); a plurality of R can be identical or different; A denotes an anion of halogen, hydroxyl, carboxylate, carbonate, nitrate, sulfate, cyano or thiocyano, a plurality of A can be identical or different; C1 denotes a monovalent cation of hydrogen, alkaline metal, ammonium or alkylammonium; l is an integer of 1–8; n is 1, 2, 3 or 4; m is 0, 1, 2, 3 or 4; k is 1, 2, 3, 4, 5 or 6; a plurality (when n≧2) of ligands can be identical or different in each complex or complex salt of a formula; with the proviso that each complex or complex salt of a formula can be a mixture of complex compounds having mutually different n or/and m, or a mixture of complex salts having mutually different counter ions C1 or/and anions A, and k is doubled when A is a divalent anion.

23. The toner according to claim 1, wherein the organic zirconium compound comprises a structure represented by the following formula (36) or (37):

$$(\text{Ar-COO}^-)_n Zr^{4\oplus}(4\text{-}n)A_1\ominus \text{ or } (2\text{-}n/2)A_2{}^2\ominus \quad (36)$$

$$(\text{Ar-COO}^-)_n Zr^{4}\oplus(O)(2\text{-}n)A_1\oplus \quad (37),$$

wherein Ar denotes an aromatic residue group capable of having a substituent of alkyl, aryl, aralkyl, cycloalkyl, alkenyl, alkoxy; aryloxy, hydroxyl, acyloxy, alkoxycarbonyl, aryloxycarbonyl, acyl, carboxyl, halogen, nitro, cyano, amino, amido or carbamoyl; $A_1$ denotes a monovalent anion of halogen, hydroxyl, nitrate or carboxylate; $A_2$ denotes a divalent anion, such as sulfate, hydrogenphosphate or carbonate; and n is 1, 2, 3 or 4 with the proviso that in case of n≧2 for each metal salt, $A_1$, $A_2$ and a plurality of aromatic carboxylates and aromatic hydroxycarboxylates as acid ions may be identical to or different from each other, and that each metal salt of a formula can be a mixture of different salts having different numbers of n.

24. The toner according to claim 1, wherein the organic zirconium compound comprises a structure represented by the following formula (38) or (39):

(38)

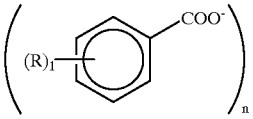

$Zr^{4\oplus}(4-n)A_1^{\ominus}$ or $(2-n/2)A_2^{2\ominus}$ (39)

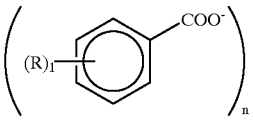

$Zr^{4\oplus}(O)(2-n)A_1^{\ominus}$, wherein R denotes a substituent of hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amido or carbamoyl, a plurality (when $l \geqq 2$) of R can be mutually linked to form an alicyclic, aromatic or heterocyclic ring capable of having 1–8 similar R substituent(s); a plurality of R can be identical or different; $A_1$ denotes a monovalent anion of halogen, hydroxyl, nitrate or carboxylate; $A_2$ denotes a divalent anion of sulfate, hydrogenphosphate or carbonate; l is an integer of 1–8; and n is 1, 2, 3 or 4 with the proviso that in case of $n \geqq 2$ for each metal salt, the anions $A_1$ and $A_2$ and a plurality of acid ions, i.e., aromatic carboxylates and aromatic hydroxycarboxylates may be identical to or different from each other; and that each metal salt of a formula can be a mixture of different salts having different numbers of n.

25. The toner according to claim 1, wherein the organic zirconium compound comprises a structure represented by the following formula (40) or (41):

(40)

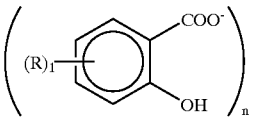

$Zr^{4+}(4-n)A_1^{-}$ or $(2-n/2)A_2^{2-}$ (41)

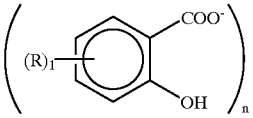

$Zr^{4+}(O)(2-n)A_1^{-}$, wherein R denotes a substituent of hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amido or carbamoyl, a plurality (when $l \geqq 2$) of R can be mutually linked to form an alicyclic, aromatic or heterocyclic ring capable of having 1–8 similar R substituent(s); a plurality of R can be identical or different; $A_1$ denotes a monovalent anion of halogen, hydroxyl, nitrate or carboxylate, $A_2$ denotes a divalent anion of sulfate, hydrogenphosphate or carbonate; l is an integer of 1–8; and n is 1, 2, 3 or 4 with the proviso that in case of $n \geqq 2$ for each metal salt, the anions $A_1$ and $A_2$ and a plurality of aromatic hydroxycarboxylates as acid ions, may be identical to or different from each other, and that each metal salt of a formula can be a mixture of different salts having different numbers of n.

26. The toner according to claim 1, wherein the vinyl polymer has carboxyl group and/or carboxylic anhydride group.

27. The toner according to claim 26, wherein the organic zirconium compound contained in the toner is capable of forming a chloroform-insoluble content through interaction with said carboxyl group and/or carboxylic anhydride group.

28. The toner according to claim 1, wherein the toner contains a chloroform-insoluble content containing the organic zirconium compound in an amount of at least 30 wt. % as zirconium based on an entire amount of the organic zirconium compound in the toner.

29. The toner according to claim 28, wherein the amount is at least 40 wt. %.

30. The toner according to claim 28, wherein the amount is at least 50 wt. %.

31. The toner according to claim 1, wherein the toner contains a chloroform-soluble content having an acid value (Av.S) and a chloroform-insoluble content having an acid value (Av.G) providing a difference therebetween (Av.G–Av.S) of 10–150 mgKOH/g.

32. The toner according to claim 31, wherein the difference (Av.G–Av.S) is 20–130 mgKOH/g.

33. The toner according to claim 31, wherein the difference (Av.G–Av.S) is 30–100 mgKOH/g.

34. The toner according to claim 1, wherein (A) the toner has a contact angle to water of 105–130 degrees, (B) the binder resin comprising a vinyl polymer having an acid value of 5–40 mgKOH/g, (C) the toner contains a resinous component containing a THF-insoluble content in an amount of 5–60 wt. %, and (D) the toner contains a wax providing a GPC chromatogram exhibiting a main peak in a molecular weight range (Mp) of 300–5,000 and a ratio Mw/Mn of 1.2–15 between weight-average molecular weight (Mw) and number-average molecular weight (Mn).

35. The toner according to claim 34, wherein the contact angle is 107–127 degrees.

36. The toner according to claim 34, wherein the contact angle is 110–125 degrees.

37. The toner according to claim 34, wherein the vinyl polymer has an acid value of 7–35 mgKOH/g.

38. The toner according to claim 34, wherein the vinyl polymer has an acid value of 1–30 mgKOH/g.

39. The toner according to claim 34, wherein the THF-insoluble content is in an amount of 7–55 wt. %.

40. The toner according to claim 34, wherein the THF-insoluble content is in an amount of 10–50 wt. %.

41. The toner according to claim 34, wherein the Mp is 600–4,500 and the ratio Mw/Mn is 1.5–10.

42. The toner according to claim 34, wherein the Mp is 700–4,000 and the ratio Mw/Mn is 1.7–8.

43. The toner according to claim 34, wherein the wax is a hydrocarbon wax, a polyethylene wax or a polypropylene wax.

44. The toner according to claim 34, wherein the wax is represented by the formula (1):

$$CH_3\text{-}((CH_2\text{—}CH_2)\text{-}(_a\text{—}CH_2\text{—}CH_2\text{—}A \quad (I),$$

wherein A denotes hydroxyl group or carboxyl group and a is an integer of 20–60.

45. The toner according to claim 34, wherein the wax comprises an acid-modified polypropylene wax having an acid value of 1–20 mgKOH/g.

46. The toner according to claim 34, wherein the wax comprises an acid-modified polyethylene wax having an acid value of 1–20 mgKOH/g.

47. The toner according to claim 34, wherein the wax has a melting point of 70–140° C. in terms of a heat-absorption peak temperature on temperature increase by differential scanning calorimetry (DSC).

48. The toner according to claim 47, wherein the melting point is 80–135° C.

49. The toner according to claim 47, wherein the melting point is 85–130° C.

50. The toner according to claim 34, wherein the toner contains at least two species of different waxes, the entire waxes contained in the toner having a GPC molecular weight distribution showing a main peak in a molecular weight range of 500–7,000 and a ratio Mw/Mn of 1.2–15.

51. The toner according to claim 50, wherein the molecular weight range is 700–6,000 and the ratio Mw/Mn is 1.5–12.

52. The toner according to claim 50, wherein the molecular weight range is 1,000–5,000 and the ratio Mw/Mn is 2–10.

53. The toner according to claim 50, wherein at least one species of the waxes is a hydrocarbon wax, a polyethylene wax or a polypropylene wax.

54. The toner according to claim 50, wherein at least one species of the waxes is represented by the formula (I):

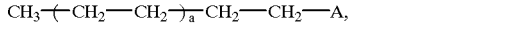

$$CH_3-(CH_2-CH_2)_a-CH_2-CH_2-A, \quad (I)$$

wherein A denotes hydroxyl group or carboxyl group and a is an integer of 20–60.

55. The toner according to claim 50, wherein at least one species of the waxes comprises an acid-modified polypropylene wax having an acid value of 1–20 mgKOH/g.

56. The toner according to claim 50, wherein at least one species of the waxes comprises an acid-modified polyethylene wax having an acid value of 1–20 mgKOH/g.

57. The toner according to claim 34, wherein the binder resin comprises at least 10 wt. % of a vinyl polymer synthesized through a radical polymerization by using an aromatic vinyl monomer and (meth)acrylate monomer in combination with a radical polymerization initiator which has at least two peroxide groups per molecule and different 10 hour-halflife temperatures including a first 10 hours-halflife temperature and a second 10 hour-halflife temperature which provide a difference therebetween of at least 5° C., and changing a polymerization reaction temperature by at least 5° C.

58. The toner according to claim 50, wherein at least one species of the waxes is contained in the binder resin.

59. The toner according to claim 1, wherein the organic zirconium compound is contained in the toner in an amount of 0.5–10 wt. parts per 100 wt. parts of the binder resin.

60. The toner according to claim 1, wherein the organic zirconium compound is contained in the toner in an amount of 1.0–8.0 wt. parts per 100 wt. parts of the binder resin.

61. The toner according to claim 1, wherein the toner is a component of a mono-component developer.

62. The toner according to claim 1, wherein the toner is a component of a two-component developer used in mixture with carrier particles.

63. An image forming method, comprising:

a developing step of developing an electrostatic image held on an image-bearing member with a toner having a negative triboelectric chargeability to form a toner image on the image-bearing member, a transfer step of transferring the toner image formed on the image-bearing member onto a recording material via or without via an intermediate transfer member, and a fixing step of fixing the toner image onto the recording material by a heat-fixing means, wherein the toner comprises at least a binder resin, a colorant, a wax and an organic metal compound, wherein (a) the toner has an acid value of 5–35 mgKOH/g, (b) the binder resin comprises a vinyl polymer, (c) the binder resin in the toner contains a chloroform-insoluble content in an amount of 3–50 wt. %, (d) the toner contains a THF (tetrahydrofuran)-soluble content providing a GPC (gel permeation chromatography) chromatogram exhibiting a main peak in a molecular weight range of 5,000–30,000 and at least one sub-peak and/or shoulder in a molecular weight range of $2\times10^5$–$15\times10^5$ and including 15–70% of a component having molecular weights of $1\times10^4$–$10\times10^4$, and (e) the organic metal compound is an organic zirconium compound comprising a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids.

64. The method according to claim 63, wherein the toner has an acid value of 10–30 mgKOH/g.

65. The method according to claim 63, wherein the chloroform-insoluble content is 5–45 wt. %.

66. The method according to claim 63, wherein the chloroform-insoluble content is 10–40 wt. %.

67. The method according to claim 63, wherein the main peak is in a molecular weight range of 7,000–25,000.

68. The method according to claim 63, wherein the main peak is in a molecular weight range of 9,000–20,000.

69. The method according to claim 63, wherein the THF-soluble content contains 20–60% of a component having molecular weights of $1\times10^4$–$10\times10^4$.

70. The method according to claim 63, wherein the THF-soluble content contains 25–50% of a component having molecular weights above $10^5$.

71. The method according to claim 63, wherein said at least one sub-peak and/or shoulder is in a molecular range of $3\times10^5$–$12\times10^5$.

72. The method according to claim 71, wherein the THF soluble content contains 25–50% of a component having molecular weights above $10^5$.

73. The method according to claim 63, wherein said organic zirconium compound is contained in the toner as a charge control agent.

74. The method according to claim 63, wherein said organic zirconium compound is a zirconium complex comprising a coordination with an aromatic diol, an aromatic hydroxycarboxylic acid or an aromatic polycarboxylic acid.

75. The method according to claim 63, wherein said organic zirconium compound is a zirconium complex salt comprising a coordination with an aromatic diol, an aromatic hydroxycarboxylic acid or an aromatic polycarboxylic acid.

76. The method according to claim 63, wherein said organic zirconium compound comprises a zirconium complex or complex salt having a structure including one ligand of an aromatic diol, an aromatic hydroxycarboxylic acid or an aromatic carboxylic acid.

77. The method according to claim 63, wherein said organic zirconium compound comprises a zirconium complex or complex salt having a structure including two ligands of an aromatic diol, an aromatic hydroxycarboxylic acid or an aromatic carboxylic acid.

78. The method according to claim 63, wherein said organic zirconium compound comprises a zirconium complex or complex salt having a structure including three ligands of an aromatic diol, an aromatic hydroxycarboxylic acid or an aromatic carboxylic acid.

79. The method according to claim 63, wherein said organic zirconium compound comprises a zirconium complex or complex salt having a structure including four ligands of an aromatic diol, an aromatic hydroxycarboxylic acid or an aromatic carboxylic acid.

80. The method according to claim 63, wherein said organic zirconium compound is a zirconium salt comprising an ionic bonding with an aromatic carbolic acid, an aromatic hydroxycarboxylic acid or an aromatic polycarboxylic acid.

81. The method according to claim 63, wherein said organic zirconium compound comprises a structure represented by the following formula (1):

(1)

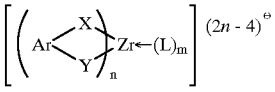

$(2n-4)C1^{\oplus}$ or $(n-2)C2^{2\oplus}$ wherein Ar denotes an aromatic residual group capable of having a substituent of alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes O or —CO—O—; L denotes a neutral ligand of water, alcohol, ammonia, alkylamine or pyridine; C1 denotes a monovalent cation of hydrogen ion, monovalent metal ion, ammonium ion or alkylammonium ion; C2 denotes a divalent cation of a metal ion; n is 2, 3 or 4; m is 0, 2 or 4; a plurality (n) of ligands of aromatic carboxylic acids and diols can be identical to or different from each other, and a plurality (m>0) of neutral ligands can be identical to or different from each other in each complex or complex salt of a formula; with the proviso that each complex or complex salt of a formula can also be a mixture of complex compounds having mutually different n or/and m, or a mixture of complex salts having mutually different counter ions C1 or/and C2.

82. The method according to claim 63, wherein said organic zirconium compound comprises a structure represented by the following formula (2):

(2)

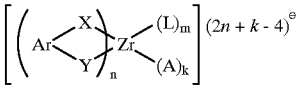

$(2n+k-4)C1^{\oplus}$ or $(n+k/2-2)C2^{2\oplus}$ wherein Ar denotes an aromatic residue group capable of having a substituent of alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes O or —CO—O—; L denotes a neutral ligand of water, alcohol, ammonia, alkylamine or pyridine; A denotes an anion of halogen, hydroxyl, carboxylate, carbonate, nitrate, sulfate, cyano or thiocyano, a plurality of A can be identical or different when k≧2; C1 denotes a monovalent cation of hydrogen ion, monovalent metal ion, ammonium ion or alkylammonium ion; C2 denotes a divalent cation of a metal ion; n is 1, 2, 3 or 4; m is 0, 1, 2, 3 or 4; k is 1, 2, 3, 4, 5 or 6; a number (when n≧2) of ligands (of aromatic carboxylic acids and diols) can be identical to or different from each other, and a number (when m≧2) of neutral ligands can be identical to or different from each other in each complex or complex salt of a formula; with the proviso that each complex or complex salt of a formula can also be a mixture of complex compounds having mutually different n or/and m, or a mixture of complex salts having mutually different counter ions C1 or/and C2, and k is doubled when A is a divalent anion.

83. The method according to claim 63, wherein said organic zirconium compound comprises a structure represented by the following formula (3), (4) or (5):

(3)

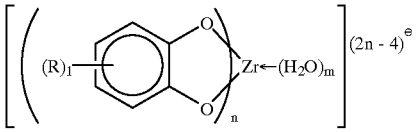

$(2n-4)C1^{\oplus}$ (4)

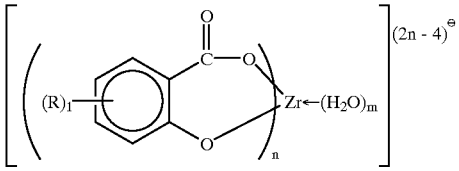

$(2n-4)C1^{\oplus}$ (5)

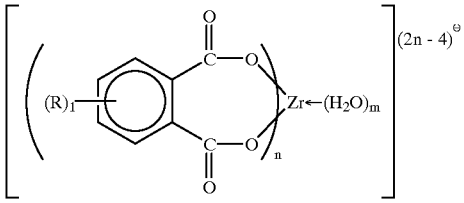

$(2n-4)C1^{\oplus}$ wherein R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when l≧2) of R can be mutually linked to form an alicyclic, aromatic or heterocyclic ring capable of having 1–8 similar R substituent(s); a plurality of R can be identical or different; C1 denotes a monovalent cation of hydrogen, alkaline metal, ammonium or alkylammonium; l is an integer of 1–8; n is 2, 3 or 4; m is 0, 2 or 4; a plurality (n) of ligands can be identical or different in each complex or complex salt of a formula; with the proviso that each complex or complex salt of a formula can be a mixture of complex compounds having mutually different n or/and m, or a mixture of complex salts having mutually different counter ions C1.

84. The method according to claim 63, wherein the organic zirconium compound comprises a structure represented by the following formula (6), (7) or (8):

(6)

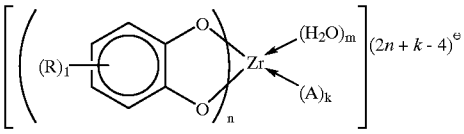

$(2n + k - 4)C1^{\oplus}$ (7)

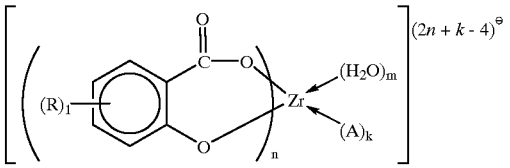

$(2n + k - 4)C1^{\oplus}$ (8)

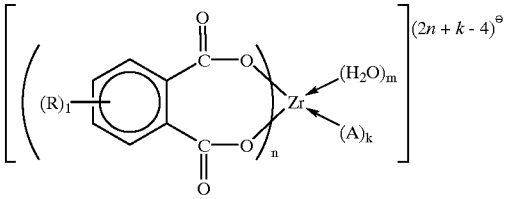

$(2n + k - 4)C1^{\oplus}$ wherein R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when l≧2) of R can be mutually linked to form an alicyclic, aromatic or heterocyclic ring capable of having 1–8 similar R substituent(s); a plurality of R can be identical or different; A denotes an anion of halogen, hydroxyl, carboxylate, carbonate, nitrate, sulfate, cyano or thiocyano, a plurality of A can be identical or different; C1 denotes a monovalent cation of hydrogen, alkaline metal, ammonium or alkylammonium; l is an integer of 1–8; n is 1, 2, 3 or 4; m is 0, 1, 2, 3 or 4; k is 1, 2, 3, 4, 5 or 6; a plurality (when n≧2) of ligands can be identical or different in each complex or complex salt of a formula; with the proviso that each complex or complex salt of a formula can be a mixture of complex compounds having mutually different n or/and m, or a mixture of complex salts having mutually different counter ions C1 or/and anions A, and k is doubled when A is a divalent anion.

85. The method according to claim 63, wherein the organic zirconium compound comprises a structure represented by the following formula (36) or (37):

$$(Ar\text{-}COO^{-})_n Zr^4 \oplus (4\text{-}n)A_1 \ominus \text{ or } (2\text{-}n/2)A_2^{2} \ominus \quad (36)$$

$$(Ar\text{-}COO^{-})_n Zr^4 \oplus (O)(2\text{-}n)A_1 \oplus \quad (37),$$

wherein Ar denotes an aromatic residue group capable of having a substituent of alkyl, aryl, aralkyl, cycloalkyl, alkenyl, alkoxy; aryloxy, hydroxyl, acyloxy, alkoxycarbonyl, aryloxycarbonyl, acyl, carboxyl, halogen, nitro, cyano, amino, amido or carbamoyl; $A_1$ denotes a monovalent anion of halogen, hydroxyl, nitrate or carboxylate; $A_2$ denotes a divalent anion, such as sulfate, hydrogenphosphate or carbonate; and n is 1, 2, 3 or 4 with the proviso that in case of n≧2 for each metal salt, $A_1$, $A_2$ and a plurality of aromatic carboxylates and aromatic hydroxycarboxylates as acid ions may be identical to or different from each other, and that each metal salt of a formula can be a mixture of different salts having different numbers of n.

86. The method according to claim 63, wherein the organic zirconium compound comprises a structure represented by the following formula (38) or (39):

(38)

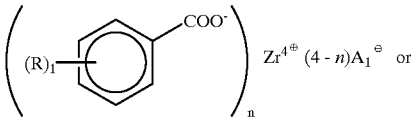

$(2 - n/2)A_2^{2\ominus}$ (39)

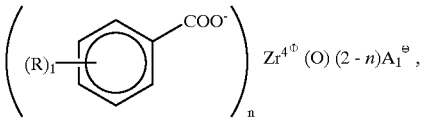

wherein R denotes a substituent of hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amido or carbamoyl, a plurality (when l≧2) of R can be mutually linked to form an alicyclic, aromatic or heterocyclic ring capable of having 1–8 similar R substituent(s); a plurality of R can be identical or different; $A_1$ denotes a monovalent anion of halogen, hydroxyl, nitrate or carboxylate; $A_2$ denotes a divalent anion of sulfate, hydrogenphosphate or carbonate; l is an integer of 1–8; and n is 1, 2, 3 or 4 with the proviso that in case of n≧2 for each metal salt, the anions $A_1$ and $A_2$ and a plurality of acid ions, i.e., aromatic carboxylates and aromatic hydroxycarboxylates may be identical to or different from each other; and that each metal salt of a formula can be a mixture of different salts having different numbers of n.

87. The method according to claim 63, wherein the organic zirconium compound comprises a structure represented by the following formula (40) or (41):

(40)

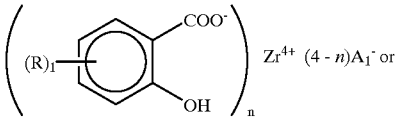

$(2 - n/2)A_2^{2-}$ (41)

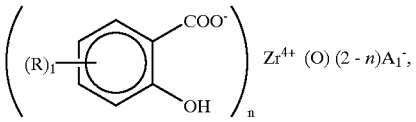

wherein R denotes a substituent of hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amido or carbamoyl, a plurality (when l≧2) of R can be mutually linked to form an alicyclic, aromatic or heterocyclic ring capable of having 1–8 similar R substituent(s); a plurality of R can be identical or different; $A_1$ denotes a monovalent anion of halogen, hydroxyl, nitrate or carboxylate; $A_2$ denotes a divalent anion of sulfate, hydrogenphosphate or carbonate; l is an integer of 1–8; and n is 1, 2, 3 or 4 with the proviso that in case of n≧2 for each metal salt, the anions $A_1$ and $A_2$ and a plurality of aromatic hydroxycarboxylates as acid ions, may be identical to or different from each other, and that each metal salt of a formula can be a mixture of different salts having different numbers of n.

88. The method according to claim 63, wherein the vinyl polymer has carboxyl group and/or carboxylic anhydride group.

89. The method according to claim 88, wherein the organic zirconium compound contained in the toner is capable of forming a chloroform-insoluble content through interaction with said carboxyl group and/or carboxylic anhydride group.

90. The method according to claim 63, wherein the toner contains a chloroform-insoluble content containing the organic zirconium compound in an amount of at least 30 wt. % as zirconium based on an entire amount of the organic zirconium compound in the toner.

91. The method according to claim 90, wherein the amount is at least 40 wt. %.

92. The method according to claim 90, wherein the amount is at least 50 wt. %.

93. The method according to claim 63, wherein the toner contains a chloroform-soluble content having an acid value (Av.S) and a chloroform-insoluble content having an acid value (Av.G) providing a difference therebetween (Av.G–Av.S) of 10–150 mgKOH/g.

94. The method according to claim 93, wherein the difference (Av.G–Av.S) is 20–130 mgKOH/g.

95. The method according to claim 93, wherein the difference (Av.G–Av.S) is 30–100 mgKOH/g.

96. The method according to claim 63, wherein (A) the toner has a contact angle to water of 105–130 degrees, (B) the binder resin comprising a vinyl polymer having an acid value of 5–40 mgKOH/g, (C) the toner contains a resinous component containing a THF-insoluble content in an amount of 5–60 wt. %, and (D) the toner contains a wax providing a GPC chromatogram exhibiting a main peak in a molecular weight range (Mp) of 300–5,000 and a ratio Mw/Mn of 1.2–15 between weight-average molecular weight (Mw) and number-average molecular weight (Mn).

97. The method according to claim 96, wherein the contact angle is 107–127 degrees.

98. The method according to claim 96, wherein the contact angle is 110–125 degrees.

99. The method according to claim 96, wherein the vinyl polymer has an acid value of 7–35 mgKOH/g.

100. The method according to claim 96, wherein the vinyl polymer has an acid value of 1–30 mgKOH/g.

101. The method according to claim 96, wherein the THF-insoluble content is in an amount of 7–55 wt. %.

102. The method according to claim 96, wherein the THF-insoluble content is in an amount of 10–50 wt. %.

103. The method according to claim 96, wherein the Mp is 600–4,500 and the ratio Mw/Mn is 1.5–10.

104. The method according to claim 96, wherein the Mp is 700–4,000 and the ratio Mw/Mn is 1.7–8.

105. The method according to claim 96, wherein the wax is a hydrocarbon wax, a polyethylene wax or a polypropylene wax.

106. The method according to claim 96, wherein the wax is represented by the formula (I):

$$CH_3-(CH_2-CH_2)_a-CH_2-CH_2-A, \quad (I)$$

wherein A denotes hydroxyl group or carboxyl group and a is an integer of 20–60.

107. The method according to claim 96, wherein the wax comprises an acid-modified polypropylene wax having an acid value of 1–20 mgKOH/g.

108. The method according to claim 96, wherein the wax comprises an acid-modified polyethylene wax having an acid value of 1–20 mgKOH/g.

109. The method according to claim 108, wherein the wax has a melting point of 70–140° C. in terms of a heat-absorption peak temperature on temperature increase by differential scanning calorimetry (DSC).

110. The method according to claim 108, wherein the melting point is 80–135° C.

111. The method according to claim 96, wherein the melting point is 85–130° C.

112. The method according to claim 111, wherein the toner contains at least two species of different waxes, the entire waxes contained in the toner having a GPC molecular weight distribution showing a main peak in a molecular weight range of 500–7,000 and a ratio Mw/Mn of 1.2–15.

113. The method according to claim 111, wherein the molecular weight range is 700–6,000 and the ratio Mw/Mn is 1.5–12.

114. The method according to claim 111, wherein the molecular weight range is 1,000–5,000 and the ratio Mw/Mn is 2–10.

115. The method according to claim 111, wherein at least one species of the waxes is a hydrocarbon wax, a polyethylene wax or a polypropylene wax.

116. The method according to claim 111, wherein at least one species of the waxes is represented by the formula (I):

$$CH_3-(CH_2-CH_2)_a-CH_2-CH_2-A, \quad (I)$$

wherein A denotes hydroxyl group or carboxyl group and a is an integer of 20–60.

117. The method according to claim 111, wherein at least one species of the waxes comprises an acid-modified polypropylene wax having an acid value of 1–20 mgKOH/g.

118. The method according to claim 111, wherein at least one species of the waxes comprises an acid-modified polyethylene wax having an acid value of 1–20 mgKOH/g.

119. The method according to claim 96, wherein the binder resin comprises at least 10 wt. % of a vinyl polymer synthesized through a radical polymerization by using an aromatic vinyl monomer and (meth)acrylate monomer in combination with a radical polymerization initiator which has at least two peroxide groups per molecule and different 10 hour-halflife temperatures including a first 10 hours-halflife temperature and a second 10 hour-halflife temperature which provide a difference therebetween of at least 5° C., and changing a polymerization reaction temperature by at least 5° C.

120. The method according to claim 111, wherein at least one species of the waxes is contained in the binder resin.

121. The method according to claim 63, wherein the organic zirconium compound is contained in the toner in an amount of 0.5–10 wt. parts per 100 wt. parts of the binder resin.

122. The method according to claim 63, wherein the organic zirconium compound is contained in the toner in an amount of 1.0–8.0 wt. parts per 100 wt. parts of the binder resin.

123. The method according to claim 63, wherein the toner is a component of a mono-component developer.

124. The method according to claim 63, wherein the toner is a component of a two-component developer used in mixture with carrier particles.

* * * * *

UNITED STATES PATENT AND TRADEMARK OFFICE

CERTIFICATE OF CORRECTION

PATENT NO. : 6,156,470
DATED : December 5, 2000
INVENTOR(S) : Satoshi Matsunaga et al.

It is certified that error appears in the above-identified patent and that said Letters Patent is hereby corrected as shown below:

Title page,
Item [56], References Cited, OTHER PUBLICATIONS,
"Sect.. Ch," should read -- Sect. Ch, --.

Column 4,
Line 32, "acids an" should read -- acid, an --.

Column 8,
Line 18, "preferably" should read -- preferably be --;
Line 19, "(before" should read -- (before being --;
Line 26, "after" should read -- after being --;
Line 52, "Yw/Mn" should read -- Mw/Mn --.

Column 9,
Line 4, "Yw/Mn" should read -- Mw/Mn --;
Line 28, "represents" should read -- represents a --.

Column 11,
Line 4, "having" should read -- having a --;
Line 50, "of" should read -- of a --.

Column 20,
Line 63, "$(4\text{-}n)A_{1\ominus}$" should read -- $(4\text{-}n)A_1^{\ominus}$ --;
Line 63, "$(2\text{-}n)A_{1\ominus}$" should read -- $(2\text{-}n)A_1^{\ominus}$ --.

Column 21,
Line 33, "$(2\text{-}n)A_2^{2\ominus}$," should read -- $(2\text{-}n)A_1^{\ominus}$, --.

Column 23,
Formula (44),

"
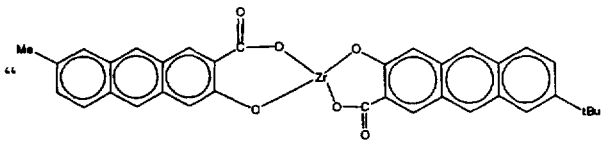
(44)
"

should read

--
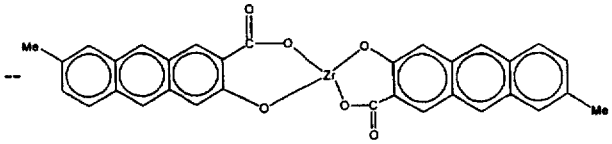
(44)
--.

UNITED STATES PATENT AND TRADEMARK OFFICE

CERTIFICATE OF CORRECTION

PATENT NO. : 6,156,470
DATED : December 5, 2000
INVENTOR(S) : Satoshi Matsunaga et al.

It is certified that error appears in the above-identified patent and that said Letters Patent is hereby corrected as shown below:

Column 54,
Line 63, "butylperoxycyclohexyl) propane," should read -- butylperoxycyclohexyl)-propane, --;

Column 55,
Line 8, "butylperoxycyclohexyl)" should read -- butylperoxycyclohexyl)- --;
Line 21, "(t-butylperoxy)valerate," should read -- (t-butylperoxy)-valerate, --.

Column 56,
Line 11, "hydroxyphenyl)" should read -- hydroxyphenyl)- --.

Column 59,
Line 3, "be" should be deleted.

Column 61,
Line 50, "in" should read -- in a --.

Column 64,
Line 57, "provide" should read -- providing --.

Column 65,
Line 54, "replaced" should read -- replaced by --.

Column 68,
Line 17, "x100" should read -- x100. --.

Column 70,
Line 45, "TA-IL" should read -- TA-II --.

Column 71,
Line 30, "filed" should read -- field --.

Column 89,
Table 8, "1.3" should read -- 1.38 --.

UNITED STATES PATENT AND TRADEMARK OFFICE

CERTIFICATE OF CORRECTION

PATENT NO. : 6,156,470
DATED : December 5, 2000
INVENTOR(S) : Satoshi Matsunaga et al.

It is certified that error appears in the above-identified patent and that said Letters Patent is hereby corrected as shown below:

Column 96,
Line 55, "(1):" should read -- (I): --;

Column 97,
Line 41, "hours-" should read -- hour --.

Column 101,
Line 62, "alkoxy;" should read -- alkoxy, --.

Column 104,
Line 56, "hours-" should read -- hour --.

Signed and Sealed this

Sixteenth Day of April, 2002

*Attest:*

*Attesting Officer*

JAMES E. ROGAN
*Director of the United States Patent and Trademark Office*